US011682824B2

(12) United States Patent
Kim et al.

(10) Patent No.: US 11,682,824 B2
(45) Date of Patent: Jun. 20, 2023

(54) ANTENNA MODULE DISPOSED IN VEHICLE

(71) Applicant: LG ELECTRONICS INC., Seoul (KR)

(72) Inventors: Dongjin Kim, Seoul (KR); Kangjae Jung, Seoul (KR); Byeongyong Park, Seoul (KR); Youngtaek Hong, Seoul (KR); Ilnam Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/665,024

(22) Filed: Feb. 4, 2022

(65) Prior Publication Data

US 2023/0094098 A1 Mar. 30, 2023

(30) Foreign Application Priority Data

Sep. 28, 2021 (WO) ..... PCT/KR2021/013168

(51) Int. Cl.
*H01Q 1/12* (2006.01)
*H01Q 1/52* (2006.01)
*H01Q 5/25* (2015.01)

(52) U.S. Cl.
CPC ..... *H01Q 1/1271* (2013.01); *H01Q 1/523* (2013.01); *H01Q 5/25* (2015.01)

(58) Field of Classification Search
CPC ..... H01Q 1/1271; H01Q 5/25; H01Q 1/523; H01Q 1/3291; H01Q 19/005; H01P 7/086
See application file for complete search history.

(56) References Cited

U.S. PATENT DOCUMENTS 5,418,543 A * 5/1995 Bolton ..... H01Q 1/1271 343/846
6,111,552 A * 8/2000 Gasser ..... H01Q 1/1271 343/873

(Continued)

FOREIGN PATENT DOCUMENTS

CN 108631052 A * 10/2018 ..... H01Q 1/38
EP 1944828 A2 * 7/2008 ..... H01Q 1/243

(Continued)

OTHER PUBLICATIONS

European Patent Office Application Serial No. 22165274.6, Search Report dated Sep. 23, 2022, 8 pages.

(Continued)

*Primary Examiner* — Ricardo I Magallanes
*Assistant Examiner* — Jordan E. DeWitt
(74) *Attorney, Agent, or Firm* — Lee Hong Degerman Kang Waimey

(57) ABSTRACT

An antenna assembly according to the present disclosure includes a dielectric substrate, and antenna elements configured as conductive patterns on the dielectric substrate to radiate radio signals. The antenna elements may include a first radiation structure and a second radiation structure. The first radiation structure includes a first conductive pattern electrically connected a first feeding portion, a second conductive pattern and a third conductive pattern electrically connected a ground. The second radiation structure includes a fourth conductive pattern electrically connected a second feeding portion and a fifth conductive pattern and a sixth conductive pattern electrically connected the ground. The first conductive pattern may be disposed between the second conductive pattern and the third conductive pattern.

12 Claims, 28 Drawing Sheets

(56) References Cited

U.S. PATENT DOCUMENTS 6,369,768 B1 * 4/2002 Fusinski ..... H01Q 9/44 343/704
6,738,026 B1 * 5/2004 McKivergan ..... H01Q 9/42 343/893
7,042,401 B2 * 5/2006 Park ..... H01Q 1/38 343/700 MS
7,215,285 B2 * 5/2007 Song ..... H01Q 21/30 343/700 MS
7,369,094 B2 * 5/2008 Song ..... H01Q 1/38 343/810
9,425,498 B2 * 8/2016 Lee ..... H01Q 21/28
10,833,418 B2 * 11/2020 Cheng ..... H01Q 1/243
2007/0024503 A1 * 2/2007 Tsai ..... H01Q 1/38 343/795
2007/0290927 A1 * 12/2007 Rowell ..... H01Q 19/005 343/834
2008/0150806 A1 * 6/2008 Qin ..... H01Q 1/38 343/700 MS
2008/0158068 A1 * 7/2008 Huang ..... H01Q 9/0421 343/700 MS
2008/0204326 A1 * 8/2008 Zeinolabedin Rafi ..... H01Q 9/0428 343/700 MS
2009/0212886 A1 * 8/2009 Satoh ..... H01P 7/086 333/204
2009/0256769 A1 * 10/2009 Kan ..... H01Q 9/285 343/819
2013/0057443 A1 * 3/2013 Asanuma ..... H01Q 5/314 343/751
2014/0312491 A1 * 10/2014 Jin ..... H01L 23/5225 257/737
2017/0033461 A1 * 2/2017 Mohajer Jasebi ... H01Q 1/2291
2017/0271764 A1 9/2017 Gabriel et al.
2018/0269578 A1 * 9/2018 Wu ..... H01Q 5/40
2019/0372215 A1 * 12/2019 Lee ..... H01Q 5/378
2020/0067182 A1 * 2/2020 Huang ..... H01Q 5/48
2020/0083599 A1 * 3/2020 Huang ..... H01Q 1/243
2020/0194966 A1 * 6/2020 Kim ..... H01S 5/02469
2020/0411994 A1 * 12/2020 Chen ..... H01Q 9/0407
2021/0066801 A1 3/2021 Tsai et al.
2022/0029294 A1 * 1/2022 Kaushal ..... H01Q 9/28
2022/0094038 A1 * 3/2022 Wang ..... H01Q 1/38
2022/0140483 A1 * 5/2022 Hung ..... H01Q 9/0464 343/844
2022/0320736 A1 * 10/2022 Jung ..... H01Q 1/32
2022/0399907 A1 * 12/2022 Wei ..... H01Q 1/38
2023/0033007 A1 * 2/2023 Lou ..... H01Q 9/0414

FOREIGN PATENT DOCUMENTS

EP 3376592 A1 * 9/2018 ..... H01Q 1/243
EP 3627713 3/2020
EP 3627713 A2 * 3/2020 ..... H01Q 1/38
JP 2015-050517 3/2015
KR 2010-0059076 6/2010
KR 2012-0035459 4/2012
WO WO-0159881 A1 * 8/2001 ..... H01Q 1/38
WO WO-2016034900 A1 * 3/2016 ..... H01Q 1/243
WO WO-2022092514 A1 * 5/2022 ..... H01Q 1/1271

OTHER PUBLICATIONS

Wang et al., "A Compact CPW-fed UWB-MIMO Antenna with Isolation Enhancement," ICWMMN 2017 Proceedings, Nov. 2017, 4 pages.
Ullah et al., "Enhanced-Performance Circularly Polarized MIMO Antenna With Polarization/Pattern Diversity," IEEE Access, Jan. 2020, 9 pages.
Potti et al., "A Novel Optically Transparent UWB Antenna for Automotive MIMO Communications," IEEE Transactions on Antennas and Propagation, vol. 69, No. 7, Jul. 2021, 8 pages.
PCT International Application No. PCT/KR2021/013168, Written Opinion and International Search Report dated Jun. 24, 2022, 9 pages.

* cited by examiner (a)

(b)

(a)

(b)

(a)

(b)

(a)

(b)

(a)

(b)

ANTENNA MODULE DISPOSED IN VEHICLE

CROSS-REFERENCE TO RELATED APPLICATIONS

Pursuant to 35 U.S.C. § 119 (a), this application claims the benefit of an earlier filing date and right of priority to International Application No. PCT/KR2021/013168 filed on Sep. 28, 2021, the contents of which are hereby incorporated by reference herein in their entireties.

TECHNICAL FIELD

This specification relates to a wideband antenna disposed in a vehicle. One particular implementation relates to an antenna system having a wideband antenna that is made of a transparent material to operate in various communication systems, and to a vehicle having the same.

BACKGROUND

A vehicle may perform wireless communication services with other vehicles or nearby objects, infrastructures, or a base station. In this regard, various communication services can be provided through a wireless communication system to which an LTE communication technology or a 5G communication technology is applied. Some of LTE frequency bands may be allocated to provide 5G communication services.

On the other hand, there is a problem in that a vehicle body and a vehicle roof are formed of a metallic material to block radio waves. Accordingly, a separate antenna structure may be disposed on a top of the vehicle body or the vehicle roof. Or, when the antenna structure is disposed on a bottom of the vehicle body or roof, a portion of the vehicle body or roof corresponding to a region where the antenna structure is disposed may be formed of a non-metallic material.

However, in terms of design, the vehicle body or roof needs to be integrally formed. In this case, the exterior of the vehicle body or roof may be formed of a metallic material. This may cause antenna efficiency to be drastically lowered due to the vehicle body or roof.

In order to increase a communication capacity without a change in the exterior design of the vehicle, a transparent antenna may be disposed on glass corresponding to a window of the vehicle. However, antenna radiation efficiency and impedance bandwidth characteristics may be deteriorated due to an electrical loss of the transparent antenna.

Meanwhile, a structure in which an antenna layer with an antenna pattern and a ground layer with a ground pattern are disposed on different planes is generally used. In particular, when operating as a wideband antenna, it is necessary to increase a thickness between the antenna layer and the ground layer. However, for a transparent antenna for a vehicle, an antenna region and a ground region need to be disposed on the same layer. Such an antenna in which the antenna pattern and the ground pattern are disposed on the same layer is difficult to operate as a wideband antenna.

In addition, even when the wideband antenna is implemented as a transparent antenna for a vehicle, it is necessary to provide Multiple-input/Multi-output (MIMO) through a plurality of antenna elements. However, any guideline on how to optimally arrange the plurality of antenna elements in a given space of the vehicle glass has not been introduced.

SUMMARY

The present disclosure is directed to solving the aforementioned problems and other drawbacks. The prevent disclosure also describes an antenna made of a transparent material that is capable of operating in a wideband range while providing LTE and 5G communication services.

The present disclosure further describes a wideband antenna structure made of a transparent material that can be implemented in various shapes on a single plane.

The present disclosure further describes a wideband antenna structure made of a transparent material that can reduce a feeding loss and improve antenna efficiency while operating in a wideband range.

The present disclosure further describes an antenna structure made of a transparent material that can improve antenna efficiency and can be reduced in size while operating in a wideband range.

The present disclosure further describes a structure in which a transparent antenna having improved antenna efficiency while operating in a wideband range can be disposed at various positions on a window of a vehicle.

The present disclosure further describes improvement of communication performance by arranging a plurality of transparent antennas on glass of a vehicle or a display of an electronic device.

The present disclosure further describes performing of Multiple-input/Multi-output (MIMO) by arranging a plurality of transparent antennas in a limited space of glass of a vehicle.

The present disclosure further describes minimizing interference between antennas while providing Multiple-input/Multi-output (MIMO) by arranging a plurality of transparent antennas in a limited space of glass of a vehicle.

According to those and other advantages of the subject matter described in this application, an antenna assembly may include a dielectric substrate, and antenna elements configured as conductive patterns on the dielectric substrate to radiate radio signals. The antenna elements may include a first radiation structure and a second radiation structure. The first radiation structure includes a first conductive pattern electrically connected a first feeding portion, a second conductive pattern and a third conductive pattern electrically connected a ground. The second radiation structure includes a fourth conductive pattern electrically connected a second feeding portion and a fifth conductive pattern and a sixth conductive pattern electrically connected the ground. The first conductive pattern may be disposed between the second conductive pattern and the third conductive pattern.

In some implementations, a size of the second conductive pattern may be smaller than a size of the third conductive pattern. The fourth conductive pattern may be disposed between the fifth conductive pattern and the sixth conductive pattern. In addition, a size of the fifth conductive pattern may be bigger than a size of the sixth conductive pattern.

In some implementations, the third conductive pattern and the fifth conductive pattern may be separated by a gap region. The gap region comprises a first gap portion and a second gap portion. In this regard, a distance of the first gap portion may be wider than a distance of the second gap portion. The first radiation structure and the second radiation structure may be configured in a symmetrical structure with respect to a center line between the first radiation structure and the second radiation structure.

In some implementations, a height of the first conductive pattern may be higher than a height of the second conductive pattern. In addition, a height of the third conductive pattern may be higher than the height of the first conductive pattern. In addition, a height of the fourth conductive pattern may be higher than a height of the sixth conductive pattern. In addition, a height of the fifth conductive pattern may be higher than the height of the fourth conductive pattern.

In some implementations, the third conductive pattern may have a first region and a second region. The first region may be connected with the second region. The fifth conductive pattern may have a third region and a fourth region. The third region may be connected with the fourth region. A portion of the second region and a portion of the fourth region may be connected with the ground.

In some implementations, a boundary of the third conductive pattern may be faced with a boundary of the fifth conductive pattern.

In some implementations, the boundary of the third conductive pattern in the second region may be separated from the boundary of the fifth conductive pattern in the fourth region by a first width. The boundary of the third conductive pattern in the first region may be separated from the boundary of the fifth conductive pattern in the third region by a second width. The first width may be wider than the second width.

In some implementations, a height of the boundary of the third conductive pattern in the second region may be higher than a height of the boundary of the third conductive pattern in the first region. A height of the boundary of the fifth conductive pattern in the fourth region may be higher than a height of the boundary of the fifth conductive pattern in the third region. The height of the boundary of the third conductive pattern in the second region and the height of the boundary of the fifth conductive pattern in the fourth region may be same height. The height of the boundary of the third conductive pattern in the first region and the height of the boundary of the fifth conductive pattern in the third region may be same height.

In some implementations, the antenna elements may further comprise a third radiation structure. The third radiation structure may be disposed in the first gap region. A width of the third radiation structure may be same with the distance of the second gap portion. A height of the third radiation structure may be smaller than a height of the second gap portion.

In some implementations, the third radiation structure may be configured in a symmetrical structure with respect to the center line between the first radiation structure and the second radiation structure.

In some implementations, the third radiation structure may comprise a seventh conductive pattern having an opening, a first end and a second end of the seventh conductive pattern electrically are connected with the ground, an eighth conductive pattern disposed in the opening, a third end and a fourth end of eighth conductive pattern electrically are connected with the ground, a first slot (SR1) disposed between the seventh conductive pattern and the eighth conductive pattern, a ninth conductive pattern disposed in the first slot, an end of the ninth conductive pattern electrically is connected with a third feeding portion, and a tenth conductive pattern disposed in the first slot, an end of the tenth conductive pattern electrically is connected with a fourth feeding portion.

In some implementations, the eight conductive pattern may comprise a first part, a second part and a third part connecting the first part and the second part. The second part may have the third end and the fourth end of the eighth conductive pattern. The second part and the third part may be disposed between the ninth conductive pattern and the tenth conductive pattern.

In some implementations, the first conductive pattern to the tenth conductive pattern may be formed as a metal mesh shape having a plurality of opening area on the dielectric substrate. The first radiation structure, the second radiation structure and the third radiation structure may be disposed on one surface of the dielectric substrate. The first radiation structure, the second radiation structure and the third radiation structure may be a Coplanar Waveguide (CPW) structure.

In some implementations, the antenna assembly may further comprise a plurality of dummy mesh grid pattern at outside portion of the first radiation structure, the second radiation structure and the third radiation structure on the one surface of the dielectric substrate. The plurality of dummy mesh grid pattern may be not connected with the feeding portions and the ground. The plurality of dummy mesh grid pattern may be separated with each other.

In some implementations, the first radiation structure may operate as a first antenna. The second radiation structure may operate as a second antenna. The first radiation structure and the second radiation structure may operate in a Low, a Middle, a High and an Ultra High frequency bands. The third radiation structure may operate as a third antenna and a fourth antenna. The third radiation structure may operate in the Middle, the High and the Ultra High frequency bands.

In some implementations, the first radiation structure and the second radiation structure may operate as a 2×2 Multi input Multi output system in the Low frequency band. The first radiation structure, the second radiation structure and the third radiation structure may operate as a 4×4 Multi input Multi output system in the Middle, High and Ultra High frequency bands.

In some implementations, the first radiation structure, the second radiation structure and the third radiation structure may be disposed at a rectangle size in width 102 mm×length 146 mm.

In an antenna system for a vehicle according another aspect of the subject matter described in this application, the vehicle may include a conductive vehicle body operating as an electrical ground. The antenna system may include glass constituting a window of the vehicle, a dielectric substrate attached to the glass and having conductive patterns in a form of a mesh grid, and antenna elements configured as conductive patterns on the dielectric substrate and configured to radiate radio signals. The antenna elements may include a first radiation structure and a second radiation structure. The first radiation structure includes a first conductive pattern electrically connected a first feeding portion, a second conductive pattern and a third conductive pattern electrically connected a ground. The second radiation structure includes a fourth conductive pattern electrically connected a second feeding portion and a fifth conductive pattern and a sixth conductive pattern electrically connected the ground. The first conductive pattern may be disposed between the second conductive pattern and the third conductive pattern.

In some implementations, a size of the second conductive pattern may be smaller than a size of the third conductive pattern. The fourth conductive pattern may be disposed between the fifth conductive pattern and the sixth conductive pattern. In addition, a size of the fifth conductive pattern may be bigger than a size of the sixth conductive pattern.

In some implementations, the third conductive pattern and the fifth conductive pattern may be separated by a gap region. The gap region comprises a first gap portion and a second gap portion. In this regard, a distance of the first gap portion may be wider than a distance of the second gap portion. The first radiation structure and the second radiation structure may be configured in a symmetrical structure with respect to a center line between the first radiation structure and the second radiation structure.

In some implementations, a height of the first conductive pattern may be higher than a height of the second conductive pattern. In addition, a height of the third conductive pattern may be higher than the height of the first conductive pattern. In addition, a height of the fourth conductive pattern may be higher than a height of the sixth conductive pattern. In addition, a height of the fifth conductive pattern may be higher than the height of the fourth conductive pattern.

In some implementations, the first radiation structure and the second radiation structure may be connected to a first feeding line and a second feeding line to operate as a first antenna and a second antenna. The third radiation structure may be connected to a third feeding line and a fourth feeding line to operate as a third antenna and a fourth antenna.

In some implementations, the antenna system may further include a transceiver circuit operably coupled to antenna elements through the first feeding line to the fourth feeding line, and configured to control a radio signal of at least one of the first band to the third band to be radiated through the antenna assembly. The antenna system may further include a processor operably coupled to the transceiver circuit to control the transceiver circuit.

In some implementations, the processor may perform Multi-input/Multi-output (MIMO) in the first band through the first antenna and the second antenna, and perform MIMO in at least one of the second band and the third band through the first to fourth antennas. The processor may control the transceiver circuit to perform Carrier Aggregation (CA) or Dual Connectivity (DC) through at least one of the first to fourth antennas.

Technical effects of a wideband antenna disposed at a vehicle will be described as follows.

In some implementations, an antenna made of a transparent material that operates in a wide band capable of providing LTE and 5G communication services can be provided by allowing grounds asymmetrically disposed at both sides of a radiator region to operate in different bands.

In some implementations, a transparent antenna made of a transparent material, which has a radiator region including conductive patterns of a stepped structure with different widths so as to form multiple resonance points and can operate in a wideband range, can be provided.

In some implementations, an entire size of a transparent antenna and a feeding loss can be minimized by minimizing a length of feeding lines.

In some implementations, an antenna structure made of a transparent material that can be minimized in antenna size while operating in a wideband range by employing a CPW feeding structure and a radiator structure in which ground regions are formed in an asymmetric structure can be provided.

In some implementations, an antenna structure of a transparent material, which can obtain improved antenna efficiency and transparency while operating in a wideband range by implementing conductive patterns in a metal mesh structure and defining a dummy pattern even at a dielectric region, can be provided.

In some implementations, a structure, in which an antenna structure made of a transparent material with improved antenna efficiency while operating in a wideband range can be disposed at various positions, such as an upper, lower, or side region of a front window of a vehicle, can be provided.

In some implementations, communication performance can be improved by arranging a plurality of transparent antennas on glass of a vehicle or a display of an electronic device.

In some implementations, antenna performance can be optimized for each band and communication capacity can be increased by arranging a plurality of transparent antennas in a symmetrical structure within a limited space of glass of a vehicle and some antenna elements are configured in a different form.

In some implementations, antenna interference between antenna elements can be reduced when the antenna elements operate simultaneously, by way of arranging a plurality of transparent antennas in a symmetrical structure within a limited space of glass of a vehicle and some antenna elements are configured in a different form.

Further scope of applicability of the present disclosure will become apparent from the following detailed description. It should be understood, however, that the detailed description and specific examples, such as the preferred embodiment of the invention, are given by way of illustration only, since various changes and modifications within the spirit and scope of the invention will be apparent to those skilled in the art.

DETAILED DESCRIPTION

Description will now be given in detail according to exemplary embodiments disclosed herein, with reference to the accompanying drawings. For the sake of brief description with reference to the drawings, the same or equivalent components may be provided with the same or similar reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In describing the present disclosure, if a detailed explanation for a related known function or construction is considered to unnecessarily divert the gist of the present disclosure, such explanation has been omitted but would be understood by those skilled in the art. The accompanying drawings are used to help easily understand the technical idea of the present disclosure and it should be understood that the idea of the present disclosure is not limited by the accompanying drawings. The idea of the present disclosure should be construed to extend to any alterations, equivalents and substitutes besides the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be connected with the another element or intervening elements may also be present. In contrast, when an element is referred to as being "directly connected with" another element, there are no intervening elements present.

A singular representation may include a plural representation unless it represents a definitely different meaning from the context.

Terms such as "include" or "has" are used herein and should be understood that they are intended to indicate an existence of several components, functions or steps, disclosed in the specification, and it is also understood that greater or fewer components, functions, or steps may likewise be utilized.

An antenna system described herein may be mounted on a vehicle. Configurations and operations according to implementations may also be applied to a communication system, namely, antenna system mounted on a vehicle. In this regard, the antenna system mounted on the vehicle may include a plurality of antennas, and a transceiver circuit and a processor for controlling the plurality of antennas.

Figure 1A:
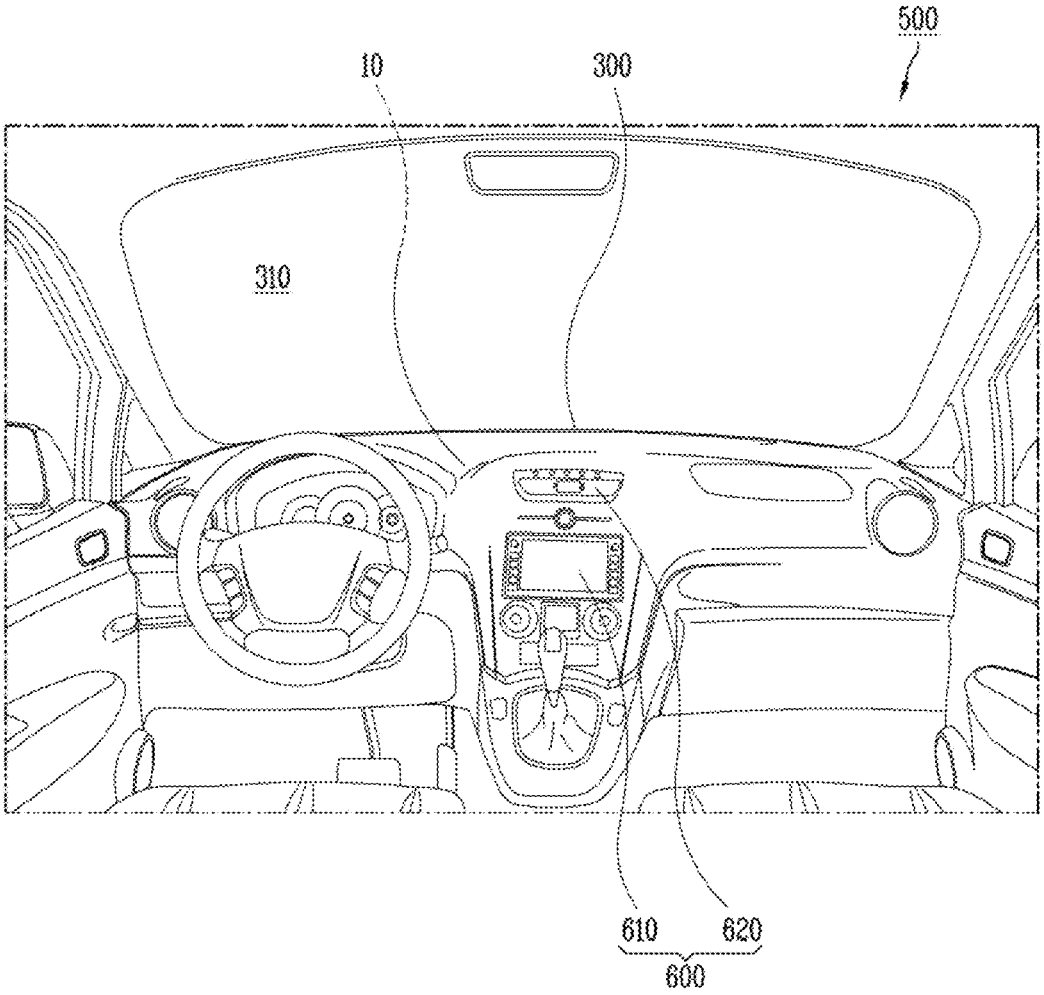
FIG. 1A is a diagram illustrating a vehicle interior in accordance with one example.
Figure 1B:
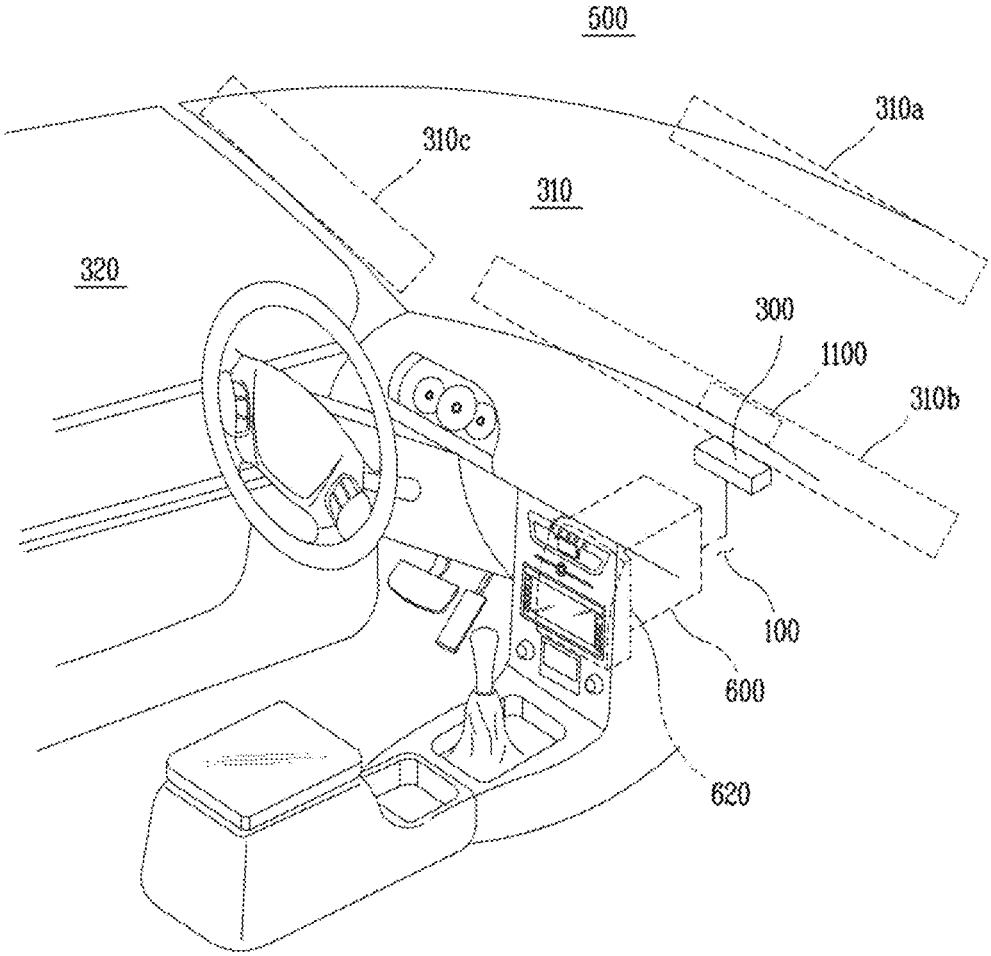
FIG. 1B is a lateral view illustrating the vehicle interior in accordance with the one example.

FIG. 1A is a diagram illustrating a vehicle interior in accordance with one example. FIG. 1B is a lateral view illustrating the vehicle interior in accordance with the one example.

As illustrated in FIGS. 1A and 1B, the present disclosure describes an antenna unit (i.e., an internal antenna system) 1000 capable of transmitting and receiving signals through GPS, 4G wireless communication, 5G wireless communication, Bluetooth, or wireless LAN. Therefore, the antenna unit (i.e., the antenna system) 1000 capable of supporting these various communication protocols may be referred to as an integrated antenna module 1000. The antenna system 1000 may include a telematics control unit (TCU) 300 and an antenna assembly 1100. For example, the antenna assembly 1100 may be disposed on a window of a vehicle.

The present disclosure also describes a vehicle 500 having the antenna system 1000. The vehicle 500 may include a dashboard and a housing 10 including the telematics control unit (TCU) 300 and the like. In addition, the vehicle 500 may include a mounting bracket for mounting the telematics control unit (TCU) 300.

The vehicle 500 may include the telematics control unit (TCU) 300 and an infotainment unit 600 configured to be connected to the telematics control unit 300. A portion of a front pattern of the infotainment unit 600 may be implemented in the form of a dashboard of the vehicle. A display 610 and an audio unit 620 may be included in the dashboard of the vehicle.

The antenna assembly 1100, namely, the antenna module 1100 in the form of a transparent antenna may be disposed at at least one of an upper region 310*a*, a lower region 310*b*, and a side region 310*c* of a front window 310. The antenna assembly 1100 may also be disposed at a side window 320, which is disposed at a side surface of the vehicle, in addition to the front window 310.

As illustrated in FIG. 1B, when the antenna assembly 1100 is disposed at the lower region 310*b* of the front window 310, it may be operably coupled to a TCU 300 disposed inside the vehicle. When the antenna assembly 1100 is disposed at the upper region 310*a* or the side region 310*c* of the front window 310, it may be operably coupled to a TCU disposed outside the vehicle. However, the present disclosure may not be limited to the TCU coupling configuration inside or outside the vehicle.

<V2X (Vehicle-to-Everything)>

V2X communication may include communications between a vehicle and all entities, such as V2V (Vehicle-to-Vehicle) which refers to communication between vehicles, V2I (Vehicle-to-Infrastructure) which refers to communication between a vehicle and an eNB or RSU (Road Side Unit), V2P (Vehicle-to-Pedestrian) which refers to communication between a vehicle and a terminal possessed by a person (pedestrian, cyclist, vehicle driver, or passenger), V2N (vehicle-to-network), and the like.

V2X communication may indicate the same meaning as V2X sidelink or NR V2X or may indicate a broader meaning including V2X sidelink or NR V2X.

V2X communication can be applied to various services, for example, forward collision warning, automatic parking system, Cooperative Adaptive Cruise Control (CACC), control loss warning, traffic queue warning, traffic vulnerable safety warning, emergency vehicle warning, speed warning when driving on a curved road, traffic flow control, and the like.

V2X communication may be provided through a PC5 interface and/or a Uu interface. In this case, specific network entities for supporting communications between a vehicle and all entities may exist in a wireless communication system supporting V2X communication. For example, the network entity may include a base station (eNB), a Road Side Unit (RSU), a terminal, or an application server (e.g., a traffic safety server).

In addition, a terminal performing V2X communication may refer to not only a general handheld UE but also a vehicle (V-UE), a pedestrian UE, an RSU of an eNB type, an RSU of a UE type, a robot equipped with a communication module, and the like.

V2X communication may be performed directly between terminals or may be performed through the network entity (entities). V2X operation modes may be classified according to a method of performing such V2X communication.

Terms used in V2X communication may be defined as follows.

A Road Side Unit (RSU) is a V2X service enabled device that can transmit and receive data to and from a moving vehicle using V2I service. The RSU is also a stationary infrastructure entity supporting V2X application programs, and can exchange messages with other entities that support V2X application programs. The RSU is a term frequently used in existing ITS specifications, and the reason for introducing this term to the 3GPP specifications is to make the documents easier to read for the ITS industry. The RSU is a logical entity that combines a V2X application logic with the functionality of an eNB (referred to as an eNB-type RSU) or a UE (referred to as a UE-type RSU).

V2I Service is a type of V2X service where one party is a vehicle whereas the other party is an entity belonging to infrastructure. V2P Service is also a type of V2X service where one party is a vehicle and the other party is a device carried by an individual (e.g., a handheld terminal carried by a pedestrian, a cyclist, a driver, or a passenger). V2X Service is a type of 3GPP communication service that involves a transmitting or receiving device on a vehicle. Based on the other party involved in the communication, it may be further divided into V2V service, V2I service and V2P service.

V2X enabled UE is a UE that supports V2X service. V2V Service is a type of V2X service, where both parties of communication are vehicles. V2V communication range is a direct communication range between two vehicles engaged in V2V service.

Figure 2A:
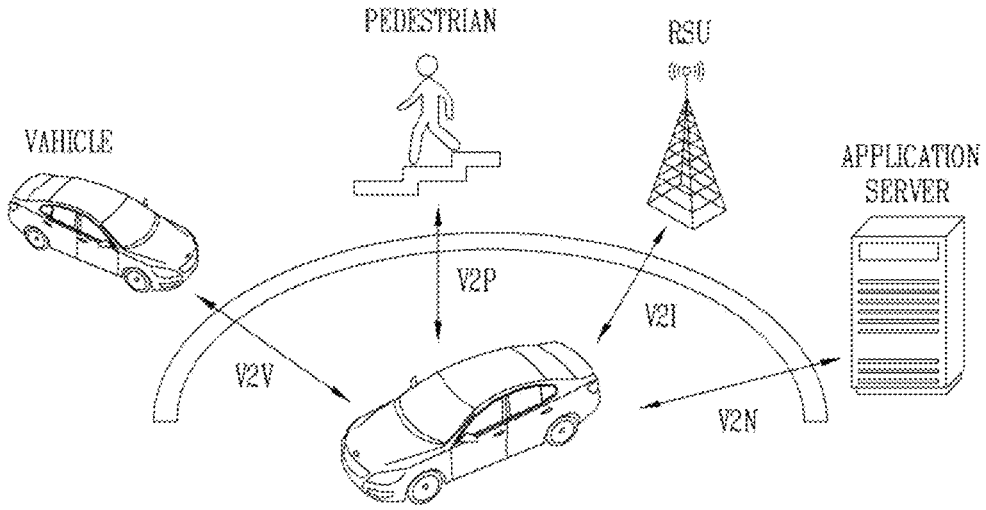
FIG. 2A illustrates a type of V2X application.

V2X applications, referred to as Vehicle-to-Everything (V2X), include the four different types, as described above, namely, (1) vehicle-to-vehicle (V2V), (2) vehicle-to-infrastructure (V2I), (3) vehicle-to-network (V2N), (4) vehicle-to-pedestrian (V2P). FIG. 2A illustrates a type of V2X application. Referring to FIG. 2A, the four types of V2X applications may use "cooperative awareness" to provide more intelligent services for end-users.

This means that entities, such as vehicles, roadside infrastructures, application servers and pedestrians, may collect knowledge of their local environments (e.g., information received from other vehicles or sensor equipment in proximity) to process and share that knowledge in order to provide more intelligent services, such as cooperative collision warning or autonomous driving.

<NR V2X>

Support for V2V and V2X services has been introduced in LTE during Releases 14 and 15, in order to expand the 3GPP platform to the automotive industry.

Requirements for support of enhanced V2X use cases are broadly arranged into four use case groups.

(1) Vehicles Platooning enables the vehicles to dynamically form a platoon traveling together. All the vehicles in the platoon obtain information from the leading vehicle to manage this platoon. These information allow the vehicles to drive closer than normal in a coordinated manner, going to the same direction and traveling together.

(2) Extended Sensors enable the exchange of raw or processed data gathered through local sensors or live video images among vehicles, road site units, devices of pedestrians and V2X application servers. The vehicles can increase the perception of their environment beyond of what their own sensors can detect and have a more broad and holistic view of the local situation. High data rate is one of the key characteristics.

(3) Advanced Driving enables semi-automated or full-automated driving. Each vehicle and/or RSU shares its own perception data obtained from its local sensors with vehicles in proximity and allows vehicles to synchronize and coordinate their trajectories or maneuvers. Each vehicle shares its driving intention with vehicles in proximity too.

(4) Remote Driving enables a remote driver or a V2X application to operate a remote vehicle for those passengers who cannot drive by themselves or remote vehicles located in dangerous environments. For a case where variation is limited and routes are predictable, such as in public transportation, driving based on cloud computing can be used. High reliability and low latency are the main requirements.

A description to be given below can be applied to all of NR SL (sidelink) and LTE SL, and when no radio access technology (RAT) is indicated, the NR SL is meant. Operation scenarios considered in NR V2X may be categorized into six as follows. In this regard, FIG. 2B illustrates a standalone scenario supporting V2X SL communication and an MR-DC scenario supporting V2X SL communication.

In particular, 1) in scenario 1, a gNB provides control/configuration for a UE's V2X communication in both LTE SL and NR SL. 2) In scenario 2, an ng-eNB provides control/configuration for a UE's V2X communication in both LTE SL and NR SL. 3) In scenario 3, an eNB provides control/configuration for a UE's V2X communication in both LTE SL and NR SL. On the other hand, 4) in scenario 4, a UE's V2X communication in LTE SL and NR SL is controlled/configured by Uu while the UE is configured with EN-DC. 5) In scenario 5, a UE's V2X communication in LTE SL and NR SL is controlled/configured by Uu while the UE is configured in NE-DC. 6) In scenario 6, a UE's V2X communication in LTE SL and NR SL is controlled/configured by Uu while the UE is configured in NGEN-DC.

Figure 2B:
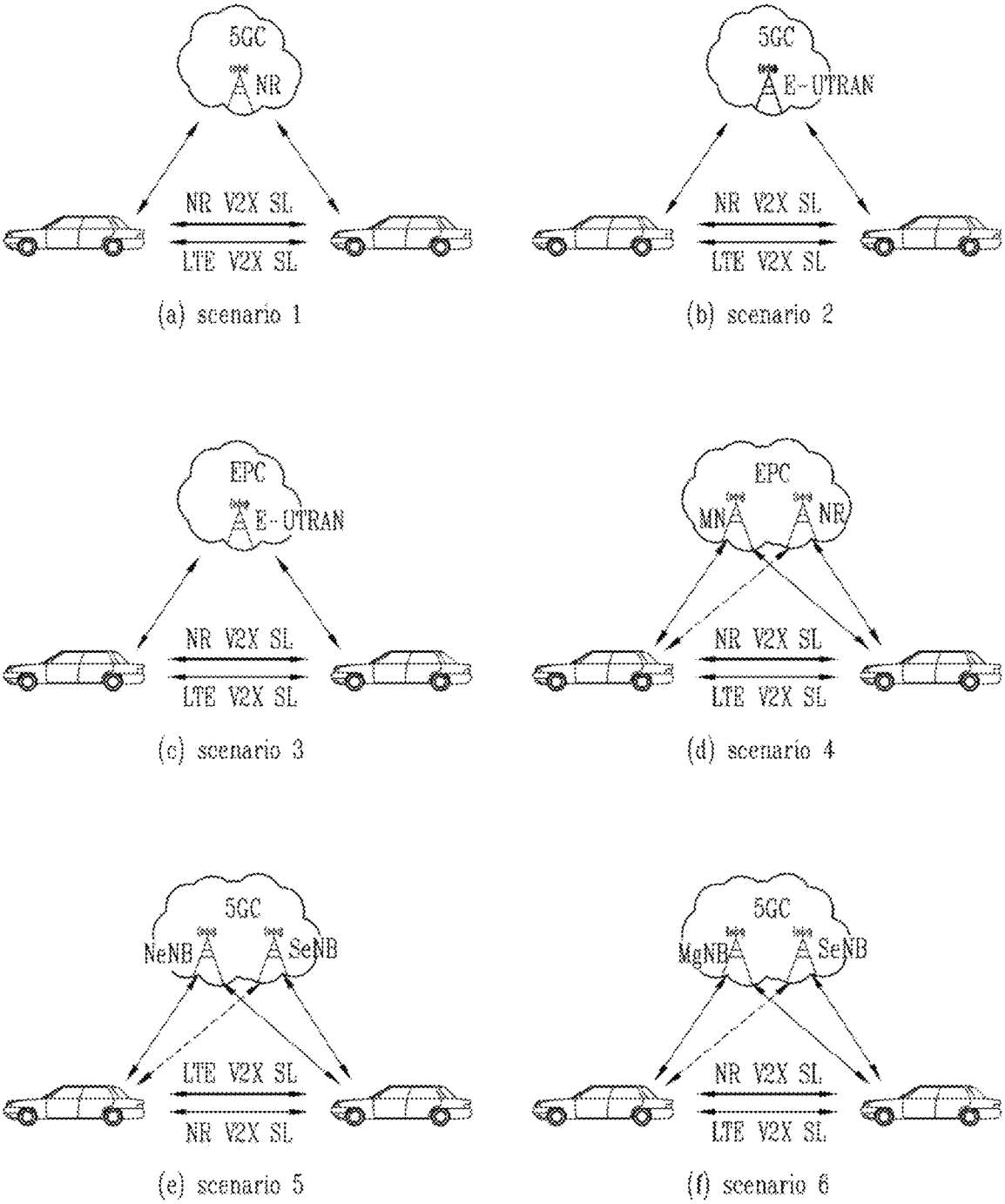
FIG. 2B illustrates a standalone scenario supporting V2X SL communication and an MR-DC scenario supporting V2X SL communication.

In order to support V2X communication, as illustrated in FIGS. 2A and 2B, a vehicle may perform wireless communication with an eNB and/or a gNB through an antenna system. The antenna system may be configured as an internal antenna system as illustrated in FIGS. 1A and 1B. The antenna system may alternatively be implemented as an external antenna system and/or an internal antenna system as illustrated in FIGS. 3A to 3C.

Figure 3A:
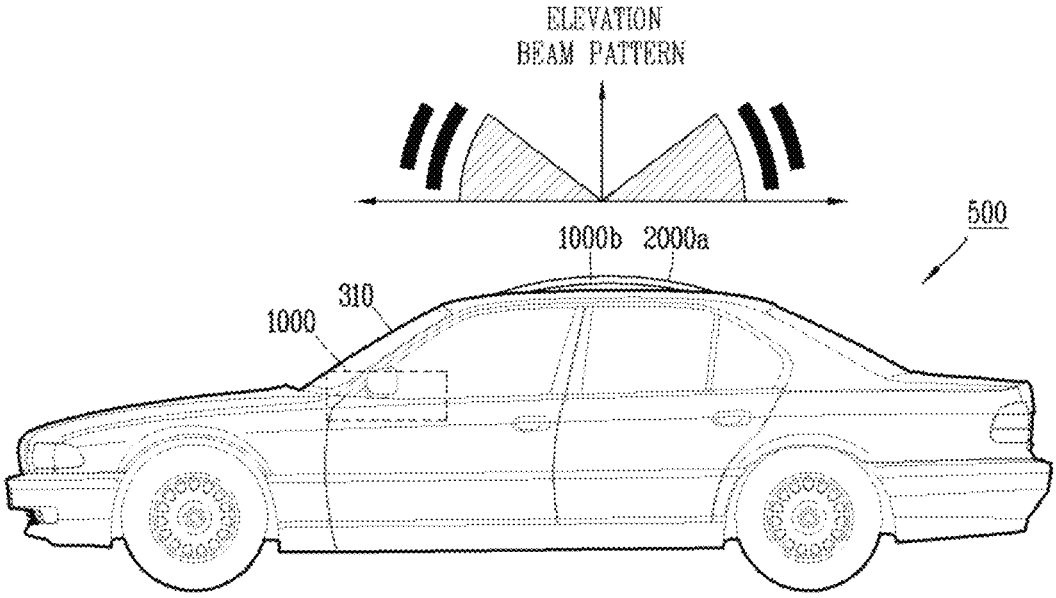
FIGS. 3A to 3C illustrate a configuration capable of performing wireless communication through a transparent antenna disposed on a window of a vehicle (vehicle window).
Figure 3B:
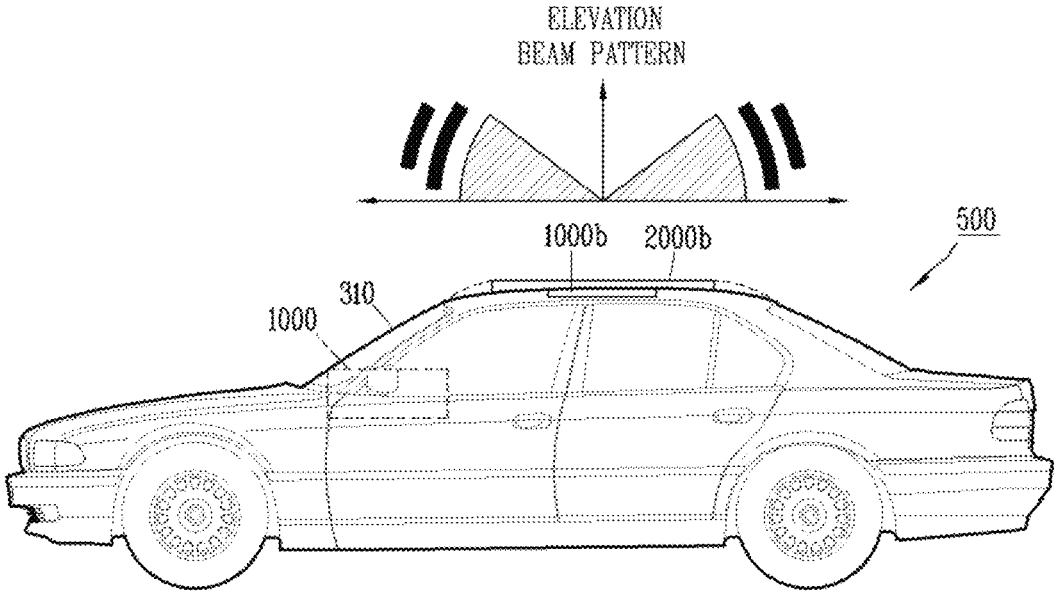
Figure 3C:
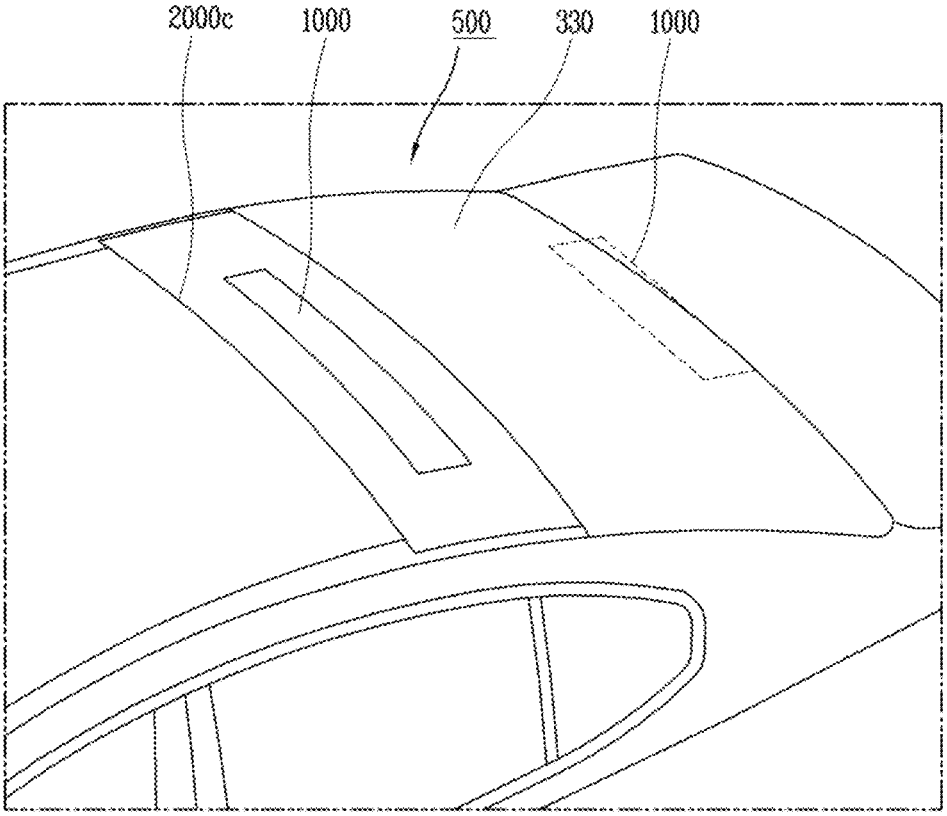

FIGS. 3A to 3C are views illustrating a structure for mounting an antenna system in a vehicle, which includes the antenna system mounted in the vehicle. In this regard, FIGS. 3A to 3C illustrate a configuration capable of performing wireless communication through a transparent antenna disposed on the front window 310 of the vehicle. An antenna system 1000 including a transparent antenna may be disposed on a front window of a vehicle and inside the vehicle. Wireless communication may also be performed through a transparent antenna disposed on a side glass of the vehicle, in addition to the front window.

The antenna system for the vehicle that includes the transparent antenna can be combined with other antennas. Referring to FIGS. 3A to 3C, in addition to the antenna system 1000 implemented as the transparent antenna, a separate antenna system 1000*b* may be further configured. FIGS. 3A and 3B illustrate a structure in which the antenna system 1000*b*, in addition to the antenna system 1000, is mounted on or in a roof of the vehicle. On the other hand, FIG. 3C illustrates a structure in which the separate antenna system 1000*b*, in addition to the antenna system 1000, is mounted in a roof frame of a roof and a rear mirror of the vehicle.

Referring to FIGS. 3A to 3C, in order to improve the appearance of the vehicle and to maintain a telematics performance at the time of collision, an existing shark fin antenna may be replaced with a flat antenna of a non-protruding shape. In addition, the present disclosure proposes an integrated antenna of an LTE antenna and a 5G antenna considering fifth generation (5G) communication while providing the existing mobile communication service (e.g., LTE).

Referring to FIG. 3A, the antenna system 1000 implemented as the transparent antenna may be disposed on the front window 310 of the vehicle and inside the vehicle. The second antenna system 1000*b* corresponding to an external antenna may be disposed on the roof of the vehicle. In FIG. 3A, a radome 2000*a* may cover the second antenna system 1000*b* to protect the second antenna system 1000*b* from an external environment and external impacts while the vehicle travels. The radome 2000*a* may be made of a dielectric material through which radio signals are transmitted/received between the second antenna system 1000*b* and a base station.

Referring to FIG. 3B, the antenna system 1000 implemented as the transparent antenna may be disposed on the front window 310 of the vehicle and inside the vehicle. One the other hand, the second antenna system 1000*b* corresponding to the external antenna may be disposed within a roof structure of the vehicle and at least part of the roof structure 2000*b* may be made of a non-metallic material. At this time, the roof structure 2000*b* of the vehicle except for the at least part made of the non-metallic material may be made of a dielectric material through which radio signals are transmitted/received between the antenna system 1000*b* and the base station.

Referring to FIG. 3C, the antenna system 1000 implemented as the transparent antenna may be disposed on the rear window 330 of the vehicle and inside the vehicle. The second antenna system 1000*b* corresponding to the external antenna may be disposed within the roof frame 2000*c* of the vehicle, and at least part of the roof frame 2000*c* may be made of a non-metallic material. At this time, the roof frame 2000*c* of the vehicle 500 except for the at least part made of the non-metallic material may be made of a dielectric material through which radio signals are transmitted/received between the second antenna system 1000*b* and the base station.

Referring to FIGS. 3A to 3C, antennas provided in the antenna system 1000 mounted on the vehicle may form a beam pattern in a direction perpendicular to the front window 310 or the rear window 330. Antennas provided in the second antenna system 1000 mounted on the vehicle may further define a beam coverage by a predetermined angle in a horizontal region with respect to the vehicle body.

Meanwhile, the vehicle 500 may include only the antenna unit (i.e., the internal antenna system) 1000 corresponding to the internal antenna without the antenna system 1000*b* corresponding to the external antenna.

Figure 4:
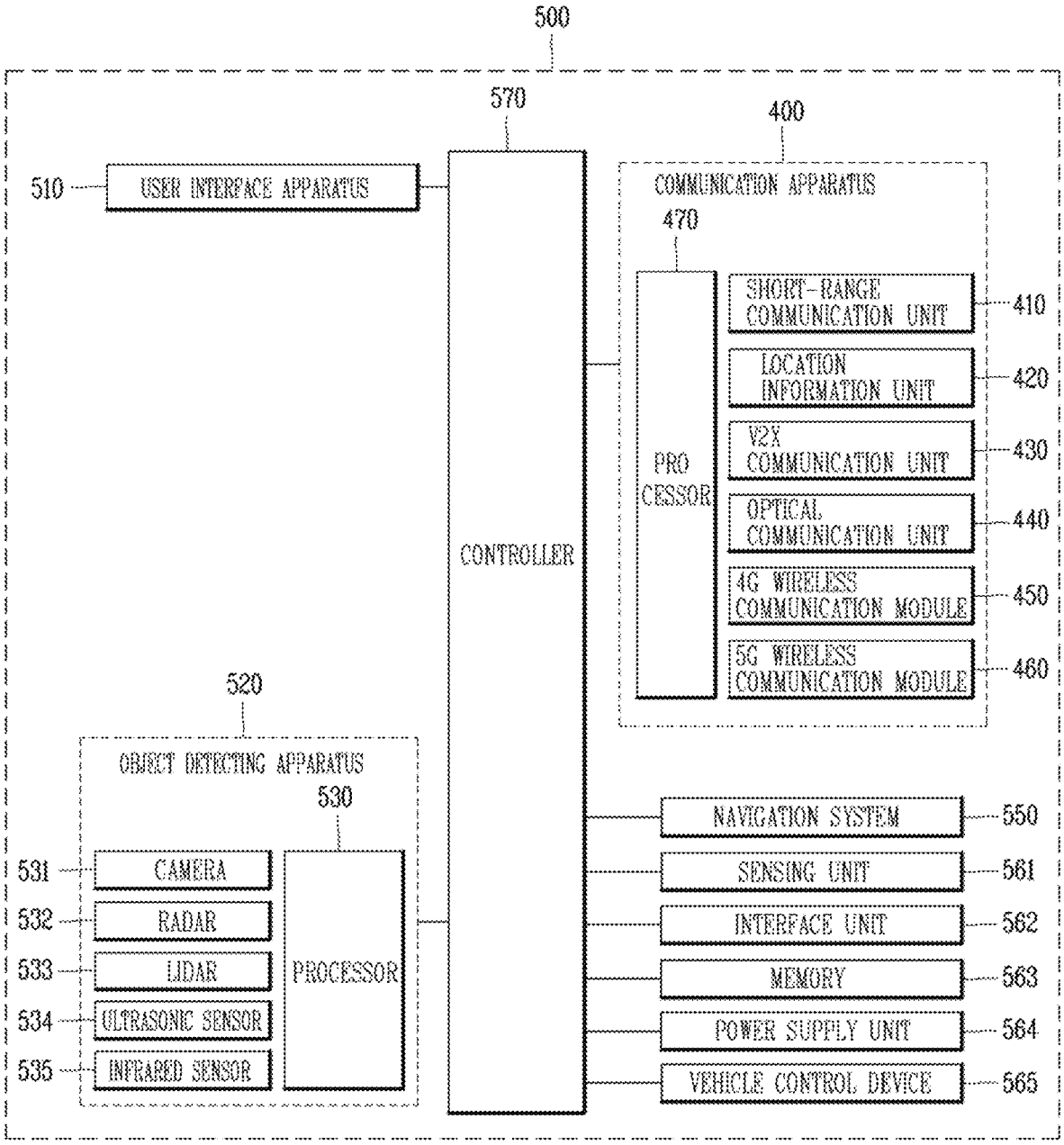
FIG. 4 is a block diagram illustrating a vehicle and an antenna system mounted on the vehicle in accordance with one example.

Meanwhile, FIG. 4 is a block diagram illustrating a vehicle and an antenna system mounted on the vehicle in accordance with an implementation.

The vehicle 500 may be an autonomous vehicle. The vehicle 500 may be switched into an autonomous driving mode or a manual mode (a pseudo driving mode) based on a user input. For example, the vehicle 500 may be switched from the manual mode into the autonomous driving mode or from the autonomous driving mode into the manual mode based on a user input received through a user interface apparatus 510.

In relation to the manual mode and the autonomous driving mode, operations such as object detection, wireless communication, navigation, and operations of vehicle sensors and interfaces may be performed by the telematics control unit mounted on the vehicle 500. Specifically, the telematics control unit mounted on the vehicle 500 may perform the operations in cooperation with the antenna module 300, the object detecting apparatus 520, and other interfaces. In some examples, the communication apparatus 400 may be disposed in the telematics control unit separately from the antenna system 300 or may be disposed in the antenna system 300.

The vehicle 500 may be switched into the autonomous driving mode or the manual mode based on driving environment information. The driving environment information may be generated based on object information provided from the object detecting apparatus 520. For example, the vehicle 500 may be switched from the manual mode into the autonomous driving mode or from the autonomous driving mode into the manual mode based on driving environment information generated in the object detecting apparatus 520.

For example, the vehicle 500 may be switched from the manual mode into the autonomous driving mode or from the autonomous driving mode into the manual mode based on driving environment information received through the communication apparatus 400. The vehicle 500 may be switched from the manual mode into the autonomous driving mode or from the autonomous driving mode into the manual mode based on information, data or signal provided from an external device.

When the vehicle 500 is driven in the autonomous driving mode, the autonomous vehicle 500 may be driven based on an operation system. For example, the autonomous vehicle 500 may be driven based on information, data or signal generated in a driving system, a parking exit system, and a parking system. When the vehicle 500 is driven in the manual mode, the autonomous vehicle 500 may receive a user input for driving through a driving control apparatus. The vehicle 500 may be driven based on the user input received through the driving control apparatus.

The vehicle 500 may include a user interface apparatus 510, an object detecting apparatus 520, a navigation system 550, and a communication apparatus 400. In addition, the vehicle may further include a sensing unit 561, an interface unit 562, a memory 563, a power supply unit 564, and a vehicle control device 565 in addition to the aforementioned apparatuses and devices. In some implementations, the vehicle 500 may include more components in addition to components to be explained in this specification or may not include some of those components to be explained in this specification.

The user interface apparatus 510 may be an apparatus for communication between the vehicle 500 and a user. The user interface apparatus 510 may receive a user input and provide information generated in the vehicle 500 to the user. The vehicle 510 may implement user interfaces (Uis) or user experiences (Uxs) through the user interface apparatus 200.

The object detecting apparatus 520 may be an apparatus for detecting an object located at outside of the vehicle 500. The object may be a variety of objects associated with driving (operation) of the vehicle 500. In some examples, objects may be classified into moving objects and fixed (stationary) objects. For example, the moving objects may include other vehicles and pedestrians. The fixed objects may include traffic signals, roads, and structures, for example. The object detecting apparatus 520 may include a camera 521, a radar 522, a LiDAR 523, an ultrasonic sensor 524, an infrared sensor 525, and a processor 530. In some implementations, the object detecting apparatus 520 may further include other components in addition to the components described, or may not include some of the components described.

The processor 530 may control an overall operation of each unit of the object detecting apparatus 520. The processor 530 may detect an object based on an acquired image, and track the object. The processor 530 may execute operations, such as a calculation of a distance from the object, a calculation of a relative speed with the object and the like, through an image processing algorithm.

In some implementations, the object detecting apparatus 520 may include a plurality of processors 530 or may not include any processor 530. For example, each of the camera 521, the radar 522, the LiDAR 523, the ultrasonic sensor 524 and the infrared sensor 525 may include the processor in an individual manner.

When the processor 530 is not included in the object detecting apparatus 520, the object detecting apparatus 520 may operate according to the control of a processor of an apparatus within the vehicle 500 or the controller 570.

The navigation system 550 may provide location information related to the vehicle based on information obtained through the communication apparatus 400, in particular, a location information unit 420. Also, the navigation system 550 may provide a path (or route) guidance service to a destination based on current location information related to the vehicle. In addition, the navigation system 550 may provide guidance information related to surroundings of the vehicle based on information obtained through the object detecting apparatus 520 and/or a V2X communication unit 430. In some examples, guidance information, autonomous driving service, etc. may be provided based on V2V, V2I, and V2X information obtained through a wireless communication unit 460 operating together with the antenna system 1000.

The communication apparatus 400 may be an apparatus for performing communication with an external device. Here, the external device may be another vehicle, a mobile terminal, or a server. The communication apparatus 400 may perform communication by including at least one of a transmitting antenna, a receiving antenna, and radio frequency (RF) circuits and RF devices for implementing various communication protocols. The communication apparatus 400 may include a short-range communication unit 410, a location information unit 420, a V2X communication unit 430, an optical communication unit 440, a 4G wireless communication module 450, and a processor 470. In some implementations, the communication apparatus 400 may further include other components in addition to the components described, or may not include some of the components described.

The short-range communication unit 410 may be a unit for facilitating short-range communication. The short-range communication unit 410 may construct short-range wireless area networks to perform short-range communication between the vehicle 500 and at least one external device. The location information unit 420 may be a unit for acquiring location information related to the vehicle 500. For example, the location information unit 420 may include a Global Positioning System (GPS) module or a Differential Global Positioning System (DGPS) module.

The V2X communication unit 430 may be a unit for performing wireless communication with a server (Vehicle to Infrastructure; V2I), another vehicle (Vehicle to Vehicle; V2V), or a pedestrian (Vehicle to Pedestrian; V2P). The V2X communication unit 430 may include an RF circuit implementing communication protocols such as V2I, V2V, and V2P. The optical communication unit 440 may be a unit for performing communication with an external device through the medium of light. The optical communication unit 440 may include a light-emitting diode for converting an electric signal into an optical signal and sending the optical signal to the exterior, and a photodiode for converting the received optical signal into an electric signal. In some implementations, the light-emitting diode may be integrated with lamps provided on the vehicle 500.

A wireless communication unit may be a unit that performs wireless communication with one or more communication systems through one or more antenna systems. The wireless communication unit may transmit and/or receive a signal to and/or from a device in a first communication system through a first antenna system. In addition, the wireless communication unit may transmit and/or receive a signal to and/or from a device in a second communication system through a second antenna system. For example, the first communication system and the second communication system may be an LTE communication system and a 5G communication system, respectively. However, the first communication system and the second communication system may not be limited thereto, and may be changed according to applications.

In some examples, the antenna module 300 disposed in the vehicle 500 may include a wireless communication unit. In this regard, the vehicle 500 may be an electric vehicle (EV) or a vehicle that can be connected to a communication system independently of an external electronic device. In this regard, the communication apparatus 400 may include at least one of the short-range communication unit 410, the location information unit 420, the V2X communication unit 430, the optical communication unit 440, a 4G wireless communication module 450, and a 5G wireless communication module 460.

The 4G wireless communication module 450 may perform transmission and reception of 4G signals with a 4G base station through a 4G mobile communication network. In this case, the 4G wireless communication module 450 may transmit at least one 4G transmission signal to the 4G base station. In addition, the 4G wireless communication module 450 may receive at least one 4G reception signal from the 4G base station. In this regard, Uplink (UL) Multi-input and Multi-output (MIMO) may be performed by a plurality of 4G transmission signals transmitted to the 4G base station. In addition, Downlink (DL) MIMO may be performed by a plurality of 4G reception signals received from the 4G base station.

The 5G wireless communication module 460 may perform transmission and reception of 5G signals with a 5G base station through a 5G mobile communication network. Here, the 4G base station and the 5G base station may have a Non-Stand-Alone (NSA) structure. The 4G base station and the 5G base station may be disposed in the Non-Stand-Alone (NSA) structure. Alternatively, the 5G base station may be disposed in a Stand-Alone (SA) structure at a separate location from the 4G base station. The 5G wireless communication module 460 may perform transmission and reception of 5G signals with a 5G base station through a 5G mobile communication network. In this case, the 5G wireless communication module 460 may transmit at least one 5G transmission signal to the 5G base station. In addition, the 5G wireless communication module 460 may receive at least one 5G reception signal from the 5G base station. In this instance, 5G and 4G networks may use the same frequency band, and this may be referred to as LTE refarming. In some examples, a Sub 6 frequency band, which is a range of 6 GHz or less, may be used as the 5G frequency band. On the other hand, a millimeter-wave (mmWave) range may be used as the 5G frequency band to perform wideband high-speed communication. When the mmWave band is used, the electronic device may perform beamforming for communication coverage expansion with a base station.

On the other hand, regardless of the 5G frequency band, 5G communication systems can support a larger number of MIMOs to improve a transmission rate. In this instance, UL MIMO may be performed by a plurality of 5G transmission signals transmitted to a 5G base station. In addition, DL MIMO may be performed by a plurality of 5G reception signals received from the 5G base station.

In some examples, the wireless communication unit 110 may be in a Dual Connectivity (DC) state with the 4G base station and the 5G base station through the 4G wireless communication module 450 and the 5G wireless communication module 460. As such, the dual connectivity with the 4G base station and the 5G base station may be referred to as EUTRAN NR DC (EN-DC). On the other hand, if the 4G base station and 5G base station are disposed in a co-located structure, throughput improvement can be achieved by inter-Carrier Aggregation (inter-CA). Accordingly, when the 4G base station and the 5G base station are disposed in the EN-DC state, the 4G reception signal and the 5G reception signal may be simultaneously received through the 4G wireless communication module 450 and the 5G wireless communication module 460. Short-range communication between electronic devices (e.g., vehicles) may be performed using the 4G wireless communication module 450 and the 5G wireless communication module 460. In some implementations, after resources are allocated, vehicles may perform wireless communication in a V2V manner without a base station.

Meanwhile, for transmission rate improvement and communication system convergence, Carrier Aggregation (CA) may be carried out using at least one of the 4G wireless communication module 450 and the 5G wireless communication module 460 and a WiFi communication module. In this regard, 4G+WiFi CA may be performed using the 4G wireless communication module 450 and the Wi-Fi communication module. Or, 5G+WiFi CA may be performed using the 5G wireless communication module 460 and the Wi-Fi communication module.

In some examples, the communication apparatus 400 may implement a display apparatus for a vehicle together with the user interface apparatus 510. In this instance, the display apparatus for the vehicle may be referred to as a telematics apparatus or an Audio Video Navigation (AVN) apparatus.

Hereinafter, an antenna assembly (antenna module) that may be disposed on a window of a vehicle according to the present disclosure and an antenna system for a vehicle including the antenna assembly will be described. In this regard, the antenna assembly may refer to a structure in which conductive patterns are combined on a dielectric substrate, and may also be referred to as an antenna module.

Figure 5:
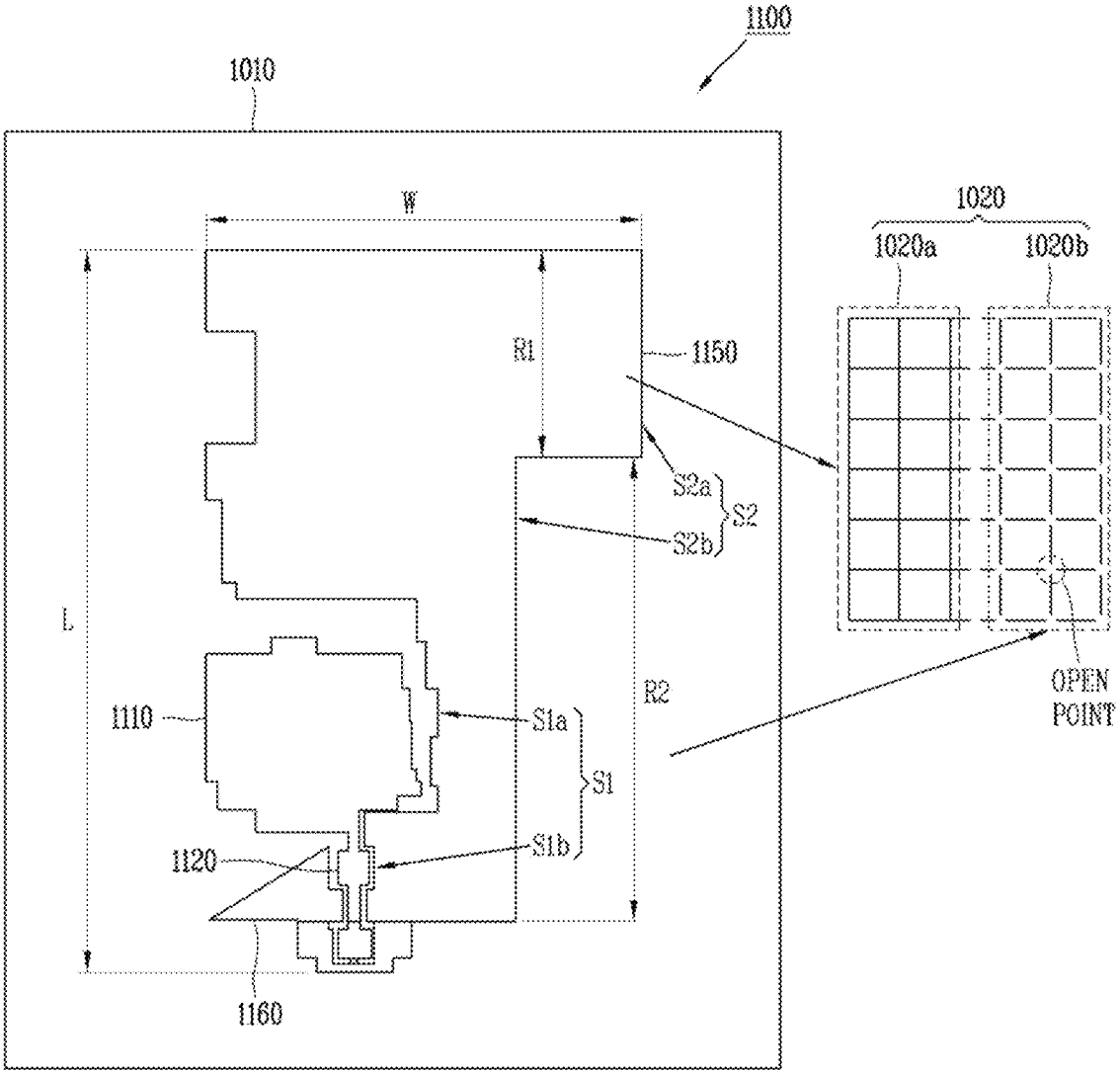
FIG. 5 illustrates a configuration of a stepped wideband CPW antenna in accordance with an implementation.

FIG. 5 illustrates a configuration of a stepped wideband CPW antenna in accordance with an example.

Referring to FIG. 5, an antenna assembly 1100 may include a dielectric substrate 1010, a radiator region 1110, a feeding line 1120, a third conductive pattern 1150, and a second conductive pattern 1160. Hereinafter, configuration and arrangement of a stepped wideband CPW antenna will be described with reference to FIG. 5.

The dielectric substrate 1010 may be configured such that the radiator region 1110, the feeding line 1120, the third conductive pattern 1150, and the second conductive pattern 1160 are disposed on a surface thereof. The dielectric substrate 1010 may be implemented as a substrate having predetermined permittivity and thickness. When the antenna assembly 1100 is implemented as a transparent antenna, the dielectric substrate 1010 may be implemented as a transparent substrate made of a transparent material.

The radiator region 1110 may be implemented as conductive patterns on the dielectric substrate 1010 to radiate a radio signal. When the antenna assembly 1100 is implemented as a transparent antenna, the conductive patterns may be configured as a metal mesh grid 1020*a*. That is, the antenna assembly 1100 may be implemented as the metal mesh grid 1020*a* configured to interconnect a plurality of grids. On the other hand, a dummy mesh grid 1020*b* disposed at a dielectric region may be implemented as an open dummy pattern in which a plurality of grids are disconnected at connection points.

The feeding line 1120 may be configured to apply a signal on the same plane as the conductive patterns of the radiator region 1110. Accordingly, since the radiator region 1110 and the feeding line 1120 are disposed on the same plane, a CPW antenna structure can be implemented.

The third conductive pattern 1150 may be disposed at one side surface of the radiator region 1110 at one side of the feeding line 1120 and also disposed at an upper side of the radiator region 1110 in one axial direction. The one axial direction may be a y-axial direction, but may not be limited thereto. Although it is illustrated that the third conductive pattern 1150 is disposed at the upper side of the radiator region 1110, the present disclosure may not be limited thereto. The third conductive pattern 1150 may alternatively disposed at one side, another side or a lower side of the radiator region 1110 depending on an angle at which the antenna assembly 1100 is disposed.

The second conductive pattern 1160 may be disposed at a lower side of the radiator region 1110 in the one axial direction at another side of the feeding line 1120. Accordingly, a length of the second conductive pattern 1160 in the one axis may be shorter than a length of the third conductive pattern 1150 in the one axis. The one axial direction may be a y-axial direction, but may not be limited thereto. Although it is illustrated that the second conductive pattern 1160 is disposed at the lower side of the radiator region 1110, the present disclosure may not be limited thereto. The second conductive pattern 1150 may alternatively disposed at one side, another side or an upper side of the radiator region 1110 depending on an angle at which the antenna assembly 1100 is disposed. Since the third conductive pattern 1150 and the second conductive pattern 1160 are disposed on the same plane (i.e., the same dielectric substrate 1010) as the radiator region 1110, the antenna assembly 1100 illustrated in FIG. 6 can have a CPW antenna structure.

In some examples, the wideband CPW antenna may operate as a wideband antenna by the configuration that the conductive patterns radiate radio signals at different bands. The third conductive pattern 1150 may be configured to radiate a signal of a first band. The radiator region 1110 may be configured to radiate a signal of a second band that is higher than the first band. In some examples, the second conductive pattern 1160 may be configured to radiate a signal of a third band that is higher than the second band.

In this regard, the second band may be a band higher than the first band and the third band may be set to a band higher than the second band. For example, the first band corresponding to LB may be set to include 800 MHz, but may not be limited thereto. The second band corresponding to MB/HB may be set to include 2200 MHz, but may not be limited thereto. The third band corresponding to UHB or Sub 6 band may be set to include 3500 MHz, but may not be limited thereto.

Referring to FIG. 5, the third conductive pattern 1150 may include first side surfaces S1*a* and S1*b* spaced apart from the feeding line 1120 and the radiator region 1110, and second side surfaces S2*a* and S2*b* that are another side surfaces of the first side surfaces S1*a* and S1*b*. In this regard, the first side surfaces S1*a* and S1*b* and the second side surfaces S2*a* and S2*b* may define a boundary of conductive patterns (i.e., the metal mesh grid) constituting the third conductive pattern 1150.

Boundaries of the first side surfaces S1*a* and S1*b* of the third conductive pattern 1150 may be disposed on the same plane to be spaced apart different gaps from a boundary of the one side surface of the radiator region 1110 and a boundary of the upper side of the radiator region 1110. The gap between the boundary of the first side surface S1 (i.e., Sla) of the third conductive pattern 1150 and the boundary of the one side surface of the radiator region 1110 may be narrower than the gap between the boundary of the first side surface S1 (i.e., S1*b*) of the third conductive pattern 1150 and the boundary of the upper side of the radiator region 1110. Accordingly, a first region R1 that is an upper region of the third conductive pattern 1150 may operate as a more independent radiator than a second region R2 that is a lower region of the third conductive pattern 1150. Therefore, the third conductive pattern 1150 can radiate the radio signal of the first band by the first region R1 that has a large area and operates as the independent radiator and the second region R2 adjacent to the radiator region 1110.

Figure 6:
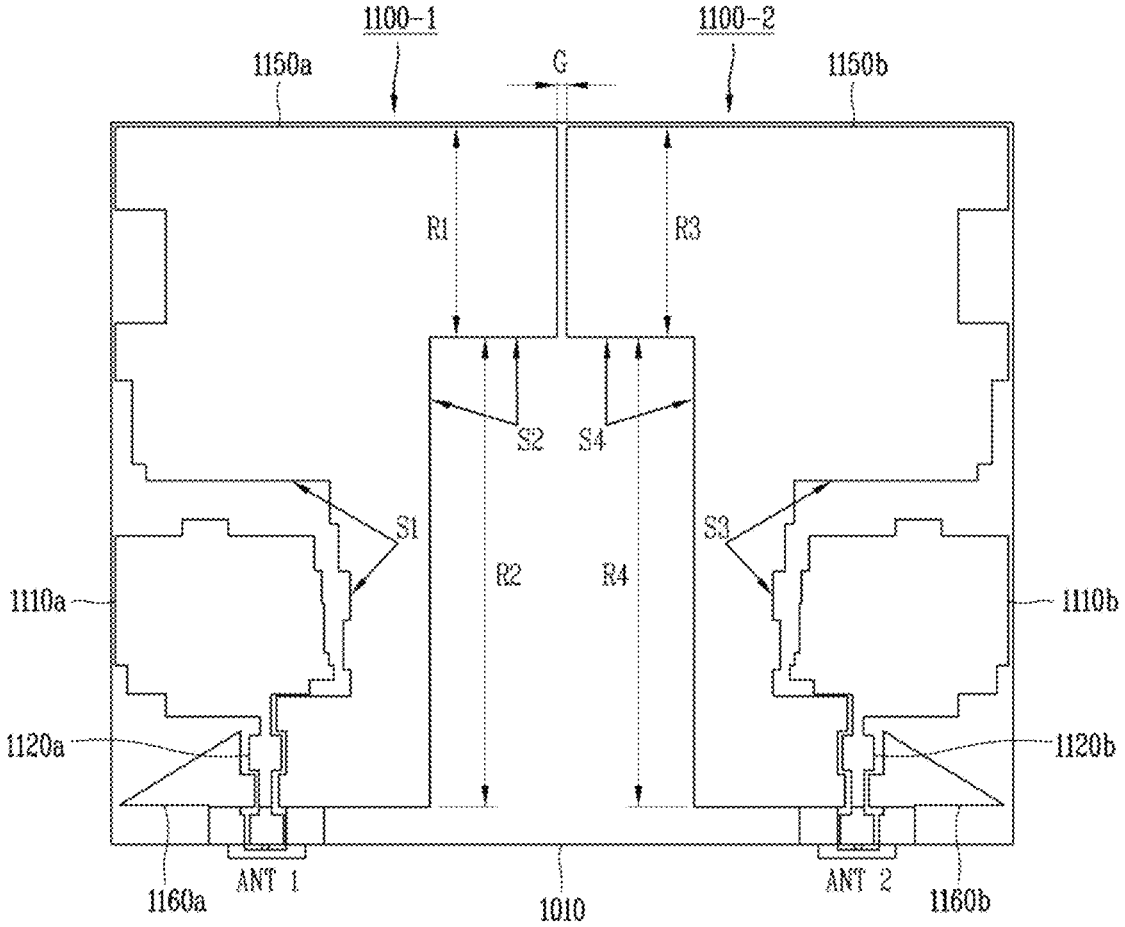
FIG. 6 illustrates a configuration in which first and second radiation structures formed in a mirror structure are disposed on a dielectric substrate.

In some examples, the boundaries of the first side surfaces S1 or the boundaries of the second side surfaces S2 of the third conductive pattern 1150 may be recessed. Referring to FIG. 6, boundaries of first side surface S1*a* and S1*b* of a third conductive pattern 1150*a* may be recessed.

The configuration that the boundaries of the first side surfaces S1 are recessed may mean that end portions on one axis are located at different positions. Accordingly, the conductive patterns constituting the third conductive pattern 1150 can have different lengths and resonate at different frequencies.

The one side surface of the radiator region 1110 and the first side surface of the third conductive pattern 1150 may face each other in a stepped structure with different gaps. The stepped structure of the third conductive pattern 1150 can optimize antenna performance at sub bands of the first band. Accordingly, an operating bandwidth of the third conductive pattern 1150 can cover an entire band of the first band.

The radiator region 1110 may have a stepped structure in which an end portion of one side surface of the radiator region 1110 and an end portion of another side surface of the radiator region 1110 have different lengths. The stepped structure of the radiator region 1110 can optimize antenna performance at sub bands of the second band. Accordingly, an operating bandwidth of the radiator region 1110 can cover an entire band of the second band. Also, with the stepped structure in which the one side surface of the radiator region 1110 and the first side surface of the third conductive pattern 1150 are spaced apart from each other by different gaps, a width of the antenna assembly 1100 can be reduced.

The third conductive pattern 1150 may include the first region R1 and the second region R2. The first region R1 may correspond to the upper region and may include a plurality of conductive patterns having end portions located at different positions on the first side surfaces S1. The second region R2 may correspond to a region lower than the first region R1 and may have end portions spaced apart from the boundaries of the radiator region 1110 on the first side surfaces S1.

In some examples, the third conductive pattern 1150 may be configured such that end portions of the second side surfaces S2*a* and S2*b* are formed at the same point in the first region R1 and the second region R2. Accordingly, an entire width of the antenna can be reduced by the third conductive pattern 1150 in which the end portions of the second side surfaces S2*a* and S2*b* are formed at the same point. As the entire width of the antenna is reduced, an entire size of the antenna can be miniaturized.

The CPW antenna 1100 having the asymmetric shape of FIG. 5 may be implemented by a plurality of antenna elements. FIG. 6 illustrates a configuration in which first and second radiation structures formed in a mirror structure according to one implementation are disposed on a dielectric substrate.

As illustrated in FIG. 6, the CPW antennas 1100 having the asymmetric shape of FIG. 5 may be disposed symmetrically with respect to one axis. Accordingly, a first radiation structure 1100-1 and a second radiation structure 1100-2 may be disposed symmetrically with respect to the one axis. Accordingly, the first radiation structure 1100-1 and the second radiation structure 1100-2 can be configured in a mirror shape so as to operate while minimizing the influence between the same antennas. The first radiation structure 1100-1 and the second radiation structure 1100-2 may simultaneously operate in the same band to perform Multiple-input/Multi-output (MIMO).

Referring to FIGS. 5 and 6, the antenna assembly 1100 may include the first radiation structure 1100-1 and the second reflection structure 1100-2. The first radiation structure 1100-1 and the second radiation structure 1100-2 may be disposed symmetrically with respect to the one axis, as aforementioned.

The first radiation structure 1100-1 may include a third conductive pattern 1150*a* and a second conductive pattern 1160*a* that are defined at both sides of the first conductive pattern 1110*a* on the dielectric substrate 1010 in the one axial direction to have different lengths. In this regard, the first radiation structure 1100-1 may include a first conductive pattern 1110*a*, a third conductive pattern 1150*a*, and a second conductive pattern 1160*a*. The first conductive pattern 1110*a* is electrically connected a first feeding portion FP1, and the second conductive pattern 1160*a* and the third conductive pattern 1150*a* is electrically connected to a ground G. The first conductive pattern 1110*a* may be disposed between the second conductive pattern 1160*a* and the third conductive pattern 1150*a*. In addition, a size of the second conductive pattern 1160*a* may be smaller than a size of the third conductive pattern 1150*a*.

The second radiation structure 1100-2 may include a fifth conductive pattern 1150*b* and a sixth conductive pattern 1160*b* that are defined at both sides of the fourth conductive pattern 1110*b* on the dielectric substrate 1010 in the one axial direction to have different lengths. In this regard, the second radiation structure 1100-2 may include a fourth conductive pattern 1110*b*, the fifth conductive pattern 1150*b*, and the sixth conductive pattern 1160*b*. The fourth conductive pattern 1110*b* is electrically connected a second feeding portion FP2, and the fifth conductive pattern 1150*b* and the sixth conductive pattern 1160*b* may be electrically connected to the ground G. The fourth conductive pattern 1110*b* may be disposed between the fifth conductive pattern 1150*b* and the sixth conductive pattern 1160*b*. In addition, a size of fifth conductive pattern 1150*b* may be bigger than a size of the sixth conductive pattern 1160*b*.

In some examples, in the first radiation structure 1100-1, the third conductive pattern 1150*a* may include first side surfaces S1 (i.e., S1*a* and S1*b*) spaced apart from the first feeding line 1120*a* and the first conductive pattern 1110*a*, and second side surfaces S2 (i.e., S2*a* and S2*b*) that are another side surfaces of the first side surfaces S1. In this regard, boundaries of the first side surfaces S1*a* and S1*b* of the third conductive pattern 1150*a* may be disposed on the same plane to be spaced apart different gaps from a boundary of one side surface of the first conductive pattern 1110*a* and a boundary of an upper side of the radiator region 1110. The boundaries of the first side surfaces S1 may be recessed.

In the second radiation structure 1100-2, the fifth conductive pattern 1150*b* may include third side surfaces S3 spaced apart from the second feeding line 1120*b* and the fourth conductive pattern 1110*b*, and fourth side surfaces S4 that are another side surfaces of the third side surfaces S3. In this regard, boundaries of the third side surfaces S3 of the fifth conductive pattern 1150*b* may be disposed on the same plane to be spaced apart different gaps from a boundary of one side surface of the fourth conductive pattern 1110*b* and a boundary of an upper side of the fourth conductive pattern 1110*b*. The boundaries of the third side surfaces S3 may be recessed.

On the other hand, in the first radiation structure 1100-1, the third conductive pattern 1150*a* formed in the asymmetric structure with the second conductive pattern 1160*a* may be divided into a first region R1 as an upper region and a second region R2 as a lower region. In the second radiation structure 1100-2, the fifth conductive pattern 1150*b* formed in the asymmetric structure with the sixth conductive pattern 1160*b* may be divided into a third region R3 as an upper region and a fourth region R4 as a lower region.

When the first radiation structure 1100-1 and the second radiation structure 1100-2 are disposed at a minimized interval, the entire antenna assembly 1100 can be minimized. In some examples, when the first radiation structure 1100-1 and the second radiation structure 1100-2 operate independently in the same band, it may be necessary to minimize mutual influence therebetween. To this end, the first radiation structure 1100-1 and the second radiation structure 1100-2 may be disposed symmetrically with respect to one axis. In order to minimize the entire size of the antenna assembly 1100 and minimize the mutual influence, a gap region G corresponding to a distance between the first and second radiation structures 1100-1 and 1100-2 may be defined.

Hereinafter, antenna performance of the first radiation structure 1100-1 and the second radiation structure 1100-2 arranged in the mirror shape as illustrated in FIG. 6 will be described. In this regard, since the first radiation structure 1100-1 and the second radiation structure 1100-2 operate as independent antennas, they may be referred to as a first antenna ANT1 and a second antenna ANT2, respectively.

Figure 7:
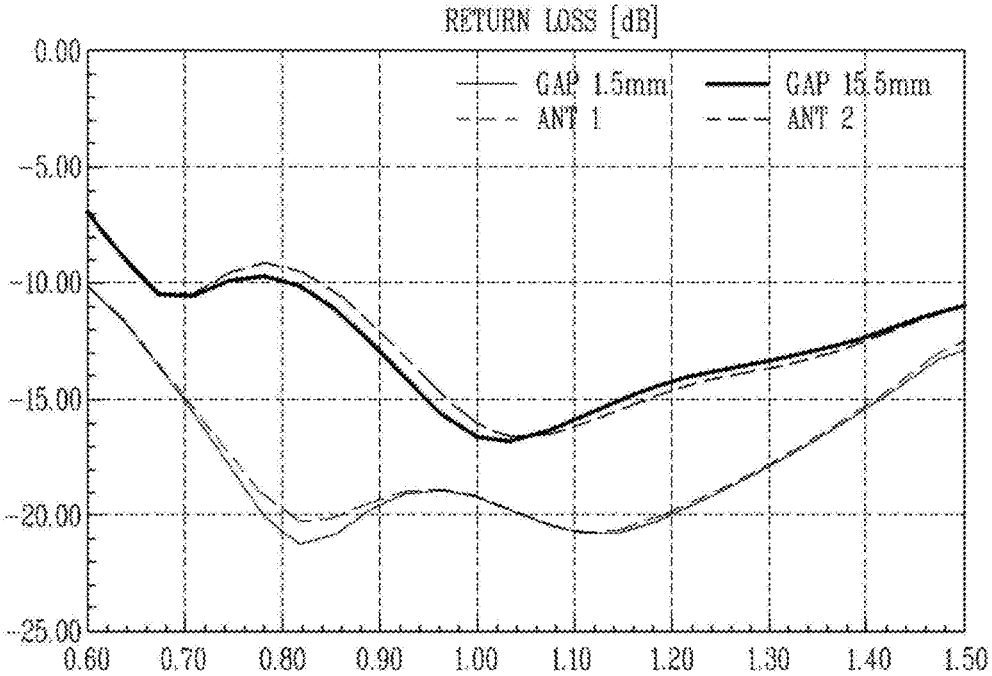
FIG. 7 illustrates return loss and isolation according to a change in gap of a gap region between the first and second radiation structures of FIG. 6.
Figure 7:
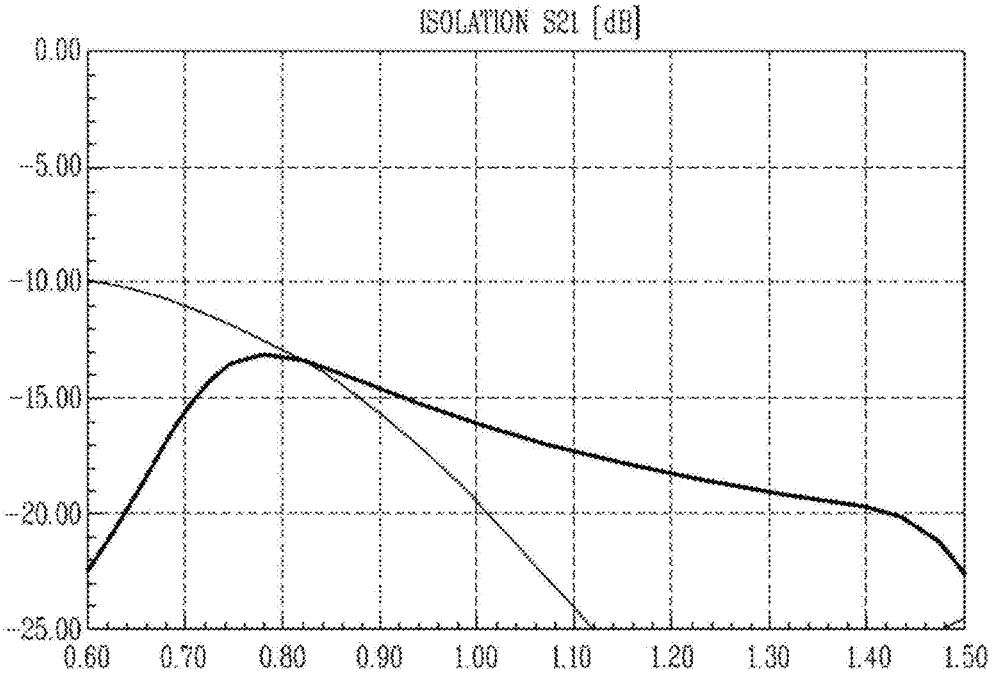

FIG. 7 illustrates return loss and isolation according to a change in gap of a gap region between the first and second radiation structures of FIG. 6. (a) of FIG. 7 illustrates the return loss according to the change in gap of the gap region between the first and second radiation structures of FIG. 6. (b) of FIG. 7 illustrates isolation according to the change in gap of the gap region between the first and second radiation structures of FIG. 6.

Referring to FIG. 6, the antenna assembly 1100 may have a structure in which the first antenna ANT1 and the second antenna ANT2 are disposed close to each other in the mirror shape to minimize the affection between the antennas having the same shape. For example, the antenna assembly 1100 may have a size to be arranged in a small area of 109×102 $mm^2$. Operating bandwidths of the first antenna ANT1 and the second antenna ANT2 may be set to 699 to 7125 MHz. The first antenna ANT1 and the second antenna ANT2 can operate in any operating band of LB/MB/HB/5G band.

Referring to FIG. 6 and (a) of FIG. 7, when the gap of the gap region G of the dielectric between the first and third regions R1 and R3 corresponding to the upper regions of the third and fifth conductive patterns 1150*a* and 1150*b* is changed from 15.5 mm to 1.5 mm, the return loss characteristic is rather improved. This results from an effect that an effective ground region is increased by the ground regions of the adjacent radiation structures. As the gap of the gap region G is changed from 15.5 mm to 1.5 mm, the return loss characteristic has a value of −10 dB or less in the entire band of 0.6-1.5 GHz. In other words, an impedance matching characteristic in the low band LB is improved as the gap of the gap region G between the third and fifth conductive patterns 1150*a* and 1150*b* becomes narrower.

Referring to FIG. 6 and (b) of FIG. 7, when the gap of the gap region G of the dielectric between the first and third regions R1 and R3 corresponding to the upper regions of the third and fifth conductive patterns 1150*a* and 1150*b* is changed from 15.5 mm to 1.5 mm, the isolation characteristic is slightly degraded. Since the affection between the radiation structures is slightly increased in the ground regions of the adjacent radiation structures, the isolation may be somewhat degraded. As the gap of the gap region G is changed from 15.5 mm to 1.5 mm, the isolation characteristic has a value of −13 dB or less in the entire band of 0.6-1.5 GHz.

However, even when the gap of the gap region G is changed from 15.5 mm to 1.5 mm, the isolation values in the vicinity of 0.8 GHz are almost the same of −13 dB. In summary, as the gap region G increases, the isolation is improved but the return loss is rather deteriorated at an LB resonant frequency. Accordingly, the gap region G, which satisfies the return loss of −10 dB or less and the isolation, can be reduced down to 1.5 mm. In some implementations, the gap of the gap region G may be set to 1.8 mm to satisfy the isolation and return loss of −10 dB or less in the entire band of 0.6 to 1.5 GHz, in consideration of design tolerances, etc., but may not be limited thereto.

Figure 8A:
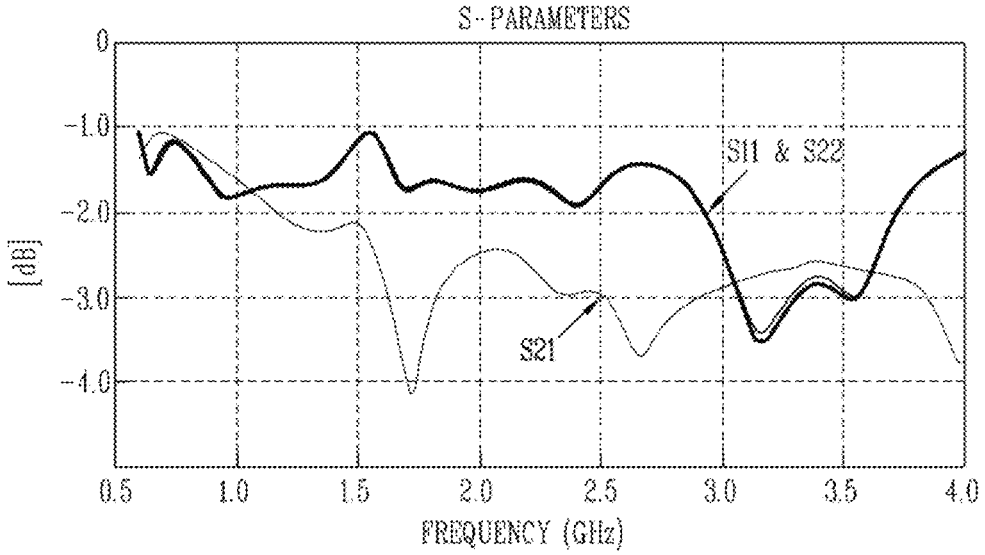
FIG. 8A illustrates return loss and isolation characteristics of first and second antennas in first to third bands in the antenna structure of FIG. 6.
Figure 8B:
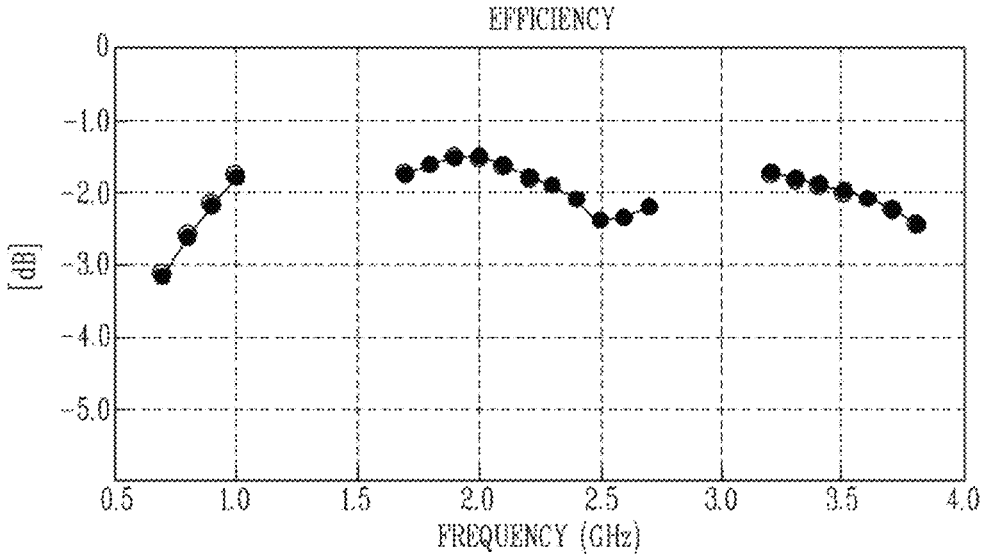
FIG. 8B illustrates efficiency characteristics of the first and second antennas in the first to third bands in the antenna structure of FIG. 6.

FIG. 8A illustrates return loss and isolation characteristics of the first and second antennas in the first to third bands in the antenna structure of FIG. 6. FIG. 8B illustrates efficiency characteristics of the first and second antennas in the first to third bands in the antenna structure of FIG. 6.

Referring to FIGS. 6 and 8A, the first and second antennas ANT1 and ANT2 configured in the same shape in the mirror structure may have the same resonant frequency characteristics. In addition, in spite of the structure in which the first and second antennas ANT1 and ANT2 are arranged adjacent to each other with a gap G1 of about 1.8 mm, the isolation characteristics are −10 dB or less in the entire first to third bands.

Referring to FIGS. 6 and 8B, the antenna efficiencies of the first and second antennas ANT1 and ANT2 have a value of −3.5 dB or more in the entire first to third bands.

Figure 9A:
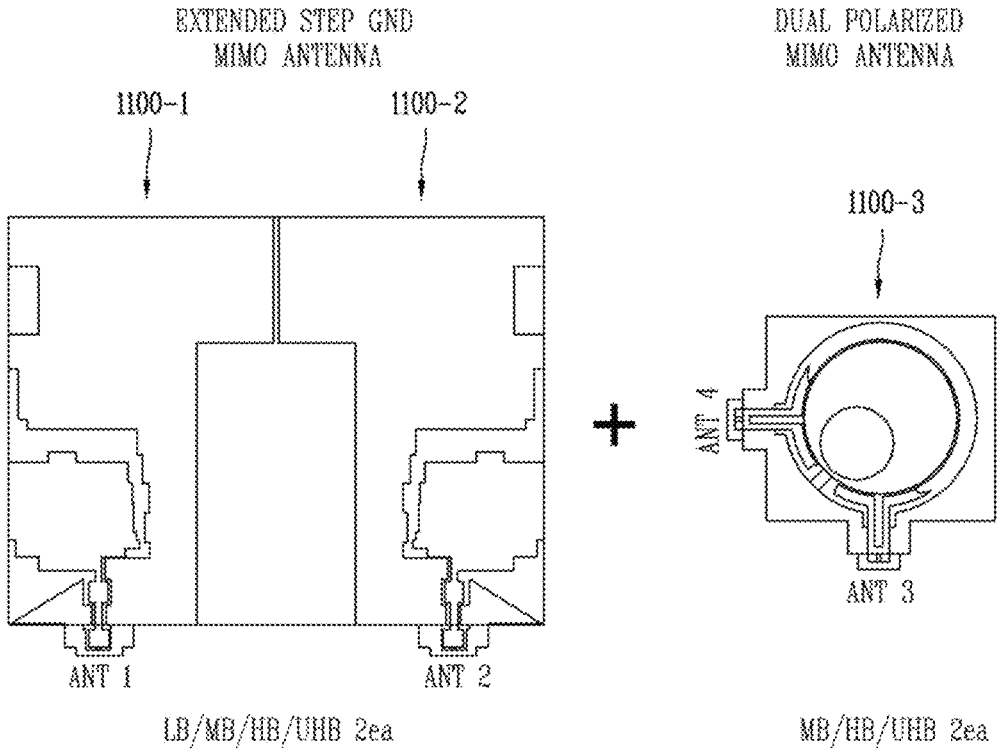
FIG. 9A illustrates an example of a combination of a first type MIMO antenna with symmetrical extended step grounds and a second type dual polarized MIMO antenna.
Figure 9B:
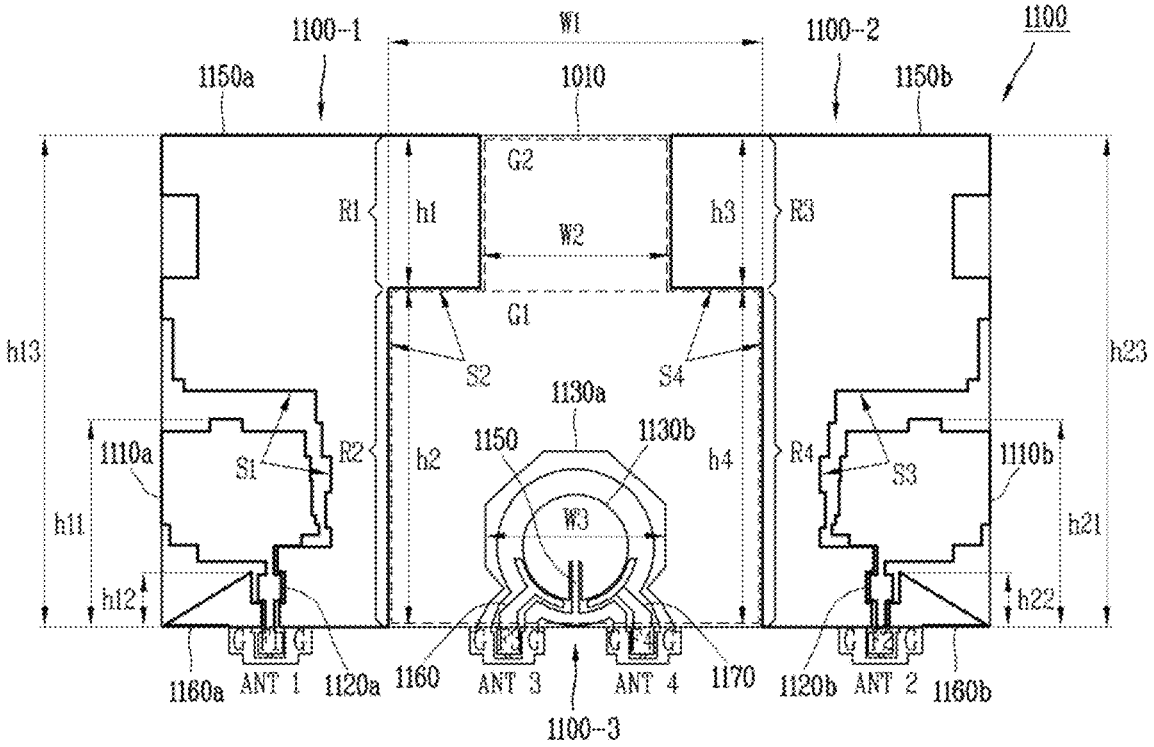
FIG. 9B illustrates an optimal arrangement of the first type MIMO antenna and the second type dual-polarized MIMO antenna.

In some examples, the antenna module may include a plurality of antenna elements that can be optimally disposed in a minimum space through a combination of radiation structures of different shapes. FIG. 9A illustrates an example of a combination of a first type MIMO antenna with symmetrical extended step grounds and a second type dual polarized MIMO antenna. Also, FIG. 9B illustrates an optimal arrangement of the first type MIMO antenna and the second type dual-polarized MIMO antenna.

Referring to FIGS. 6 and 9A, the first radiation structure 1100-1 and the second radiation structure 1100-2 may operate as the first antenna ANT1 and the second antenna ANT2. The first radiation structure 1100-1 and the second radiation structure 1100-2 may be arranged in a left-right symmetrical structure, that is, in a mirror shape with respect to a center line, so as to minimize an antenna space. In addition, the first radiation structure 1100-1 and the second radiation structure 1100-2 may reduce an interference level between antennas by adjusting a current path for each band. The first antenna ANT1 and the second antenna ANT2 may operate simultaneously in the same band. Therefore, MIMO can be carried out through the first antenna ANT1 and the second antenna ANT2.

Referring to FIGS. 6 and 9A, a third radiation structure 1100-3 may operate as a dual polarized MIMO antenna. Accordingly, the third radiation structure 1100-3 may operate as a third antenna ANT3 and a fourth antenna ANT4. Shapes of inner patch and outer patch constituting the third radiation structure 1100-3 may not be limited to FIG. 9A and may alternatively be configured in other shapes as illustrated in FIG. 9B. As illustrated in FIG. 9B, a first patch 1130*a* corresponding to the external patch may be formed in a polygonal or circular shape to minimize a space occupied by the third radiation structure 1100-3.

Referring to FIGS. 6 and 9A, the first and second radiation structures 1100-1 and 1100-2 may operate in LB/MB/HB/UHB. In some examples, the third radiation structure 1100-3 may operate in MB/HB/UHB excluding LB. Here, LB/MB/HB/UHB represents a low band, a mid band, a high band, and an ultra-high band, respectively. In this regard, LB may be referred to as a first band, MB may be referred to as a second band, and HB/UHB may be referred to as a third band, but may not be limited thereto.

Referring to FIGS. 6, 9A and 9B, the antenna assembly 1100 may include a dielectric substrate 1010, antenna elements 1100-1 to 1100-3, and gap regions G1 and G2. The antenna elements 1100-1 to 1100-3 may be implemented as conductive patterns on the dielectric substrate 1010 to radiate radio signals.

The first radiation structure 1100-1 may include a third conductive pattern 1150*a* and a second conductive pattern 1160*a*. In this regard, the first radiation structure 1100-1 may include a first conductive pattern 1110*a*, a third conductive pattern 1150*a*, and a second conductive pattern 1160*a*. The first conductive pattern 1110*a* is electrically connected a first feeding portion FP1, and the second conductive pattern 1160*a* and the third conductive pattern 1150*a* is electrically connected to a ground G. The first conductive pattern 1110*a* may be disposed between the second conductive pattern 1160*a* and the third conductive pattern 1150*a*. In addition, a size of the second conductive pattern 1160*a* may be smaller than a size of the third conductive pattern 1150*a*.

The second radiation structure 1100-2 may include a fifth conductive pattern 1150*b* and a sixth conductive pattern 1160*b*. In this regard, the second radiation structure 1100-2 may include a fourth conductive pattern 1110*b*, the fifth conductive pattern 1150*b*, and the sixth conductive pattern 1160*b*. The fourth conductive pattern 1110*b* is electrically connected a second feeding portion FP2, and the fifth conductive pattern 1150*b* and the sixth conductive pattern 1160*b* may be electrically connected to the ground G. The fourth conductive pattern 1110*b* may be disposed between the fifth conductive pattern 1150*b* and the sixth conductive pattern 1160*b*. In addition, a size of fifth conductive pattern 1150*b* may be bigger than a size of the sixth conductive pattern 1160*b*.

Meanwhile, the third conductive pattern 1150*a* and the fifth conductive pattern 1150*b* may be separated by a gap region G1, G2. The gap region may comprise a first gap portion G1 and a second gap portion G2. In this regard, a distance of the first gap portion G1 may be wider than a distance of the second gap portion G2. The first radiation structure 1100-1 and the second radiation structure 1100-2 may be configured in a symmetrical structure with respect to a center line between the first radiation structure 1100-1 and the second radiation structure 1100-2. In some examples, a height h1 of the first conductive pattern 1110*a* may be higher than a height h2 of the second conductive pattern 1160*a*. In this regard, a height h3 of the third conductive pattern 1150*a* may be higher than the height h1 of the first conductive pattern 1110*a*. In addition, a height h4 of the fourth conductive pattern 1110*b* may be higher than a height h6 of the sixth conductive pattern 1160*b*. In this regard, a height h5 of the fifth conductive pattern 1150*b* may be higher than the height h4 of the fourth conductive pattern 1110*b*.

In some examples, the third conductive pattern 1150*a* may configured to have a first region R1 and a second region. The first region R1 may be connected with the second region R2. In addition, the fifth conductive pattern

1150*b* may configured to have a third region R3 and a fourth region R4. The third region R3 may be connected with the fourth region R4. Meanwhile, a portion of the second region R2 and a portion of the fourth region R4 may be connected with the ground G, respectively.

In some examples, the first and second side surfaces S1, S2 may form a boundary of the third conductive pattern 1150*a*, and the third and fourth side surfaces S3, S4 may form a boundary of the fifth conductive pattern 1150*b*. In this regard, the boundary S2 of the third conductive pattern 1150*a* may be faced with the boundary S4 of the fifth conductive pattern 1150*b*. In this regard, the boundary S2 of the third conductive pattern 1150*a* in the second region R2 may be separated from the boundary S4 of the fifth conductive pattern 1150*b* in the fourth region R4 by a first width W1 of the first gap region G1. The boundary S2 of the third conductive pattern 1150*a* in the first region R1 may be separated from the boundary S4 of the fifth conductive pattern 1150*b* in the third region R3 by a second width W2 of the second gap region G2. The first width W1 of the first gap region G1 may be wider than the second width W2 of the second gap region G2. In this regard, the structure of the third and fifth conductive patterns 1150*a*, 1150*b* is formed to surround the first and fourth conductive patterns 1110*a*, 1110*b* and thus the first and third regions R1, R3 may form a protruded region. Meanwhile, the second and fourth regions R2, R4 may form a recessed region.

In some examples, a height of the boundary S2 of the third conductive pattern 1150*a* in the second region R2 may be higher than a height of the boundary S2 of the third conductive pattern 1150*a* in the first region R1. Similarly, a height of the boundary S4 of the fifth conductive pattern 1150*b* in the fourth region R4 may be higher than a height of the boundary S4 of the fifth conductive pattern 1150*b* in the third region R3. In this regard, the height of the boundary S2 of the third conductive pattern 1150*a* in the second region R2 and the height of the boundary S4 of the fifth conductive pattern 1150*b* in the fourth region R4 may be formed with same height. Similarly, the height of the boundary S2 of the third conductive pattern 1150*a* in the first region R1 and the height of the boundary S4 of the fifth conductive pattern 1150*b* in the third region R3 R4 may be formed with same height.

Meanwhile, the antenna assembly 1100 may further comprise a third radiation structure 1100-3. The third radiation structure 1100-3 may be disposed in the first gap region G1. In this regard, a height of the third radiation structure 1100-3 may be smaller than a height of the second gap region G2. As an example, a width of the third radiation structure 1100-3 may be same with the distance of the second gap region G2.

In addition, the third radiation structure 1100-3 may be configured in a symmetrical structure with respect to the center line between the first radiation structure 1100-1 and the second radiation structure 1100-2. In this regard, a detailed structure of the third radiation structure 1100-3 will be described in a description in connection with FIG. 10.

The antenna elements may include a first radiation structure 1100-1, a second radiation structure 1100-2, and a third radiation structure 1100-3 to operate as first to fourth antennas ANT1 to ANT4. Accordingly, the antenna structure of FIG. 9B may be a 4×4 MIMO antenna structure. The third radiation structure 1100-3 may be disposed in a space between the first radiation structure 1100-1 and the second radiation structure 1100-2 without an additional arrangement space. Accordingly, since the 4×4 MIMO antenna is disposed within a limited space, it may be referred to as an All-in-One MIMO antenna.

1) With respect to a gap between grounds, it may be advantageous in view of isolation to more widen the gap region G2 between the first and third regions R1 and R3 as the upper regions of the third and fifth conductive patterns 1150*a* and 1150*b*. It can be optimally adjusted to improve radiation efficiency and bandwidth. For example, in order to minimize the return loss and the antenna arrangement space, the gap region G2 may be set to about 1.5 to 1.8 mm.

2) With respect to a distance between antennas, a gap between the first and second antennas ANT1 and ANT2 with respect to the first and second feeding lines 1120*a* and 1120*b* may be set in consideration of the size of the third radiation structure 1100-3 disposed at a central region of the dielectric substrate 1010. However, in the present disclosure, the shape of the third radiation structure 1100-3 can be optimized so that the gap between the first and second antennas ANT1 and ANT2 is not increased. The gap between the first and second antennas ANT1 and ANT2 may be related to the gap region G2 defined between the first and third regions R1 and R3.

In this regard, the gap between the first and second antennas ANT1 and ANT2 may be a narrow interval within one wavelength, not in units of several wavelengths like a general MIMO antenna. The gap between the first and second antennas ANT1 and ANT2 may be adjustable in consideration of interference between the antennas. In this regard, current paths that are defined at the first and second antennas ANT1 and ANT2 may be generated outside the feeding lines 1120*a* and 1120*b* or adjacent to the feeding lines 1120*a* and 1120*b*. Accordingly, the antenna structure can maintain the interference between the antennas below a threshold value without increasing the distance between the first and second antennas ANT1 and ANT2.

3) With regard to an extended ground structure, the first and second radiator structures 1100-1 and 1110-2 may be disposed to face each other in order to improve isolation between the antennas. The isolation between the antennas may consider both the isolation between the first and third antennas and the isolation between the second and fourth antennas in addition to the isolation between the first and second antennas. Accordingly, an extended ground structure and a mirror structure of the third and fifth conductive patterns 1150*a* and 1150*b* may be designed such that the isolation between the first and second antennas, the isolation between the first and third antennas, and the isolation between the second and fourth antennas are all below the threshold value. In some examples, in MB/HB/UHB operation modes, the extended step ground structure of the third and fifth conductive patterns 1150*a* and 1150*b* may especially operate as an isolator.

4) With regard to a dual polarized antenna feeding design, end portions of third and fourth feeding lines 1160 and 1170 may be disposed on the same line with end portions of the first and second feeding lines 1120*a* and 1120*b* for alignment with the first and second feeding lines 1120*a* and 1120*b*. In some examples, another end portions of the third and fourth feeding lines 1160 and 1170 may be connected to the second patch 1130*b* at about 45 degrees, so that the third radiation structure 1100-3 can operate as a dual polarized antenna.

As described above, the antenna elements may include the first radiation structure 1100-1, the second radiation structure 1100-2, and the third radiation structure 1100-3. The first and second radiation structures 1100-1 and 1100-2 corresponding to the first type MIMO antennas may constitute an extended step ground MIMO antenna. The first type MIMO antennas may include the first antenna ANT1 and the second antenna ANT2 operating in LB/MB/HB/UHB. The third radiation structure 1100-3 corresponding to the second type MIMO antenna may constitute a dual polarized MIMO antenna. The second type MIMO antenna may include the third antenna ANT3 and the fourth antenna ANT4 operating in MB/HB/UHB.

In the antenna assembly 1100, a 4×4 MIMO antenna can be constituted in a manner that the first and second type MIMO antennas include the first to fourth antennas ANT1 to ANT4 within a limited region. Since the 4×4 MIMO antenna is disposed within the limited region and the second type antenna is disposed between the first type antennas, the antenna assembly 1100 can be referred to as an all-in-one antenna.

The antenna assembly 1100 may perform a 2×2 MIMO operation in LB through the first antenna ANT1 and the second antenna ANT2 corresponding to the first type MIMO antennas. In addition, the antenna assembly 1100 may perform a 4×4 MIMO operation in MB/HB/UHB through the first antenna ANT1 to the fourth antenna ANT4. Accordingly, the antenna assembly 1100 may perform a 4×4 MIMO operation in MB/HB/UHB using both the first type MIMO antennas and the second type MIMO antennas.

The first radiation structure 1100-1 may include a third conductive pattern 1150*a* and a second conductive pattern 1160*a* that are defined at both sides of the first conductive pattern 1110*a* on the dielectric substrate 1010 in the one axial direction to have different lengths. The second radiation structure 1100-2 may include a fifth conductive pattern 1150*b* and a sixth conductive pattern 1160*b* that are defined at both sides of the fourth conductive pattern 1110*b* on the dielectric substrate 1010 in the one axial direction to have different lengths.

The third radiation structure 1100-3 may be disposed between the first radiation structure 1100-1 and the second radiation structure 1100-2. The gap regions G1 and G2 may be defined between the third conductive pattern 1150*a* of the first radiation structure 1100-1 and the fifth conductive pattern 1150*b* of the second radiation structure 1100-2.

The gap regions G1 and G2 may include the first gap region G1 and the second gap region G2 that is an upper region of the first gap region G1 in the one axial direction. In this regard, a first gap of the first gap region G1 may be wider than a second gap of the second gap region G2, and the third radiation structure 1100-3 may be disposed in the first gap region G1.

As described above, the first radiation structure 1100-1 and the second radiation structure 1100-2 may be formed in the symmetrical structure. In this regard, the third conductive pattern 1150*a* of the first radiation structure 1100-1 and the fifth conductive pattern 1150*b* of the second radiation structure 1100-2 may be disposed to face each other. Accordingly, the first radiation structure 1100-1 and the second radiation structure 1100-2 can have a symmetrical structure with respect to a center line between the first radiation structure 1100-1 and the second radiation structure 1100-2.

The first radiation structure 1100-1 may include the first conductive pattern 1110*a*, the first feeding line 1120*a*, the third conductive pattern 1150*a*, and the second conductive pattern 1160*a*. In this regard, the first feeding line 1120*a* may apply a signal on the same plane as the conductive patterns of the first conductive pattern 1110*a*. The third conductive pattern 1150*a* may be disposed at one side surface of the first conductive pattern 1110*a* at one side of the first feeding line 1120*a* and also disposed at an upper side of the first conductive pattern 1110*a* in the one axial direction. The third conductive pattern 1150*a* may radiate a signal of a first band, and the first conductive pattern 1110*a* may radiate a signal of a second band higher than the first band. The second conductive pattern 1160*a* may be disposed at a lower side of the first conductive pattern 1110*a* in the one axial direction at another side of the first feeding line 1120*a*. The second conductive pattern 1160*a* may radiate a signal of a third band higher than the second band.

The second radiation structure 1100-2 may include the fourth conductive pattern 1110*b*, the second feeding line 1120*b*, the fifth conductive pattern 1150*b*, and the sixth conductive pattern 1160*b*. In this regard, the second feeding line 1120*b* may apply a signal on the same plane as the conductive patterns of the fourth conductive pattern 1110*b*. The sixth conductive pattern 1160*b* may be disposed at a lower side of the fourth conductive pattern 1110*b* in the one axial direction at one side of the second feeding line 1120*b*. The sixth conductive pattern 1160*a* may be disposed at one side surface of the fourth conductive pattern 1110*b* at another side of the second feeding line 1120*b* and also disposed at an upper side of the fourth conductive pattern 1110*b* in the one axial direction. The sixth conductive pattern 1160*a* may radiate a signal of a first band, and the fourth conductive pattern 1110*b* may radiate a signal of a second band higher than the first band. The sixth conductive pattern 1160*b* may radiate a signal of a third band higher than the second band.

In some examples, the third conductive pattern 1150*a* may include first side surfaces S1 spaced apart from the first feeding line 1120*a* and the first conductive pattern 1110*a*. In addition, the third conductive pattern 1150*a* may further include second side surfaces S2 that are another side surfaces of the first side surfaces S1. In this regard, boundaries of the first side surfaces S1*a* and S1*b* of the third conductive pattern 1150*a* may be disposed on the same plane to be spaced apart different gaps from a boundary of the one side surface of the first conductive pattern 1110*a* and a boundary of the upper side of the first conductive pattern 1110*a*. In this case, the boundaries of the first side surfaces S1 of the third conductive pattern 1150*a* may be recessed to configure an extended step ground structure.

The fifth conductive pattern 1150*b* may include third side surfaces S3 spaced apart from the second feeding line 1120*b* and the fourth conductive pattern 1110*b*. The fifth conductive pattern 1150*b* may further include fourth side surfaces S4 that are another side surfaces of the third side surfaces S3. In this regard, boundaries of the third side surfaces S3 may be disposed on the same plane to be spaced apart different gaps from a boundary of the one side surface of the fourth conductive pattern 1110*b* and a boundary of the upper side of the fourth conductive pattern 1110*b*. In this case, the boundaries of the third side surfaces S3 of the fifth conductive pattern 1150*b* may be recessed to configure an extended step ground structure.

In the first and second radiation structures 1100-1 and 1110-2, the second and sixth conductive patterns 1160*a* and 1160*b* may have a triangular shape. The second conductive pattern 1160*a* may be spaced apart from the boundary of the first feeding line 1120*a* and may have a triangular shape in which its height is decreased in a lateral direction from the boundary of the first feeding line 1120*a*. Accordingly, the second conductive pattern 1160*a* may be spaced farther apart from the first conductive pattern 1110*a* at its side region than at its central region. The sixth conductive pattern 1160*b* may be spaced apart from the boundary of the second feeding line 1120*b* and may have a triangular shape in which its height is decreased in a lateral direction from the boundary of the second feeding line 1120*b*. Accordingly, the sixth conductive pattern 1160*b* may be spaced farther apart from the fourth conductive pattern 1110*b* at its side region than at its central region.

Meanwhile, the third conductive pattern 1150*a* may include a first region R1 corresponding to its upper region, and have a linear structure in which its end portion is on a line parallel to one axis on the second side surface S2. Also, the third conductive pattern 1150*a* may further include a second region R2 corresponding to a region lower than the first region R1 and having a narrower width than the end portion of the first region R1. One side surface of the second region R2 may be spaced apart from the first feeding line 1120*a* and the one side surface of the first conductive pattern 1110*a*, and may be spaced apart from the upper side of the first conductive pattern 1110*a*. In some examples, another side surface of the second region R2 may define the second side surface S2.

The fifth conductive pattern 1150*b* may include a third region R3 corresponding to its upper region, and have a linear structure in which its end portion is on a line parallel to one axis on the fourth side surface S4. Also, the fifth conductive pattern 1150*b* may further include a fourth region R4 corresponding to a region lower than the third region R3 and having a narrower width than the end portion of the third region R3. One side surface of the fourth region R4 may be spaced apart from the second feeding line 1120*b* and one side surface of the fourth conductive pattern 1110*b*, and may be spaced apart from the upper side of the fourth conductive pattern 1110*b*. In some examples, another side surface of the third region R3 may define the fourth side surface S4.

In some examples, the first gap region G1 and the second gap region G2 may correspond to dielectric regions. The first gap region G1 may define a first dielectric region on the dielectric substrate 1010. The first dielectric region may be defined at a first gap between the end portion of the second region R2 of the third conductive pattern 1150*a* and the end portion of the fourth region R4 of the second conductive pattern 1160*a*. The second gap region G2 may define a second dielectric region on the dielectric substrate 1010. The second dielectric region may be defined at a second gap between the end portion of the first region R1 of the third conductive pattern 1150*a* and the end portion of the third region R3 of the second conductive pattern 1160*a*. In this regard, the first gap of the first gap region G1 may be wider than the second gap of the second gap region G2 in another axial direction perpendicular to the one axis. Accordingly, for a minimum spatial arrangement structure, the third radiation structure 1100-3 may be disposed in the first gap region G1 defining the wider dielectric region.

The third radiation structure 1100-3 operating in the second band and the third band may have a smaller size than the first and second radiation structures 1100-1 and 1100-2 operating in the first to third bands. Accordingly, the third radiation structure 1100-3 can be disposed in a space between the first and second radiation structures 110-1 and 1100-2.

Figure 10:
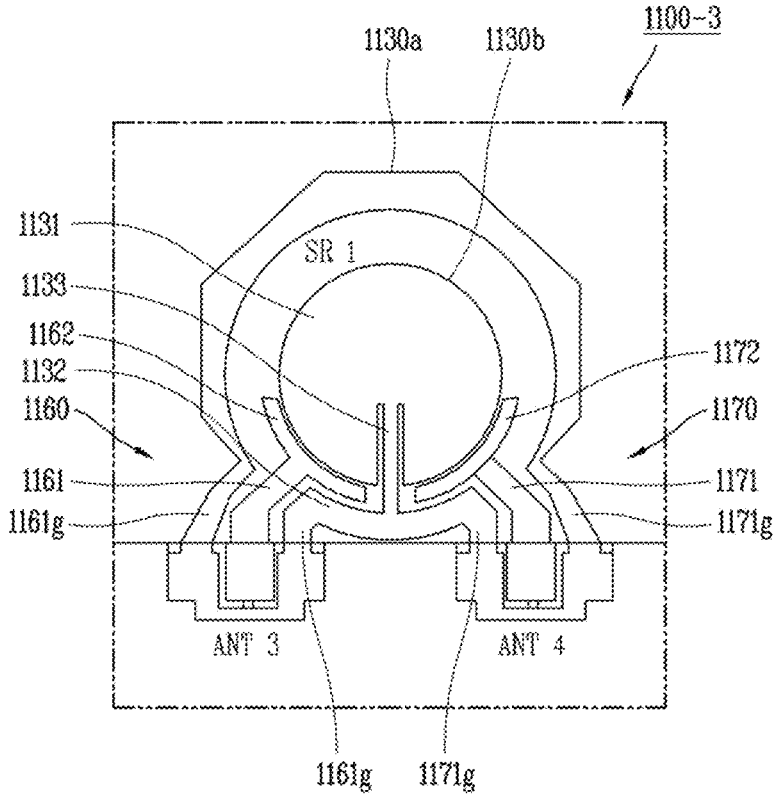
FIG. 10 is an enlarged view of a third radiation structure in accordance with one implementation.

The third radiation structure 1100-3 may include a plurality of antenna elements isolated from one another by slots. In this regard, FIG. 10 is an enlarged view of the third radiation structure in accordance with one example. Referring to FIGS. 9A to 10, the third radiation structure 1100-3 may include a first patch 1130*a* and a second patch 1130*b*. Referring to FIG. 10, the first patch 1130*a* and the second patch 1130*b* may be referred to as an outer patch and an inner patch, respectively. The first patch 1130*a* and the second patch 1130*b* may be formed in a polygonal shape and a circular shape, but may not be limited thereto.

Meanwhile, the third radiation structure 1100-3 may comprise a plurality of conductive patterns. In this regard, the third radiation structure 1100-3 may comprise seventh to tenth conductive patterns 1130*a*, 1130*b*, 1160, 1170. The seventh and eight conductive patterns 1130*a*, 1130*b* may be referred to as the first patch 1130*a* and the second patch 1130*b*, respectively. The seventh conductive pattern 1130*a* may have an opening corresponding to an inner region of the seventh conductive pattern 1130*a*. In this regard, a first end and a second end of the seventh conductive pattern 1130*a* electrically are connected with the ground G. Similarly, the eighth conductive pattern 1130*b* may be disposed in the opening corresponding to an inner region of the seventh conductive pattern 1130*a*. In this regard, a third end and a fourth end of eighth conductive pattern 1130*b* electrically are connected with the ground G.

The third radiation structure 1100-3 may comprise a slot region between the plurality of conductive pattern. In this regard, the third radiation structure 1100-3 may further comprise a first slot SR1 disposed between the seventh conductive pattern 1130*a* and the eighth conductive pattern 1130*b*. The third radiation structure 1100-3 may further comprise a ninth conductive pattern 1160, 1161, 1162 and a tenth conductive pattern 1170, 1171, 1172.

The tenth conductive pattern 1170, 1171, 1172 may be disposed in the first slot SR1. In this regard, an end of the ninth conductive pattern 1160 electrically is connected with a third feeding portion FP3. In addition, the tenth conductive pattern 1170, 1171, 1172 may be disposed in the first slot SR1. In this regard, an end of the tenth conductive pattern 1170 electrically is connected with a fourth feeding portion FP4. Meanwhile, the eight conductive pattern 1130*b* may comprise a first part 1131, a second part 1132 and a third part 1133 connecting the first part 1131 and the second part 1132. The second part 1132 may configured to have the third end and the fourth end of the eighth conductive pattern 1130*b*. The second part 1132 and the third part 1133 may be disposed between the ninth conductive pattern 1160, 1161, 1162 and the tenth conductive pattern 1170, 1171, 1172.

The first patch 1130*a* and the second patch 1130*b* may be formed in the shape of one of combinations including rectangle/rectangle, polygon/polygon, circle/circle, polygon/circle, or circle/polygon. The shape of the second patch 1130*b* as the inner patch may correspond to a shape of a first slot SR1.

The third radiation structure 1100-3 may operate as a dual polarized antenna. Accordingly, although the third radiation structure 1100-3 is implemented as a single antenna element, it may functionally operate as two antennas. The third radiation structure 1100-3 may include the first patch 1130*a*, the second patch 1130*b*, the third feeding line 1160, and the fourth feeding line 1170.

The first patch 1130*a* may be configured such that the first slot SR1 is formed in an inner region of a first conductive pattern that is disposed on the dielectric substrate 1010. The first patch 1130*a* may radiate a signal in the second band through the first conductive pattern. The second patch 1130*b* may radiate a signal in the third band through a second conductive pattern that is disposed in the inner region of the first slot SR1.

The third feeding line 1160 may be disposed at a first feeding region of the first slot SR1 between the inside of the first patch 1130*a* and the outside of the second patch 1130*b*. The fourth feeding line 1170 may be disposed at a second feeding region of the first slot SR1 between the inside of the first patch 1130*a* and the outside of the second patch 1130*b*. Here, the second feeding region of the first slot SR1 may correspond to a position orthogonal to the first feeding region. Accordingly, the third radiation structure 1100-3 can operate as a dual polarized antenna having mutually orthogonal polarizations.

Feeding lines for feeding the first to third radiation structures 1100-1 to 1100-3 may be disposed on the same line on the dielectric substrate 1010. That is, end portions of the first to fourth feeding lines 1120*a*, 1120*b*, 1160, and 1170 may be disposed on the same line on the dielectric substrate 1010 so as to be all connected to a connector at an end portion of the dielectric substrate 1010, as illustrated in FIG. 9B. In this regard, the third feeding line 1160 and the fourth feeding line 1170 may be rotated by a predetermined angle in a diagonal direction for coupling feeding, so as to be parallel to the one axial direction. The first feeding line 1120*a* to the fourth feeding line 1170 may be parallel to the one axial direction. Accordingly, a first end portion of the first feeding line 1120*a* to a fourth end portion of the fourth feeding line 1170 may be disposed on the same line parallel to another axial direction.

The third radiation structure 1100-3 may further include a connection line 1150 that is disposed between the third feeding line 1160 and the fourth feeding line 1170 to connect the first patch 1130*a* and the second patch 1130*b*.

The third and fourth feeding lines 1160 and 1170 may also be implemented in a CPW line structure like the first and second feeding lines 1120*a* and 1120*b*. In this regard, the third feeding line 1160 and the fourth feeding line 1170 may have a first CPW feeding structure and a second CPW feeding structure in which ground patterns 1161*g* and 1171*g* are formed at sides of signal lines 1161 and 1171. The third feeding line 1160 and the fourth feeding line 1170 may further include a first signal line 1162 and a second signal line 1172 that are spaced apart from the first patch 1130*a* and the second patch 1130*b* by the dielectric region. The first signal line 1162 and the second signal line 1172 may extend along the inside of the first patch 1130*a* and the outside of the second patch 1130*b*.

The third feeding line 1160 may include a first conductive pattern 1161 and a first coupling line 1162. The fourth feeding line 1170 may include a second conductive pattern 1171 and a second coupling line 1172. In this regard, the signal lines 1162 and 1172 may correspond to the first conductive pattern 1161 and the second conductive pattern 1171, respectively. In some examples, the first signal line 1162 and the second signal line 1172 may correspond to the first coupling line 1162 and the second coupling line 1172, respectively.

The first conductive pattern 1161 may be configured such that the first ground patterns 1161*g* are disposed at both sides thereof. The second conductive pattern 1171 may be configured such that the second ground patterns 1171*g* are disposed at both sides thereof. The first coupling line 1162 may extend from an end portion of the first conductive pattern 1161 to both sides along the first slot SR1, to couple a first signal to the first patch 1130*a* or the second patch 1130*b*. The second coupling line 1172 may extend from an end portion of the second conductive pattern 1171 to both sides along the first slot SR1, to couple the first signal to the first patch 1130*a* or the second patch 1130*b*.

One end portion of the first coupling line 1162 may be adjacent to the connection line 1150 with being spaced apart by a predetermined distance. Also, one end portion of the first coupling line 1172 may be adjacent to the connection line 1150 with being spaced apart by a predetermined distance.

In some examples, the antenna assembly 1100 including the first radiation structure 1100-1 to the third radiation structure 1100-3 may be configured such that a plurality of antennas operate independently. In this regard, the antenna assembly 1100 may perform MIMO in the same frequency band through the plurality of antennas.

Specifically, the first radiation structure 1100-1 and the second radiation structure 1100-2 may operate as the first antenna ANT1 and the second antenna ANT2, respectively, in the first to third bands. In some examples, the third radiation structure 1100-3 may operate as the third antenna ANT3 and the fourth antenna ANT4 in the second band and the third band. Accordingly, the third radiation structure 1100-3 can operate as a dual polarized antenna through a single antenna element, and thus can function as two antennas.

The antenna assembly 1100 may operate as the first antenna 1100-1, ANT1 having a first polarization by a first radio signal applied from the first feeding line 1120*a*. The antenna assembly 1100 may operate as the second antenna 1100-2, ANT2 having the first polarization by a second radio signal applied from the second feeding line 1120*b*.

The third radiation structure 1100-3 constituting the antenna assembly 1100 may operate as the third antenna ANT3 having a second polarization by a third radio signal applied from the third feeding line 1160. In some examples, the fourth radiation structure 1100-4 constituting the antenna assembly 1100 may operate as the fourth antenna ANT4 having a third polarization by a fourth radio signal applied from the fourth feeding line 1170.

Figure 11A:
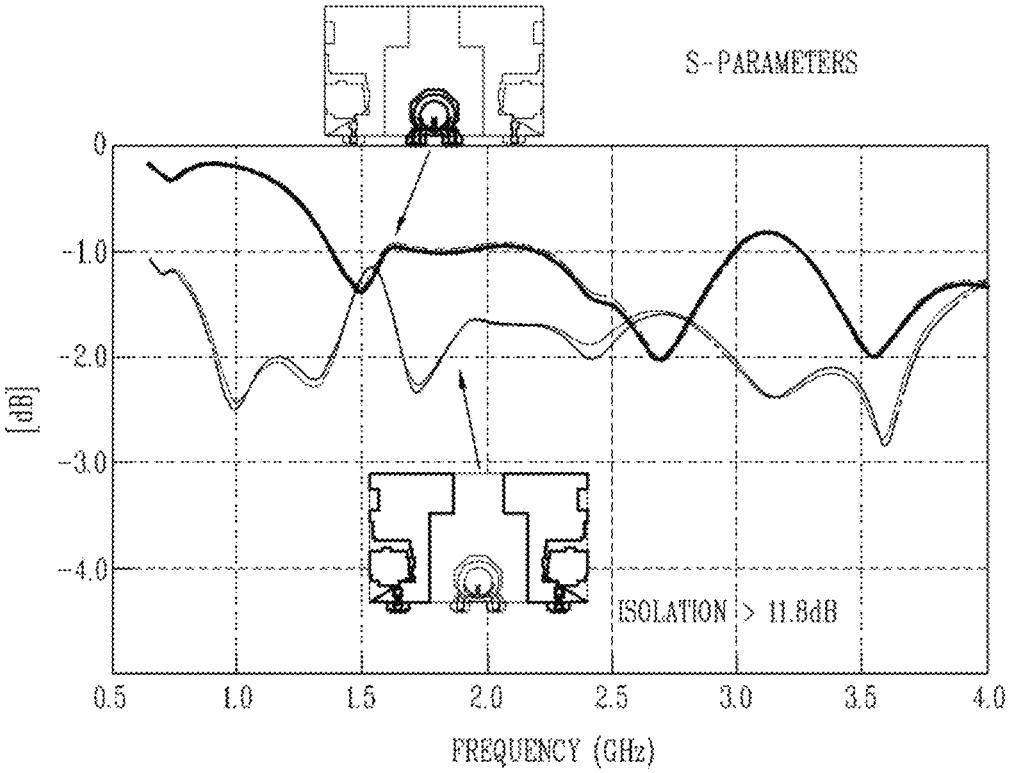
FIG. 11A illustrates a return loss of the third radiation structure and isolation between the first and second radiation structures in the antenna assembly of FIG. 9B.
Figure 11B:
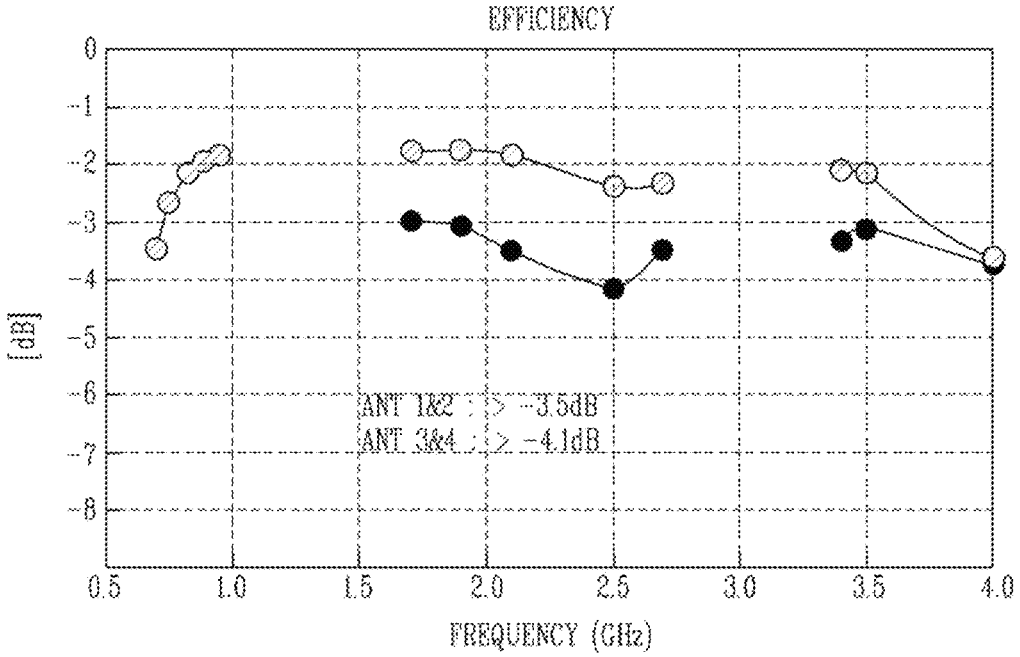
FIG. 11B illustrates efficiency characteristics of first and second radiation structures and efficiency characteristics of third and fourth radiation structures in the antenna assembly of FIG. 9B.

The antenna performance of the first and second radiation structures in which the third conductive patterns are disposed adjacent to each other has been described with reference to FIGS. 7 to 8B. Hereinafter, antenna performance of the entire first to third radiation structures constituting the first to fourth antennas will be described. In this regard, FIG. 11A illustrates the return loss characteristic of the third radiation structure and the isolation between the first and second radiation structures in the antenna assembly of FIG. 9B. FIG. 11B illustrates efficiency characteristics of the first and second radiation structures and efficiency characteristics of the third and fourth radiation structures in the antenna assembly of FIG. 9B.

Referring to FIGS. 6 and 8A, the first and second radiation structures 1100-1 and 1100-2 having the same shape and structure may have the same resonant frequency characteristics. Referring to FIGS. 9B and 11A, the first and second radiation structures 1100-1 and 1100-2 at which the third conductive pattern 1150*a* and the fifth conductive pattern 1150*b* are adjacent to each other may have the isolation of 11.8 dB or more. The third radiation structure 1100-3 that has the different shape from the first and second radiation structures 1100-1 and 1100-2 and operates as the dual polarized antenna may resonate in the second band and the third band. The second band and the third band may include MB/HB/UHB/5G band excluding LB corresponding to the first band.

Referring to FIGS. 9B and 11B, the efficiency of the first and second antennas ANT1 and ANT2 corresponding to the first and second radiation structures 1100-1 and 1100-2 may have a value of −3.5 dB or more. Meanwhile, the efficiency of the third and fourth antennas ANT3 and ANT4 operating as the dual polarized antenna through the third radiation structure 1100-3 may have a value of −4.1 dB or more.

Figure 12A:
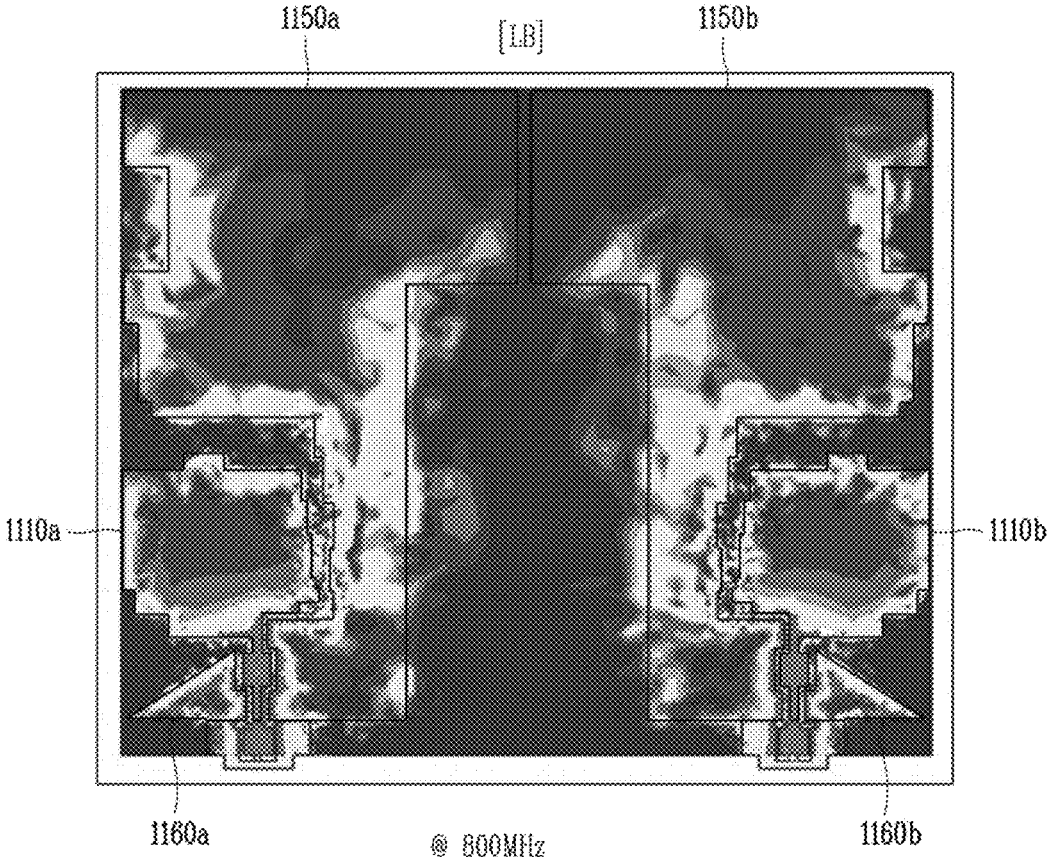
FIGS. 12A to 12C illustrate a surface current distribution of the first and second radiation structures in the first to third bands.
Figure 12B:
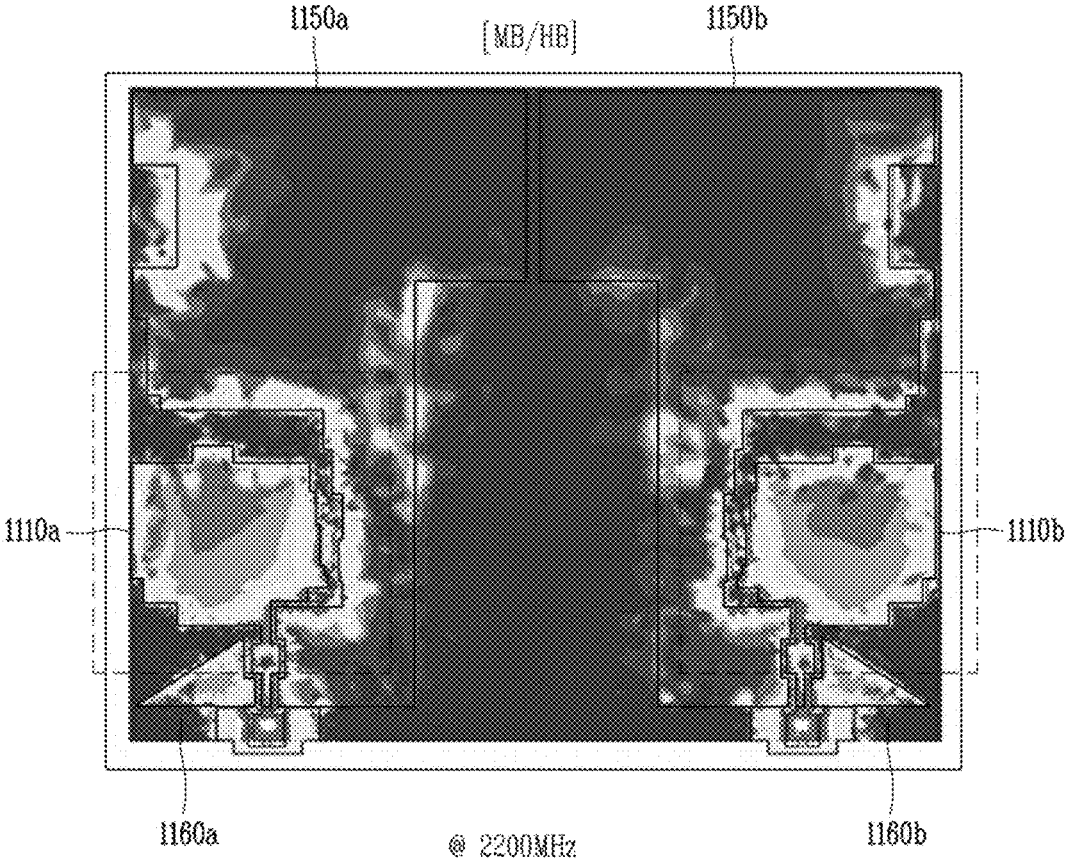
Figure 12C:
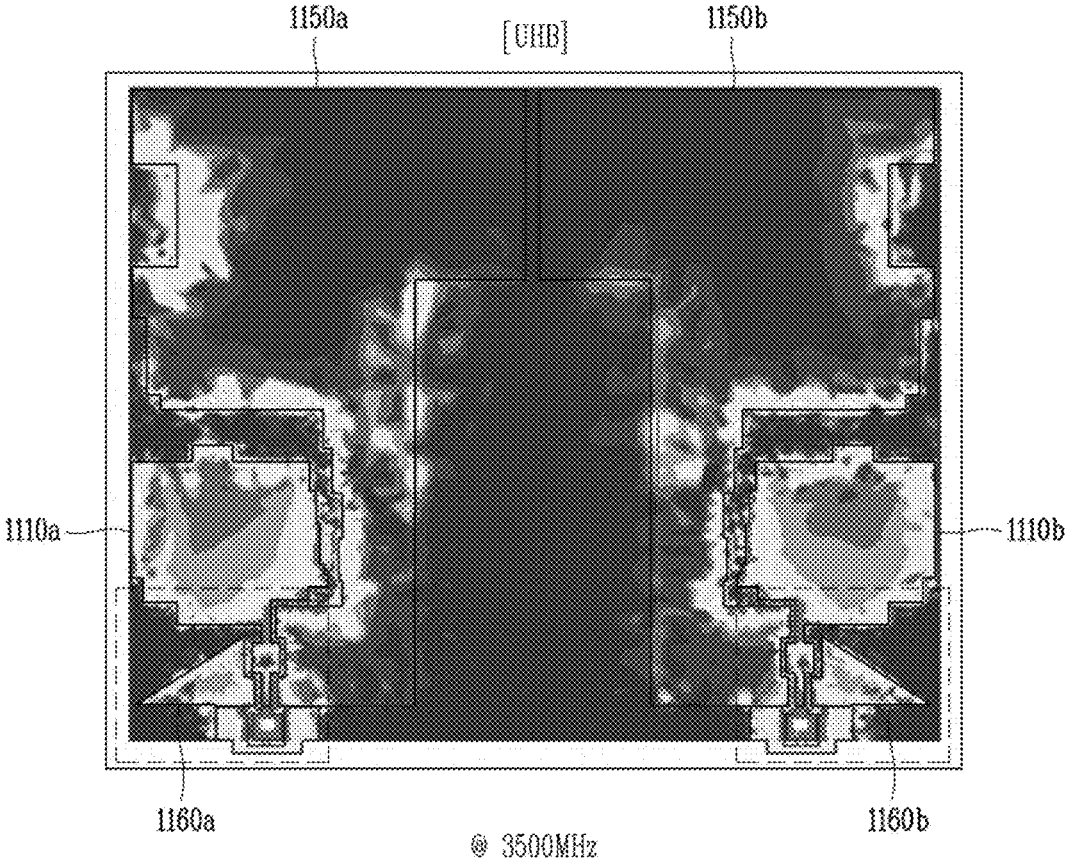

On the other hand, the first and second radiation structures 1100-1 and 1100-2 constituting the antenna assembly 1100 may be disposed adjacent to each other with very low mutual interference. FIGS. 12A to 12C illustrate a surface current distribution of the first and second radiation structures in the first to third bands.

Referring to FIGS. 6 and 9B, the third and fifth conductive patterns 1150*a* and 1150*b* of the MIMIO antennas may be disposed to face each other to minimize mutual influence of the antennas having the same shape when the antennas operate in the same frequency band. The MIMIO antennas may include the first and second radiation structures 1100-1 and 1100-2.

Referring to FIGS. 6, 9B, and 12A, the surface current distribution at 800 MHz in the first band LB is high at the feeding lines 1120*a* and 1120*b* and the first and fourth conductive patterns 1110*a* and 1110*b*. On the other hand, the surface current distribution is higher at the second and fourth regions R2 and R4 as the lower regions than at the first and third regions R1 and R3 as the upper regions in the third and fifth conductive patterns 1150*a* and 1150*b*. Accordingly, an interference level between the first and second antennas ANT1 and ANT2 can be kept low in the first band such as 800 MHz, despite the gap (e.g., 1.8 mm) of the gap region G1 that is very narrow.

Referring to FIGS. 6, 9B, and 12B, the surface current distribution at 2200 MHz in the second band MB/HB is high at the feeding lines 1120*a* and 1120*b* and the first and fourth conductive patterns 1110*a* and 1110*b*. On the other hand, the surface current distribution is higher at the second and fourth regions R2 and R4 as the lower regions than at the first and third regions R1 and R3 as the upper regions in the third and fifth conductive patterns 1150*a* and 1150*b*. Accordingly, an interference level between the first and second antennas ANT1 and ANT2 can be kept low in the second band such as 2200 MHz, despite the gap (e.g., 1.8 mm) of the gap region G1 that is very close.

On the other hand, the gap of 1.8 mm of the gap region G1 may be regarded as a wider gap in the second band than in the first band. Accordingly, as illustrated in FIG. 8A, the isolation between the first and second radiation structures in the second band is more improved than the isolation between the first and second radiation structures in the first band.

Referring to FIGS. 6, 9B, and 12C, the surface current distribution at 3500 MHz in the third band UHB is high at the feeding lines 1120*a* and 1120*b* and the second and sixth conductive patterns 1160*a* and 1160*b*. On the other hand, the surface current distribution is higher at the second and fourth regions R2 and R4 as the lower regions than at the first and third regions R1 and R3 as the upper regions in the third and fifth conductive patterns 1150*a* and 1150*b*. Accordingly, an interference level between the first and second antennas ANT1 and ANT2 can be kept low in the third band such as 3500 MHz, despite the gap (e.g., 1.8 mm) of the gap region G1 that is narrow.

On the other hand, the gap of 1.8 mm of the gap region G1 may be regarded as a wider gap in the third band than in the first and second bands. Accordingly, as illustrated in FIG. 8A, the isolation between the first and second radiation structures in the third band is more improved than the isolation between the first and second radiation structures in the first band.

Referring to FIGS. 6, 8A, 9B, and 12A to 12C, the surface current distribution is low at the first and third regions R1 and R3 although the first and third regions R1 and R3 of the third and fifth conductive patterns 1150*a* and 1150*b* are disposed adjacent to each other. Accordingly, even though the gap region G is formed to be narrow, there is little interference between the first and second antennas ANT1 and ANT2 during the MB/HB/UHB operation. In some examples, although the gap region G is formed to be narrow, the interference between the first and second antennas ANT1 and ANT2 may be maintained at a threshold value, for example, —10 dB or less, even during the LB operation.

Figure 13A:
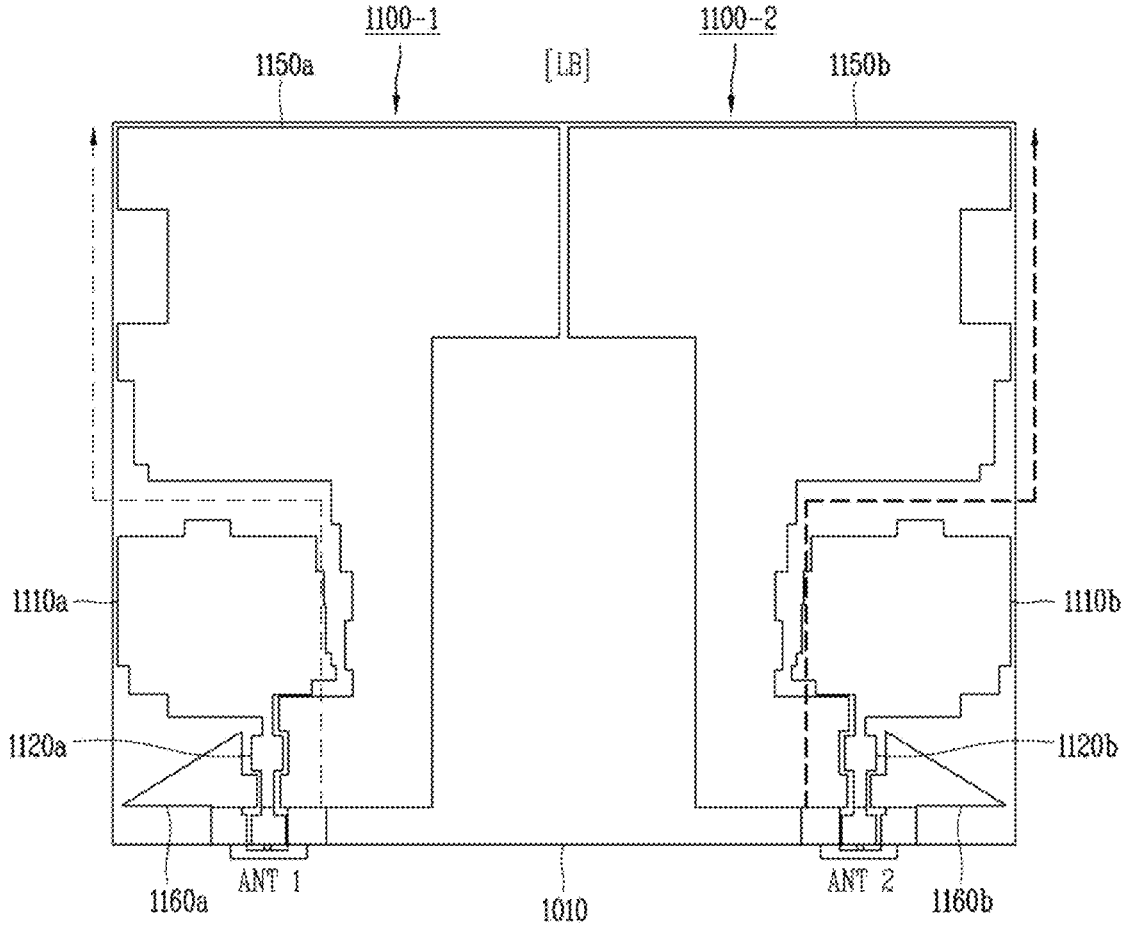
FIGS. 13A to 13C illustrate current paths and radiation patterns in the first to third bands.
Figure 13A:
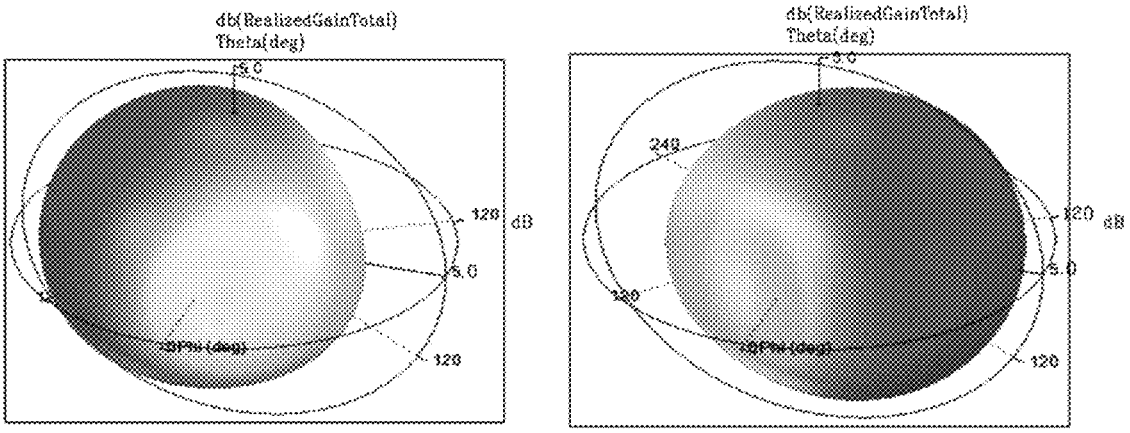
Figure 13B:
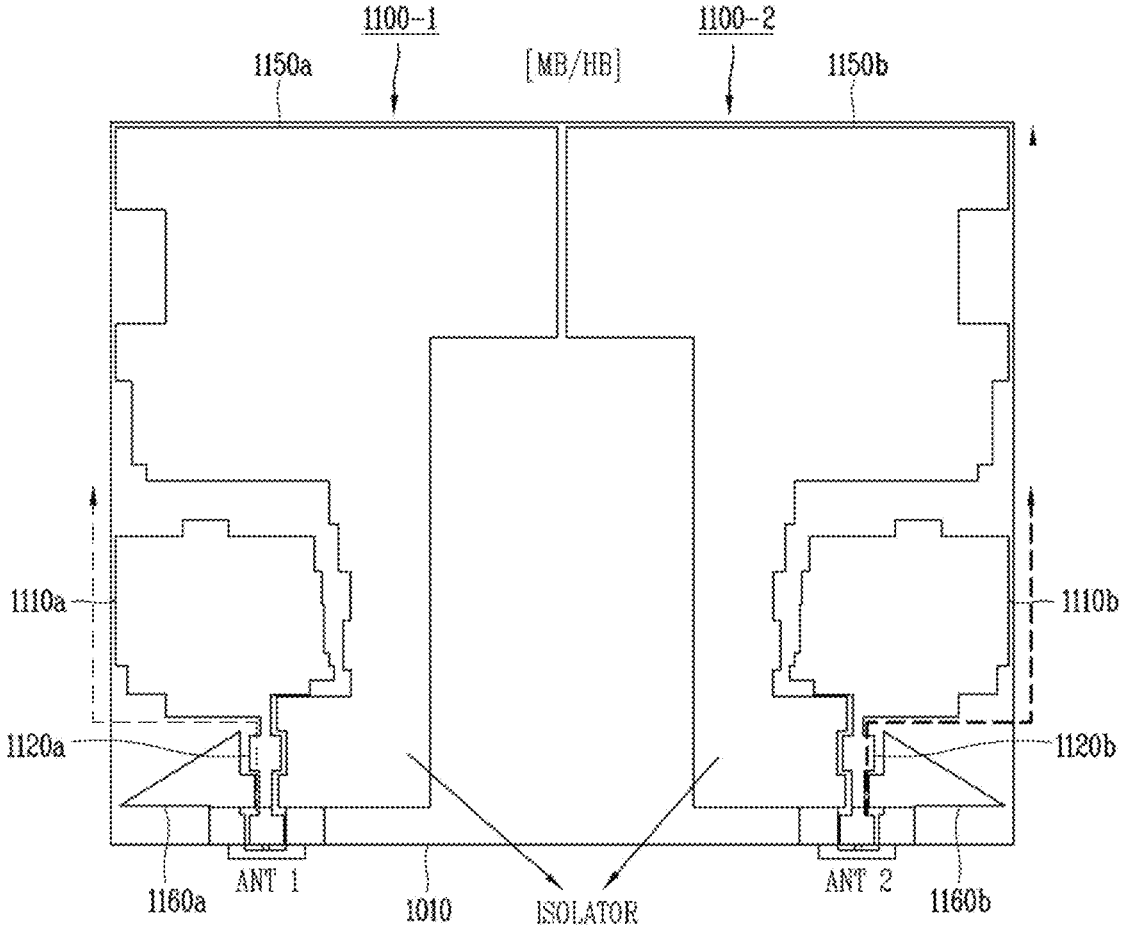
Figure 13B:
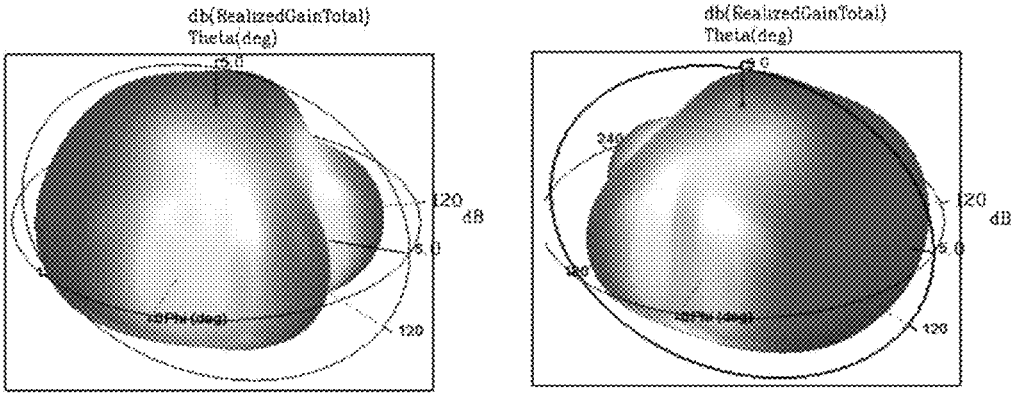
Figure 13C:
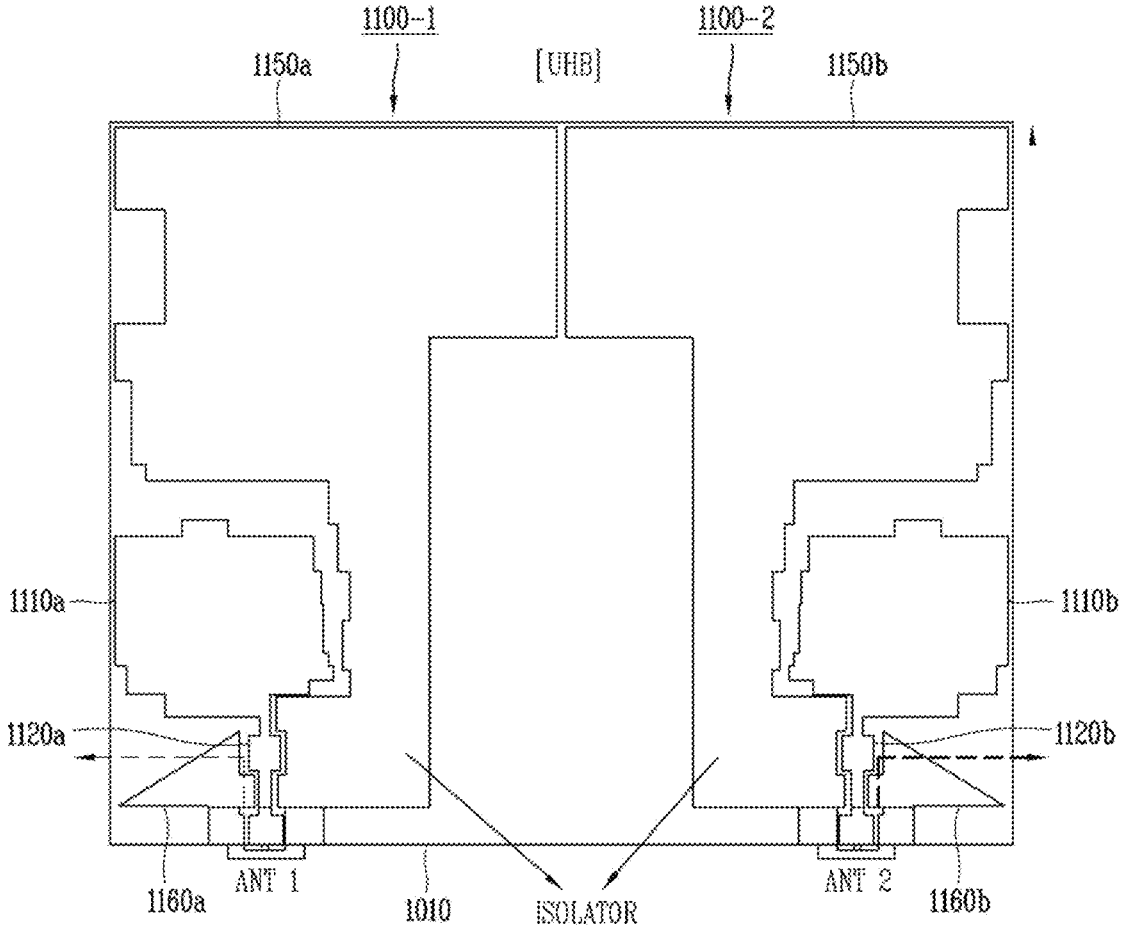
Figure 13C:
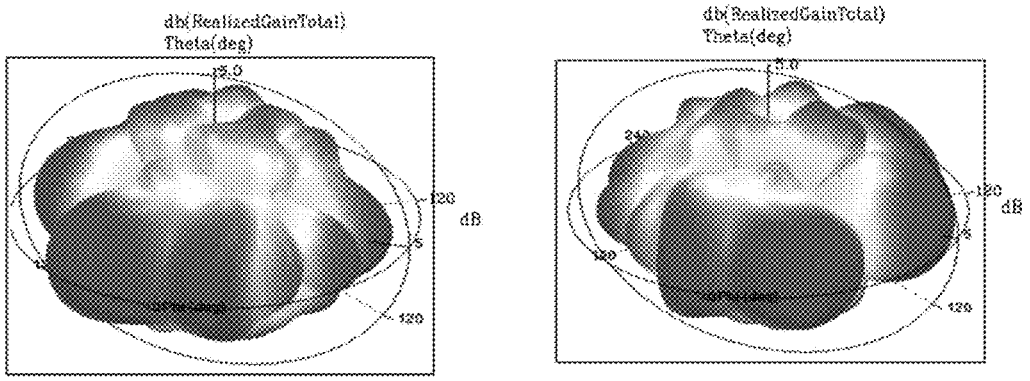

In some examples, in the mirror-type MIMO antenna structure, the extended ground structure of the upper region may serve as an isolator between antennas. FIGS. 13A to 13C illustrate current paths and radiation patterns in the first to third bands.

Referring to (a) to (c) of FIG. 13A, main current paths are indicated for the first to third bands, respectively. LB may be set to the first band, MB/HB may be set to the second band, and UHB may be set to the third band. Referring to FIGS. 6 and 9B, and (a) to (c) of FIG. 13A, the single antenna elements may be arranged in the mirror shape so that the main current paths are spaced apart for each antenna.

Accordingly, the interference between the antennas can be minimized even when the first and second radiation structures 1100-1 and 1100-2 are disposed at a narrow gap corresponding to the gap region G1. As the first and second radiation structures 1100-1 and 1100-2 are disposed in the mirror shape, an overlapping region between radiation patterns can be minimized, thereby minimizing the interference between the antennas. In some examples, the third and fifth conductive patterns 1150*a* and 1150*b* implemented as the extended grounds may operate as an isolator between antenna elements, particularly, when operating in MB/HB/UHB.

Referring to FIGS. 6 and 9B, and (a) of FIG. 13A, main current paths formed at the first and second antennas ANT1 and ANT2 are formed along the first and third side surfaces S1 and S3 of the third and fifth conductive patterns 1150*a* and 1150*b*. Referring to FIGS. 6, 9B, and (b) of FIG. 13A, peaks of radiation patterns of the first and second antennas ANT1 and ANT2 in the first band are formed in different directions according to the mirror structure. Therefore, as the first and second radiation structures 1100-1 and 1100-2 are disposed in the mirror shape, an overlapping region between radiation patterns can be minimized, thereby minimizing the interference between the antennas.

Referring to FIGS. 6 and 9B, and (a) of FIG. 13B, main current paths formed at the first and second antennas ANT1 and ANT2 are formed along outer side surfaces of the first and fourth conductive patterns 1110*a* and 1110*b*. A distance between the main current paths between the outer side surfaces of the first and fourth conductive patterns 1110*a* and 1110*b* may increase more than a distance between the main current paths in the LB. Accordingly, the isolation between the first and second antennas ANT1 and ANT2 in MB/HB is more improved than that in LB.

Referring to FIGS. 6, 9B, and (b) of FIG. 13B, peaks of radiation patterns of the first and second antennas ANT1 and ANT2 in the second band are formed in different directions according to the mirror structure. Therefore, as the first and second radiation structures 1100-1 and 1100-2 are disposed in the mirror shape, an overlapping region between radiation patterns can be minimized, thereby minimizing the interference between the antennas.

Referring to FIGS. 6 and 9B, and (a) of FIG. 13C, main current paths formed at the first and second antennas ANT1 and ANT2 are formed along inner side surfaces and outer side surfaces of the second and sixth conductive patterns 1160*a* and 1160*b*. A distance between the main current paths formed along the inner side surfaces of the outer side surfaces of the second and sixth conductive patterns 1160*a* and 1160*b* may increase more than the distance between the main current paths in the LB. Accordingly, the isolation between the first and second antennas ANT1 and ANT2 in UHB is more improved than that in LB.

Referring to FIGS. 6, 9B, and (b) of FIG. 13C, peaks of radiation patterns of the first and second antennas ANT1 and ANT2 in the second band are formed in different directions according to the mirror structure. Therefore, as the first and second radiation structures 1100-1 and 1100-2 are disposed in the mirror shape, an overlapping region between radiation patterns can be minimized, thereby minimizing the interference between the antennas.

As described above, the antenna elements of the CPW antenna module having the mirror structure can operate simultaneously for each band. In this regard, FIG. 14 illustrates a radiation pattern characteristic for each band with respect to the first and second type MIMO antennas.

Figure 14:
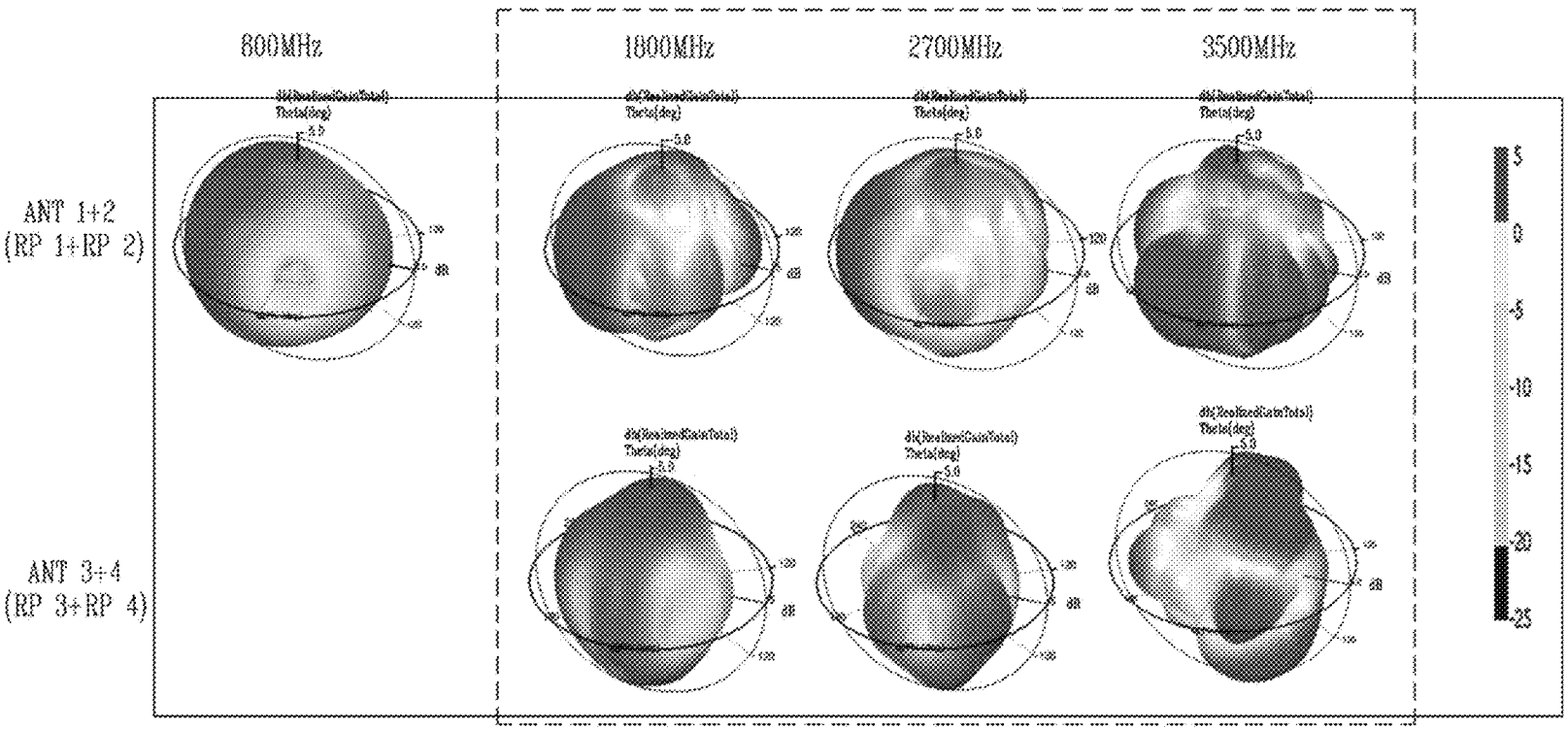
FIG. 14 illustrates a radiation pattern characteristic for each band with respect to the first and second type MIMO antennas.

Referring to FIGS. 6, 9B, and 14, the first type MIMO antennas corresponding to the first and second antennas ANT1 and ANT2 may operate in the first to third bands. Also, the second type MIMO antennas corresponding to the third and fourth antennas ANT3 and ANT4 may operate in the first to third bands.

Referring to FIGS. 6, 9B, 13A to 13C, and 14, when the first and second antennas ANT1 and ANT2 operate simultaneously in the first to third bands, the radiation patterns may also be formed in a symmetrical shape.

Referring to (b) of FIG. 13A, when the first or second antenna ANT1 or ANT2 operates, the peaks of the radiation patterns RP1 and RP2 are formed in different directions and the radiation patterns are also formed in an asymmetric shape in the first band. Here, the first band may be LB and, for example, the operating frequency may be 800 MHz, but is not limited thereto. In some examples, in FIG. 14, when the first and second antennas ANT1 and ANT2 operate simultaneously, a combined radiation pattern in the first band may be the sum of the radiation patterns RP1 and RP2. Accordingly, when the first and second antennas ANT1 and ANT2 operate simultaneously, the radiation patterns can also be formed in the symmetrical shape in the first band.

Referring to (b) of FIG. 13B, when the first or second antenna ANT1 or ANT2 operates, the peaks of the radiation patterns RP1 and RP2 are formed in different directions and the radiation patterns are also formed in an asymmetric shape in the second band. Here, the second band may be MB/HB and, for example, the operating frequencies may be 1900 MHz and 2700 MHz, but is not limited thereto. In some examples, in FIG. 14, when the first and second antennas ANT1 and ANT2 operate simultaneously, a combined radiation pattern in the second band may be the sum of the radiation patterns RP1 and RP2. Accordingly, when the first and second antennas ANT1 and ANT2 operate simultaneously, the radiation patterns can also be formed in the symmetrical shape in the second band.

Referring to (b) of FIG. 13B, when the first or second antenna ANT1 or ANT2 operates, the peaks of the radiation patterns RP1 and RP2 are formed in different directions and the radiation patterns are also formed in an asymmetric shape in the third band. Here, the third band may be UHB and, for example, the operating frequency may be 3500 MHz, but is not limited thereto. In some examples, in FIG. 14, when the first and second antennas ANT1 and ANT2 operate simultaneously, a combined radiation pattern in the third band may be the sum of the radiation patterns RP1 and RP2. Accordingly, when the first and second antennas ANT1 and ANT2 operate simultaneously, the radiation patterns can also be formed in the symmetrical shape in the third band.

Referring to FIGS. 6, 9B, and 14, when the third and fourth antennas ANT3 and ANT4 operate simultaneously in the second and third bands, the radiation patterns may also be formed in a symmetrical shape. When the third and fourth antennas ANT3 and ANT4 operate simultaneously, a combined radiation pattern may be formed by the sum of the respective radiation patterns RP3 and RP4 by the third and fourth antennas ANT3 and ANT4. Accordingly, when the third and fourth antennas ANT3 and ANT4 operate simultaneously, the radiation patterns can also be formed in the symmetrical shape in the second band and the third band.

Figure 15A:
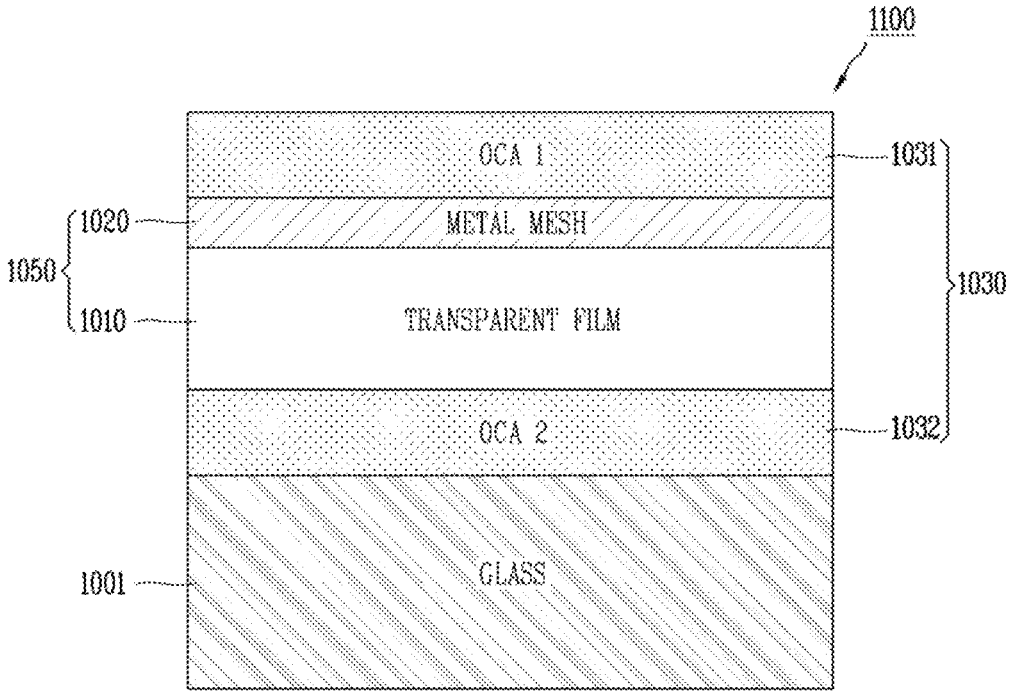
FIG. 15A illustrates a layered structure of an antenna assembly in which a transparent antenna implemented in the form of a metal mesh is disposed on glass and a mesh grid structure.
Figure 15A:
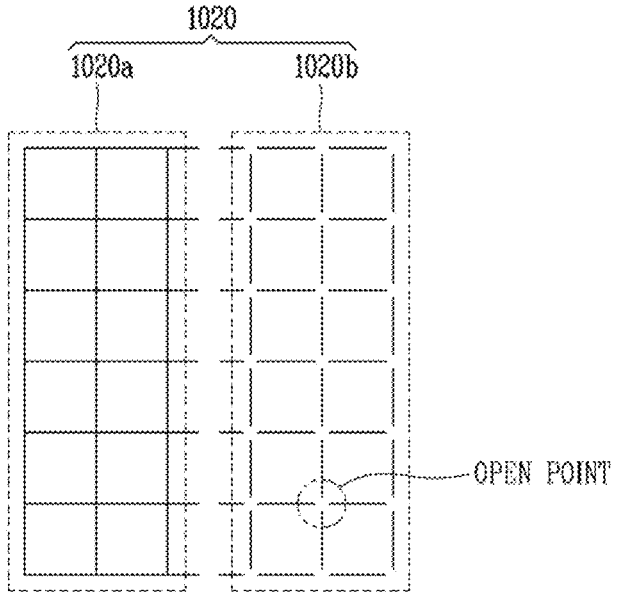
Figure 15B:
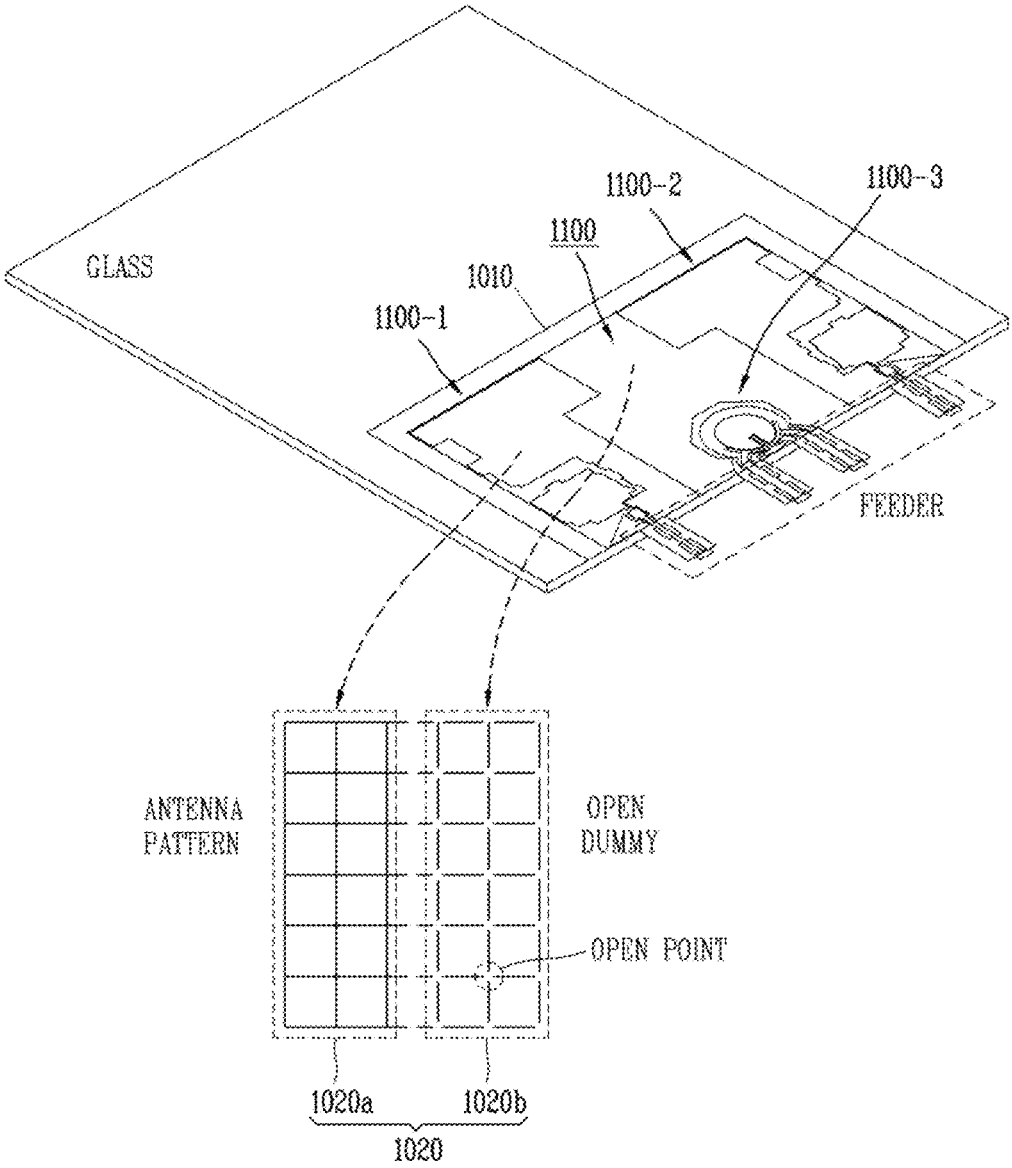
FIG. 15B illustrates an antenna assembly with a transparent antenna, in which a 4×4 MIMO antenna is implemented in the form of a metal mesh on glass, and a mesh grid structure thereof.

In some examples, the wideband dual polarized antenna structure may be implemented as a transparent antenna in the form of a metal mesh on glass or a display. FIG. 15A illustrates a layered structure of an antenna assembly in which a transparent antenna implemented in the form of a metal mesh is disposed on glass and a mesh grid structure. FIG. 15B illustrates an antenna assembly with a transparent antenna, in which a 4×4 MIMO antenna is implemented in the form of a metal mesh on glass, and a mesh grid structure thereof.

Referring to (a) of FIG. 15A, the layered structure of an antenna assembly on which the transparent antenna is disposed may include glass 1001, a dielectric substrate 1010, a metal mesh layer 1020, and an optical clear adhesive (OCA) layer 1030. The dielectric substrate 1010 may be implemented as a transparent film. The OCA layer 1030 may include a first OCA layer 1031 and a second OCA layer 1032.

The glass 1001 may be made of a glass material, and the second OCA layer 1032 serving as a glass attachment sheet may be attached to the glass 1001. As one example, the glass 1001 may have a thickness of about 3.5 to 5.0 mm, but is not limited thereto. The glass 1001 may constitute the front window 301 of the vehicle illustrated in FIGS. 1A and 1B.

The dielectric substrate 1010 made of the transparent film material may constitute a dielectric region at which conductive patterns of the upper metal mesh layer 1020 are disposed. The dielectric substrate 1010 may have a thickness of about 100 to 150 mm, but is not limited thereto.

The metal mesh layer 1020 may be formed by the plurality of metal mesh grids as illustrated in FIG. 5. Conductive patterns may be configured such that the plurality of metal mesh grids operate as feeding lines or radiators. The metal mesh layer 1020 may constitute a transparent antenna region. As one example, the metal mesh layer 1020 may have a thickness of about 2 mm, but is not limited thereto.

The metal mesh layer 1020 may include a metal mesh grid 1020*a* and a dummy mesh grid 1020*b*. In some examples, the first OCA layer 1031 serving as a transparent film layer for protecting the conductive patterns from an external environment may be disposed on upper regions of the metal mesh grid 1020*a* and the dummy mesh grid 1020*b*.

The first OCA layer 1031 may be a protective sheet of the metal mesh layer 1020 and may be disposed on the upper region of the metal mesh layer 1020. As one example, the first OCA layer 1031 may have a thickness of about 20 to 40 mm, but is not limited thereto. The second OCA layer 1032 may be the glass attachment sheet and may be disposed on the upper region of the glass 1001. The second OCA layer 1032 may be disposed between the glass 1001 and the dielectric substrate 1010 made of the transparent film material. As one example, the second OCA layer 1032 may have a thickness of about 20 to 50 mm, but is not limited thereto.

Referring to FIGS. 5, 6, 9B, and 15B, the antenna assembly 1100 may be implemented as a transparent antenna. To this end, the first and fourth conductive patterns 1110*a* and 1110*b* and the feeding lines 1120*a* and 1120*b* may be formed by the metal mesh layer 1020 on which the plurality of grids are electrically connected. The third and fifth conductive patterns 1150*a* and 1150*b* and the second and sixth conductive patterns 1160*a* and 1160*b* may also be formed by the metal mesh layer 1020 on which the plurality of grids are electrically connected. In addition to the first and second radiation structures 1100-1 and 1100-2, the third radiation structure 1100-3 may also be formed by the metal mesh layer 1020.

On the other hand, the dummy mesh grid 1020*b* disposed at the dielectric region may be implemented as an open dummy pattern in which a plurality of grids are disconnected at connection points. Accordingly, the antenna assembly 1100 may be implemented as the transparent antenna on the dielectric substrate 1010, and an entire region on which the dielectric substrate 1010 is disposed may be referred to as a transparent antenna region.

The transparent antenna region may be divided into an antenna pattern region and an open dummy region. The antenna pattern region may be defined by the metal mesh grid 1020*a* in which the plurality of grids are connected to one another. On the other hand, the open dummy region may be defined by the dummy mesh grid 1020*b* having an open dummy structure disconnected at the connection points. The first and second radiation structures 1100-1 and 1100-2 and the third radiation structure 1100-3 constituting the transparent antenna may implement a CPW structure disposed on the dielectric substrate 1010.

In some examples, a feeder interfaced with the glass corresponding to the transparent region in the form of the metal mesh of FIG. 15B may define a non-transparent region. The feeder defining the non-transparent region may also be implemented as a CPW transmission line. An end portion of the feeder implemented as the CPW transmission line may be fastened by an RF connector. The RF connector may be implemented as an SMA type or a Fakra type, but is not limited thereto, and may alternatively be implemented as an arbitrary interface capable of transmitting an RF signal.

Figure 16A:
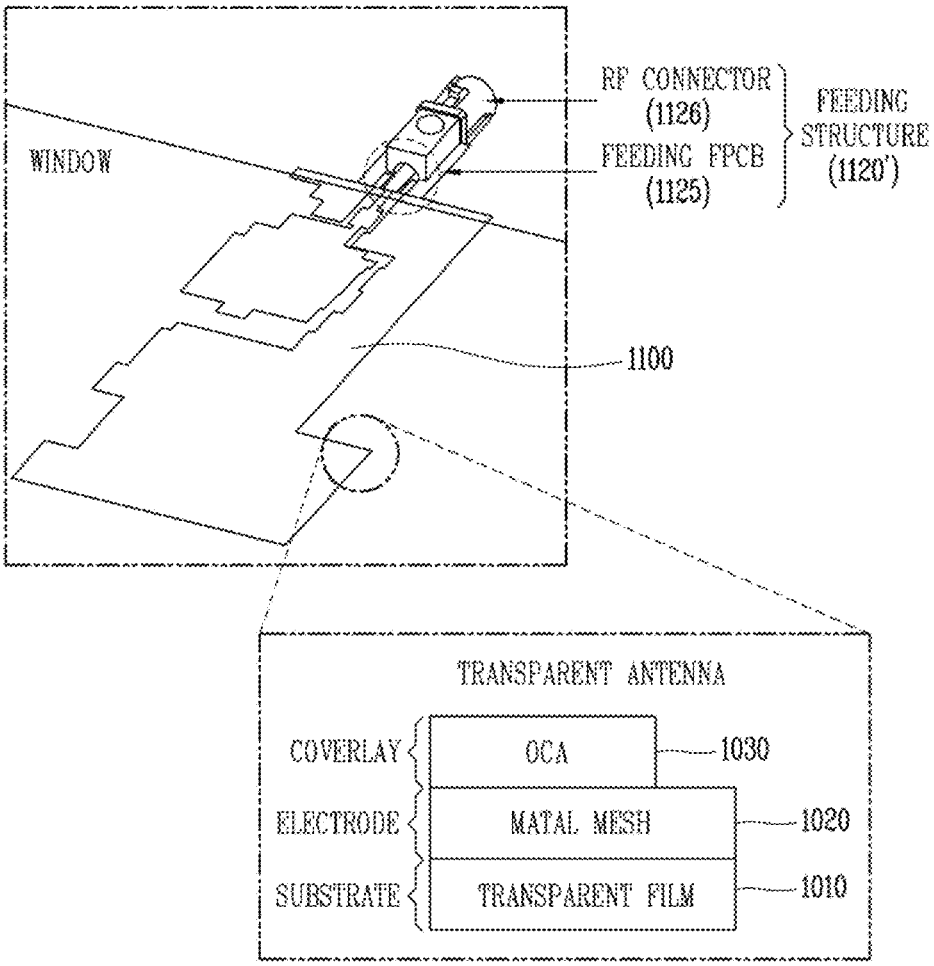
FIG. 16A illustrates that an antenna assembly disposed on a vehicle window as a transparent region or on a dielectric substrate attached to the window is coupled to a CPW transmission line and a connector structure which are disposed on a non-transparent region.
Figure 16B:
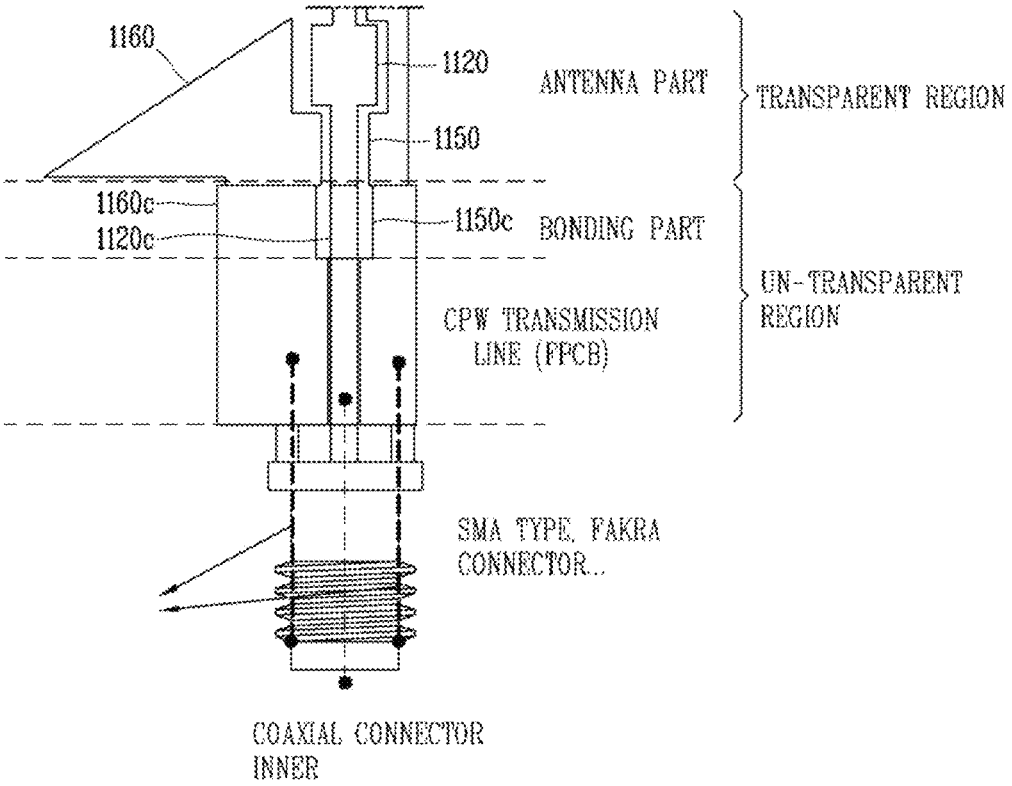
FIG. 16B is an enlarged view of a bonding part between the transparent region and the non-transparent region of FIG. 16A.

The antenna assembly 1100 disposed on the vehicle window (glass) may be implemented as the transparent antenna. In some examples, the CPW transmission line for feeding power to the transparent antenna and its bonding part may be disposed at the non-transparent region. FIG. 16A illustrates a structure that an antenna assembly disposed on a vehicle as a transparent region or a dielectric substrate attached to the window is coupled to a CPW transmission line and a connector structure which are disposed at a non-transparent region. FIG. 16B is an enlarged view of a bonding part between the transparent region and the non-transparent region of FIG. 16A.

Referring to FIG. 16A, the CPW antenna structure implemented on the vehicle window is indicated by the antenna assembly 1100 having the CPW antenna structure of FIG. 6. However, it is not limited to the antenna assembly 1100 of FIG. 6 and may be replaced with the antenna assemblies 1100*a* and 1100*b* of FIGS. 5A and 5B. In some examples, a feeding structure 1120' may further include a feeding FPCB 1125 connected to the feeding line 1120, and an RF connector 1126.

Referring to the lateral view of the antenna assembly 1100, conductive patterns may be disposed in the form of the metal mesh 1020 on the transparent film 1010. In some examples, the OCA layer 1030 may be disposed on the conductive patterns formed of the metal mesh 1020, that is, on the radiator region 1110, the feeding line 1120, and the upper regions of the first and second conductive patterns 1150 and 1160.

Referring to FIGS. 5, 6, 9B, 16A, and 16B, lower end portions of the feeding line 1120, the third conductive pattern 1150, and the second conductive pattern 1160 that constitute the transparent antenna may be connected on the same plane to a feeding line 1120*c*, a first ground 1150*c*, and a second ground 1160*c* of the bonding part, respectively. The feeding line 1120*c*, the first ground 1150*c*, and the second ground 1160*c* of the bonding part may be disposed at the non-transparent region. The feeding line 1120*c*, the first ground 1150*c*, and the second ground 1160*c* of the bonding part may constitute a CPW structure disposed on a second dielectric substrate 1010*b* different from the dielectric substrate 1010. The dielectric substrate 1010 may be implemented as a transparent substrate and the second dielectric substrate 1010*b* may be implemented as a non-transparent substrate.

The foregoing description has been given of the wideband antenna assembly implemented as the transparent antenna according to one aspect. Hereinafter, an antenna system for a vehicle having an antenna assembly according to another aspect will be described. An antenna assembly attached to the vehicle glass may be implemented as a transparent antenna.

Figure 17A:
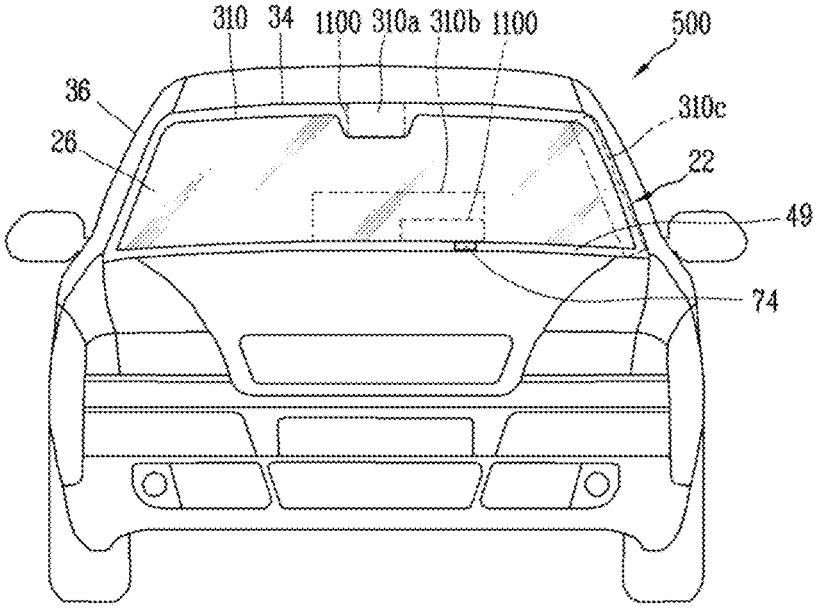
FIG. 17A is a front view of a vehicle in which a transparent antenna can be implemented on glass.
Figure 17B:
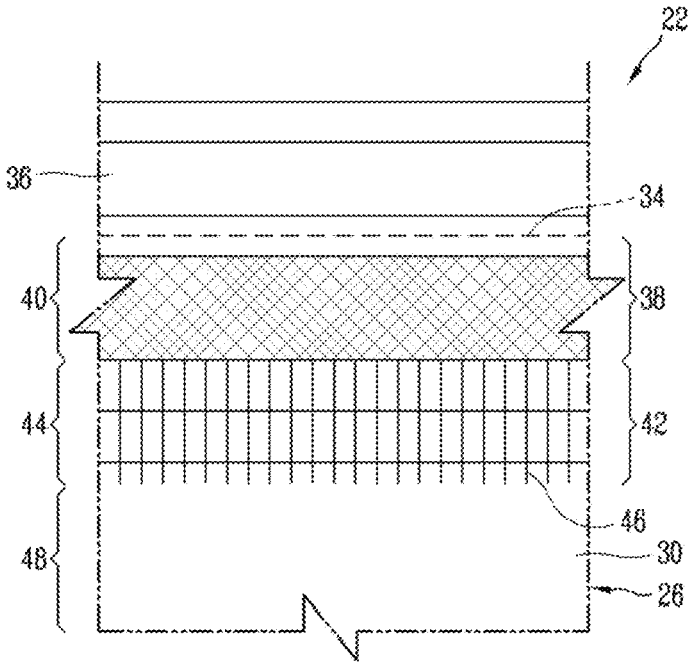
FIG. 17B illustrates a detailed configuration of a transparent glass assembly, in which a transparent antenna can be implemented.

FIG. 17A is a front view of a vehicle in which a transparent antenna can be implemented on glass. FIG. 17B illustrates a detailed configuration of a transparent glass assembly, in which a transparent antenna can be implemented.

Referring to FIG. 17A which is the front view of the vehicle 500, a configuration in which the transparent antenna for the vehicle can be disposed is illustrated. A pane assembly 22 may include an antenna disposed on an upper region 310*a*. Additionally, the pane assembly 22 may include a translucent pane glass 26 formed of a dielectric substrate. The antenna of the upper region 310*a* may support any one or more of a variety of communication systems.

The antenna disposed on the upper region 310*a* of the front window 310 of the vehicle may operate in a mid band MB, a high band HB, and a 5G Sub 6 band of 4G/5G communication systems. The front window 310 of the vehicle may be formed of the translucent pane glass 26. The translucent pane glass 26 may include a first part 38 at which the antenna and a portion of a feeder are formed, and a second part 42 at which another portion of the feeder and a dummy structure are formed. The translucent pane glass 26 may further include external regions 30 and 36 at which conductive patterns are not formed. For example, the outer region 30 of the translucent pane glass 26 may be a transparent region 48 formed to be transparent to secure light transmission and a field of view.

Although it is exemplarily illustrated that the conductive patterns can be formed at a partial region of the front window 310, another example may illustrate that the conductive patterns extend to the side glass 320 of FIG. 1B, the rear glass 330 of FIG. 3C, and an arbitrary glass structure. An occupant or driver in the vehicle 20 can see roads and surrounding environments through the translucent pane glass 26 generally without obstruction by the antenna disposed at the upper region 310*a*.

Referring to FIGS. 17A and 17B, the antenna disposed at the upper region 310*a* may include a first part 38 corresponding to an entire first region 40 of the translucent pane glass 26, and a second part 42 corresponding to an entire second region 44 of the translucent pane glass 26 located adjacent to the first region 40. The first part 38 may have a greater density (i.e., a larger grid structure) than the second part 42. Because the density of the first part 38 is greater than the density of the second part 42, the first part 38 may be perceived to be more transparent than the second part 42. Also, antenna efficiency of the first part 38 may be higher than antenna efficiency of the second part 42.

Accordingly, it may also be configured such that an antenna radiator is disposed at the first part 38 and a dummy radiator (dummy portion) is disposed at the second part 42. When the antenna assembly 1100 is implemented at the first part 38 that is the upper region 310*a* of the front glass 310 of the vehicle, the dummy radiator or a portion of the feeding line may be disposed at (attached to) the second part 42.

In this regard, the antenna region may be implemented at the upper region 310*a* of the front glass 310 of the vehicle. The conductive patterns in the form of the metal mesh grid constituting the antenna may be disposed at the first part 38. In some examples, a dummy mesh grid may be disposed at the first part 38 for visibility. In addition, in view of maintaining transparency between the first part 38 and the second part 42, conductive patterns in the form of the dummy mesh grid may also be disposed at the second part 42. An interval between mesh grids 46 disposed at the second part 42 may be wider than an interval between mesh grids disposed at the first part 38.

Conductive mesh grids disposed at the first part 38 of the antenna disposed at the upper region 310*a* may extend up to a region including a peripheral part 34 and the second part 42 of the translucent pane glass 26. The antenna of the upper region 310*a* may extend in one direction along the peripheral part 34.

The antenna assembly 1100 such as the transparent antenna may be disposed at the upper region 310*a* of the front glass 310 of the vehicle, but is not limited thereto. When the antenna assembly 1100 is disposed at the upper region 310*a* of the front glass 310, the antenna assembly 1100 may extend up to an upper region 38 of the translucent pane glass 26. The upper region 38 of the translucent pane glass 26 may have lower transparency than other portions. A part of the feeder and other interface lines may be disposed at the upper region 38 of the translucent pane glass 26. When the antenna assembly 1100 is disposed at the upper region 310*a* of the front glass 310 of the vehicle, the antenna assembly 1100 may cooperate with the second antenna system 1000*b* of FIGS. 3A to 3C.

The antenna assembly 1100 may be disposed at the lower region 310*b* or the side region 310*c* of the front glass 310 of the vehicle. When the antenna assembly 1100 is disposed at the lower region 310*b* of the front glass 310 of the vehicle, the antenna assembly 1100 may extend up to a lower region 49 of the translucent pane glass 26. The lower region 49 of the translucent pane glass 26 may have lower transparency than other portions. A part of the feeder and other interface lines may be disposed at the lower region 49 of the translucent pane glass 26. A connector assembly 74 may be disposed at the lower region 49 of the translucent pane glass 26.

When the antenna assembly 1100 is disposed at the lower region 310*b* or the side region 310*c* of the front glass 310 of the vehicle, the antenna assembly 1100 may cooperate with the internal antenna system 1000 of the vehicle illustrated in FIGS. 3A to 3C. However, the cooperation configuration between the antenna system 1000 and the second antenna system 1000*b* is not limited thereto and may vary depending on applications. In some examples, the antenna assembly 1100 may alternatively be disposed at the side glass 320 of the vehicle of FIG. 1B.

Figure 18:
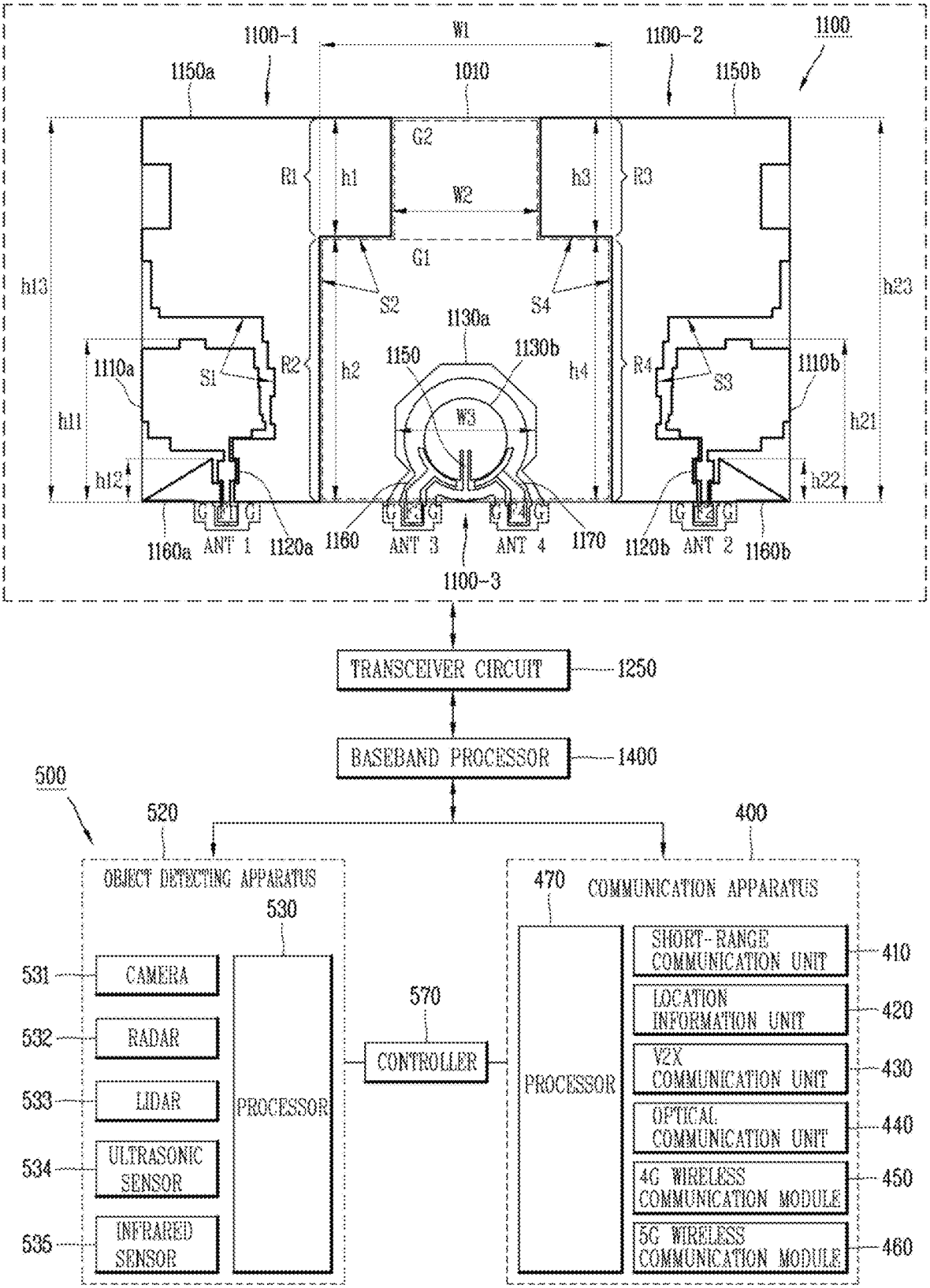
FIG. 18 is a block diagram illustrating a configuration of a vehicle to which a vehicle antenna system is mounted, according to one example.

Referring to FIGS. 1A to 17B, the antenna system 1000 for the vehicle including the antenna assembly 1100 may include a transparent pane assembly 1050 of FIG. 15A. FIG. 18 is a block diagram illustrating a configuration of a vehicle on which a vehicle antenna system is mounted, according to an example.

Referring to FIGS. 1A to 18, the vehicle 500 may include the vehicle antenna system 1000. The vehicle 500 may include the communication apparatus 400 and the object detecting apparatus 520 in addition to the vehicle antenna system 1000. A detailed description of the communication apparatus 400 and the object detecting apparatus 520 will be replaced with the description in FIG. 4. Referring to FIGS. 1A, 1B, and 15, the vehicle 500 may include a conductive vehicle body operating as an electrical ground.

The vehicle antenna system 1000 may include the antenna assembly 1100 disposed at the transparent pane assembly 1050. Referring to FIGS. 15A and 15B, the antenna assembly 1100 may include the dielectric substrate 1010 and the metal mesh layer 1020, but is not limited thereto.

The glass 1001 may constitute a window of the vehicle. The glass 1001 may be attached to the dielectric substrate 1010 made of the transparent film material through the OCA layer 1032. The dielectric substrate 1010 may be attached to the glass 1001 and configured to form conductive patterns in the form of the mesh grid.

The antenna system 1000 may include antenna elements disposed on the glass 1001, the dielectric substrate 1010, and the metal mesh layer 1020. The antenna elements may be implemented as conductive patterns on the dielectric substrate 1010 to radiate radio signals. The antenna elements may include the first and second radiation structures 1100-1 and 1100-2. The antenna elements may further include the third radiation structure 1100-3 operating as the dual polarized antenna. Meanwhile, the dielectric substrate 1010 formed or disposed at one region of the glass may include first to third radiation structures 1100-1 to 1100-3 and gap regions G1 and G2.

The first radiation structure 110-1 to the third radiation structure 1100-3 may be disposed on the dielectric substrate 1010. The first radiation structure 1100-1 may include the third conductive pattern 1150*a* and the second conductive pattern 1160*a* that are defined at both sides of the first conductive pattern 1100*a* on the dielectric substrate 1010 in one axial direction to have different lengths. The second radiation structure 1100-2 may include the fifth conductive pattern 1150*b* and the sixth conductive pattern 1160*b* that are defined at both sides of the fourth conductive pattern 1100*b* in the one axial direction to have different lengths. The third radiation structure 1100-3 may be disposed between the first radiation structure 1100-1 and the second radiation structure 1100-2.

The gap regions G1 and G2 may be defined between the third conductive pattern 1150*a* of the first radiation structure 1100-1 and the fifth conductive pattern 1150*b* of the second radiation structure 1100-2. The gap regions G1 and G2 may include the first gap region G1 defined at the lower region and the second gap region G2 defined at the upper region. The second gap region G2 may be defined at a region higher than the first gap region G1 in the one axial direction. The first gap of the first gap region G1 may be wider than the second gap of the second gap region G2, and the third radiation structure 1100-3 may be disposed at the first gap region G1 that is the lower region. The third radiation structure 1100-3 may be disposed between the first radiation structure 1100-1 and the second radiation structure 1100-2 to reduce interference between the first and second radiation structures 1100-1 and 1100 in a low band.

The first radiation structure 110-1 and the second radiation structure 1100-2 may be disposed on the dielectric substrate 1010 in the symmetrical structure. The third radiation structure 1100-3 may operate as a dual feed antenna.

The first radiation structure 1100-1 and the second radiation structure 1100-2 may mirror each other in the symmetrical structure such that the third conductive pattern 1150*a* of the first radiation structure 1100-1 and the fifth conductive pattern 1150*b* of the second radiation structure 1100-2 face each other. The first radiation structure 1100-1 and the second radiation structure 1100-2 may be formed in the symmetrical structure with respect to the center line between the first radiation structure 1100-1 and the second radiation structure 1100-2.

The first radiation structure 1100-1 and the second radiation structure 1100-2 may be fed by the first feeding line 1120*a* and the second feeding line 1120*b*. The third radiation structure 1100-3 may be rotated by a predetermined angle in a diagonal direction so as to be fed by the third feeding line 1160 and the fourth feeding line 1170 formed in parallel to the one axial direction.

The first feeding line 1120*a* to the fourth feeding line 1170 may be parallel to the one axial direction, and a first end portion of the first feeding line 1120*a* to a fourth end portion of the fourth feeding line 1170 may be disposed on the same line in parallel to another axial direction. The first end portion of the first feeding line 1120*a* to the fourth end portion of the fourth feeding line 1170 may be electrically connected to feeding lines disposed at the non-transparent region of the glass.

The plurality of antennas may be operably coupled to the transceiver circuit 1250 and the processor 1400. In this regard, the first radiation structure 1100-1 and the second radiation structure 1100-2 may be connected to the first feeding line 1120*a* and the second feeding line 1120*b* to operate as the first antenna ANT1 and the second antenna ANT2, respectively. On the other hand, the third radiation structure 1100-3 may be connected to the third feeding line 1160 and the fourth feeding line 1170 to operate as the third antenna ANT3 and the fourth antenna ANT4.

The antenna system 1000 may further include the transceiver circuit 1250 and the processor 1400. The transceiver circuit 1250 may be operably coupled to the antenna elements through the first feeding line 1120*a* to the fourth feeding line 1170. The transceiver circuit 1250 may control a radio signal of at least one of the first to third bands to be radiated through the antenna assembly 1100. The processor 1400 may be operably coupled to the transceiver circuit 1250. The processor 1400 may control the transceiver circuit 1250.

The processor 1400 may control the transceiver circuit 1250 so that radio signals of different bands are applied to the feeding line 1120, so as to perform Carrier Aggregation (CA) or Dual Connectivity (DC) through the antenna module 1100.

The processor 1400 may perform MIMO in the first band through the first antenna 1110-1, ANT1 and the second antenna 1110-2, ANT2. The processor 1400 may perform MIMO in at least one of the second band and the third band through the first antenna 1110-1, ANT1 to the fourth antenna 1110-4, ANT4. The processor 1400 may control the transceiver circuit 1250 to perform the CA or DC through at least one of the first antenna 1110-1, ANT1 to the fourth antenna 1110-4, ANT4.

In some examples, the CA operation and/or the DC operation may be carried out using the third radiation structure 1110-3 corresponding to the wideband dual polarized antenna. In this regard, the processor 1400 may control the transceiver circuit 1250 to apply a first radio signal and a second radio signal of different bands to the third antenna ANT3 and the fourth antenna ANT4.

To this end, different RF chains may be connected to different ports of one antenna element. Accordingly, a first RF chain of the transceiver circuit 1250 may apply the first signal of the first band to the third feeding line 1160. On the other hand, a second RF chain of the transceiver circuit 1250 may apply the second signal of the second band to the fourth feeding line 1170. Accordingly, the CA operation and/or the DC operation can be carried out by combining (the signals of) the different bands using the single antenna element.

So far, the antenna system having the wideband antenna made of the transparent material and the vehicle having the same have been described. Hereinafter, technical effects of the antenna system having the wideband antenna made of the transparent material and the vehicle having the same will be described.

In some implementations, an antenna made of a transparent material that operates in a wideband range capable of providing LTE and 5G communication services can be provided by allowing grounds asymmetrically disposed at both sides of a radiator region to operate in different bands.

In some implementations, a transparent antenna made of a transparent material, which has a radiator region including conductive patterns of a stepped structure with different widths so as to form multiple resonance points and can operate in a wideband range, can be provided.

In some implementations, an entire size of a transparent antenna and a feeding loss can be minimized by minimizing a length of feeding lines.

In some implementations, an antenna structure made of a transparent material that can be minimized in antenna size while operating in a wideband range by employing a CPW feeding structure and a radiator structure, in which ground regions are formed in an asymmetric structure, can be provided.

In some implementations, an antenna structure of a transparent material, which can obtain improved antenna efficiency and transparency while operating in a 52ideband range by implementing conductive patterns in a metal mesh structure and defining a dummy pattern even at a dielectric region, can be provided.

In some implementations, a structure, in which an antenna structure made of a transparent material with improved antenna efficiency while operating in a wideband range can be disposed at various positions, such as an upper, lower, or side region of a front window of a vehicle, can be provided.

In some implementations, communication performance can be improved by arranging a plurality of transparent antennas on glass of a vehicle or a display of an electronic device.

In some implementations, antenna performance can be optimized for each band and communication capacity can be increased by arranging a plurality of transparent antennas in a symmetrical structure within a limited space of glass of a vehicle and configuring some antenna elements in a different form.

In some implementations, antenna interference between antenna elements can be reduced when the antenna elements operate simultaneously, by way of arranging a plurality of transparent antennas in a symmetrical structure within a limited space of glass of a vehicle and configuring some antenna elements in a different form.

Further scope of applicability of the present disclosure will become apparent from the following detailed description. It should be understood, however, that the detailed description and specific examples, such as the preferred embodiment of the invention, are given by way of illustration only, since various changes and modifications within the spirit and scope of the invention will be apparent to those skilled in the art.

In relation to the aforementioned present disclosure, design and operations of an antenna system and a vehicle controlling the same can be implemented as computer-readable codes in a program-recorded medium. The computer-readable media includes all types of recording devices in which data readable by a computer system can be stored. Examples of such computer-readable media may include hard disk drive (HDD), solid state disk (SSD), silicon disk drive (SDD), ROM, RAM, CD-ROM, magnetic tape, floppy disk, optical data storage element and the like. Also, the computer-readable medium may also be implemented as a format of carrier wave (e.g., transmission via an Internet). The computer may include the controller of the terminal. Therefore, it should also be understood that the above-described implementations are not limited by any of the details of the foregoing description, unless otherwise specified, but rather should be construed broadly within its scope as defined in the appended claims, Therefore, all changes and modifications that fall within the metes and bounds of the claims, or equivalents of such metes and bounds are therefore intended to be embraced by the appended claims.

What is claimed is:

1. An antenna assembly comprising: a dielectric substrate; and antenna elements defined as conductive patterns on the dielectric substrate and configured to radiate radio signals, wherein the antenna elements comprise: a first radiation structure, a second radiation structure, and a third radiation structure, wherein the first radiation structure includes: a first conductive pattern electrically connected with a first feeding portion; and a second conductive pattern and a third conductive pattern electrically connected with a ground; wherein the first conductive pattern is disposed between the second conductive pattern and the third conductive pattern; wherein a size of the second conductive pattern is smaller than a size of the third conductive pattern; wherein the second radiation structure includes: a fourth conductive pattern electrically connected with a second feeding portion; and a fifth conductive pattern and a sixth conductive pattern electrically connected with the ground; wherein the fourth conductive pattern is disposed between the fifth conductive pattern and the sixth conductive pattern; wherein a size of the fifth conductive pattern is bigger than a size of the sixth conductive pattern; wherein the third conductive pattern and the fifth conductive pattern are separated by a gap region, wherein the gap region comprises a first gap portion and a second gap portion; wherein a distance of the first gap portion is wider than a distance of the second gap portion, and wherein the first radiation structure and the second radiation structure are configured in a symmetrical structure with respect to a center line between the first radiation structure and the second radiation structure, wherein the third conductive pattern has a first region and a second region, wherein the first region of the third conductive pattern is connected with the second region of the third conductive pattern, wherein the fifth conductive pattern has a third region and a fourth region, wherein the third region of the fifth conductive pattern is connected with the fourth region of the fifth conductive pattern, and wherein a portion of the second region of the third conductive pattern and a portion of the fourth region of the fifth conductive pattern are connected with the ground, wherein a boundary of the third conductive pattern is faced with a boundary of the fifth conductive pattern, wherein the boundary of the third conductive pattern in the second region is separated from the boundary of the fifth conductive pattern in the fourth region by a first width, wherein the boundary of the third conductive pattern in the first region is separated from the boundary of the fifth conductive pattern in the third region by a second width, and wherein the first width is wider than the second width; and wherein the third radiation structure is disposed in the first gap region, wherein a width of the third radiation structure is the same as the distance of the second gap portion, and wherein a height of the third radiation structure is smaller than a height of the first gap portion, and wherein the third radiation structure is configured in a symmetrical structure with respect to the center line between the first radiation structure and the second radiation structure.

2. The antenna assembly of claim 1, wherein a height of the first conductive pattern is higher than a height of the second conductive pattern, wherein a height of the third conductive pattern is higher than the height of the first conductive pattern, wherein a height of the fourth conductive pattern is higher than a height of the sixth conductive pattern, and wherein a height of the fifth conductive pattern is higher than the height of the fourth conductive pattern.

3. The antenna assembly of claim 1, wherein a height of the boundary of the third conductive pattern in the second region is higher than a height of the boundary of the third conductive pattern in the first region, wherein a height of the boundary of the fifth conductive pattern in the fourth region is higher than a height of the boundary of the fifth conductive pattern in the third region, wherein the height of the boundary of the third conductive pattern in the second region and the height of the boundary of the fifth conductive pattern in the fourth region are same height, wherein the height of the boundary of the third conductive pattern in the first region and the height of the boundary of the fifth conductive pattern in the third region are same height.

4. The antenna assembly of claim 1, wherein the third radiation structure (11) comprises: a seventh conductive pattern having an opening, a first end and a second end of the seventh conductive pattern are electrically connected with the ground, an eighth conductive pattern disposed in the opening, a third end and a fourth end of the eighth conductive pattern are electrically connected with the ground, a first slot disposed between the seventh conductive pattern and the eighth conductive pattern, a ninth conductive pattern disposed in the first slot, an end of the ninth conductive pattern is electrically connected with a third feeding portion, and a tenth conductive pattern disposed in the first slot, an end of the tenth conductive pattern is electrically connected with a fourth feeding portion, wherein the eighth conductive pattern comprises a first part, a second part and a third part connecting the first part and the second part, wherein the second part has the third end and the fourth end of the eighth conductive pattern, and wherein the second part and the third part are disposed between the ninth conductive pattern and the tenth conductive pattern.

5. The antenna assembly of claim 1, wherein the first conductive pattern to the tenth conductive pattern are formed as a metal mesh shape having a plurality of opening area on the dielectric substrate, wherein the first radiation structure, the second radiation structure and the third radiation structure are disposed on one surface of the dielectric substrate, and wherein the first radiation structure, the second radiation structure and the third radiation structure are a Coplanar Waveguide (CPW) structure.

6. The antenna assembly of claim 5, wherein the antenna assembly further comprises a plurality of dummy mesh grid patterns at an outside portion of the first radiation structure, the second radiation structure and the third radiation structure on the one surface of the dielectric substrate, wherein the plurality of dummy mesh grid patterns are not connected with the feeding portions and the ground, and wherein the plurality of dummy mesh grid patterns are separated from each other.

7. The antenna assembly of claim 1, wherein the first radiation structure operates as a first antenna, wherein the second radiation structure operates as a second antenna, wherein the first radiation structure and the second radiation structure operate in a Low, a Middle, a High and an Ultra High frequency bands.

8. The antenna assembly of claim 1, wherein the third radiation structure operates as a third antenna and a fourth antenna, wherein the third radiation structure operate in the Middle, the High and the Ultra High frequency bands.

9. The antenna assembly of claim 1, wherein the first radiation structure and the second radiation structure operate as a 2×2 Multi input Multi output system in the Low frequency band, wherein the first radiation structure, the second radiation structure and the third radiation structure operate as a 4×4 Multi input Multi output system in the Middle, High and Ultra High frequency bands.

10. The antenna assembly of claim 1, wherein the first radiation structure, the second radiation structure and the third radiation structure are disposed in a rectangle of size width 102 mm×length 146 mm.

11. An antenna system for a vehicle that comprises a conductive vehicle body operating as an electrical ground, the antenna system comprising: glass constituting a window of the vehicle; a dielectric substrate attached to the glass and having conductive patterns in the form of a mesh grid; and antenna elements configured as conductive patterns on the dielectric substrate and configured to radiate radio signals, wherein the antenna elements comprise: a first radiation structure; a second radiation structure; and a third radiation structure, wherein the first radiation structure includes: a first conductive pattern electrically connected with a first feeding portion; a second conductive pattern and a third conductive pattern electrically connected with a ground; wherein the first conductive pattern is disposed between the second conductive pattern and the third conductive pattern; wherein a size of the second conductive pattern is smaller than a size of the third conductive pattern; wherein the second radiation structure includes: a fourth conductive pattern electrically connected with a second feeding portion; a fifth conductive pattern and a sixth conductive pattern electrically connected with the ground; wherein the fourth conductive pattern is disposed between the fifth conductive pattern and the sixth conductive pattern; wherein a size of the fifth conductive pattern is bigger than a size of the sixth conductive pattern; wherein the third conductive pattern and the fifth conductive pattern are separated by a gap region, wherein the gap region comprises a first gap portion and a second gap portion; wherein a distance of the first gap portion is wider than a distance of the second gap portion, and wherein the first radiation structure and the second radiation structure are configured in a symmetrical structure with respect to a center line between the first radiation structure and the second radiation structure, wherein the third conductive pattern has a first region and a second region, wherein the first region is connected with the second region, wherein the fifth conductive pattern has a third region and a fourth region, wherein the third region is connected with the fourth region, and wherein a portion of the second region and a portion of the fourth region are connected with the ground, wherein a boundary of the third conductive pattern is faced with a boundary of the fifth conductive pattern, wherein the boundary of the third conductive pattern in the second region is separated from the boundary of the fifth conductive pattern in the fourth region by a first width, wherein the boundary of the third conductive pattern in the first region is separated from the boundary of the fifth conductive pattern in the third region by a second width, and wherein the first width is wider than the second width; and wherein the third radiation structure is disposed in the first gap region, wherein a width of the third radiation structure is the same as the distance of the second gap portion, and wherein a height of the third radiation structure is smaller than a height of the first gap portion, and wherein the third radiation structure is configured in a symmetrical structure with respect to the center line between the first radiation structure and the second radiation structure.

12. The antenna system of claim 11, wherein a height of the first conductive pattern is higher than a height of the second conductive pattern, wherein a height of the third conductive pattern is higher than the height of the first conductive pattern, wherein a height of the fourth conductive pattern is higher than a height of the sixth conductive pattern, and wherein a height of the fifth conductive pattern is higher than the height of the fourth conductive pattern.

* * * * *